US008193989B2

(12) United States Patent
Fujita et al.

(10) Patent No.: US 8,193,989 B2
(45) Date of Patent: Jun. 5, 2012

(54) ANTENNA APPARATUS

(75) Inventors: Seiken Fujita, Saitama (JP); Hisamatsu Nakano, Kodaira (JP); Iichi Wako, Saitama (JP); Ken Tanaka, Saitama (JP); Toshihito Umegaki, Inagi (JP)

(73) Assignees: Hitachi Kokusai Electric Inc., Tokyo (JP); Yagi Antenna Inc., Saitama-Shi (JP)

( * ) Notice: Subject to any disclaimer, the term of this patent is extended or adjusted under 35 U.S.C. 154(b) by 555 days.

(21) Appl. No.: 12/354,227

(22) Filed: Jan. 15, 2009

(65) Prior Publication Data

US 2009/0128442 A1 May 21, 2009

Related U.S. Application Data

(63) Continuation of application No. PCT/JP2007/066480, filed on Aug. 24, 2007.

(30) Foreign Application Priority Data

Aug. 24, 2006 (JP) ..... 2006-228197
Feb. 8, 2007 (JP) ..... 2007-029438

(51) Int. Cl.
*H01Q 1/38* (2006.01)

(52) U.S. Cl. ..... 343/700 MS; 343/846

(58) Field of Classification Search ..... 343/700 MS, 343/829, 833, 834, 846
See application file for complete search history.

(56) References Cited

U.S. PATENT DOCUMENTS 2,746,040 A * 5/1956 Martin ..... 343/830
3,680,135 A * 7/1972 Boyer ..... 343/742
4,672,386 A * 6/1987 Wood ..... 343/770
4,864,320 A * 9/1989 Munson et al. ..... 343/833
4,924,237 A * 5/1990 Honda et al. ..... 343/702
5,014,070 A * 5/1991 Stock et al. ..... 343/700 MS
5,539,418 A * 7/1996 Egashira et al. ..... 343/712
5,784,032 A 7/1998 Johnston et al.
5,912,647 A * 6/1999 Tsuru et al. ..... 343/700 MS
5,926,150 A 7/1999 McLean et al.
6,064,347 A * 5/2000 Fordham ..... 343/749
6,339,402 B1 * 1/2002 McKivergan ..... 343/702
6,456,249 B1 * 9/2002 Johnson et al. ..... 343/702
6,542,128 B1 * 4/2003 Johnson et al. ..... 343/742
6,650,294 B2 * 11/2003 Ying et al. ..... 343/700 MS
6,670,925 B2 * 12/2003 Iwai et al. ..... 343/702
6,750,825 B1 * 6/2004 Delaveaud et al. ..... 343/749

(Continued)

FOREIGN PATENT DOCUMENTS

JP 62-131610 A 6/1987

(Continued)

OTHER PUBLICATIONS

English translation of International Search Report for PCT/JP2007/066480, Nov. 27, 2007.

(Continued)

*Primary Examiner* — Tho G Phan
(74) *Attorney, Agent, or Firm* — Bacon & Thomas, PLLC

(57) ABSTRACT

An aspect of an antenna apparatus according to the present invention is provided with a conductor plate, radiating elements disposed to face the conductor plate and partially short-circuited to the conductor plate, a feeding terminal provided on the conductor plate, and a feeding path connecting the feeding terminal and a feeding portion of the radiating elements to each other.

12 Claims, 54 Drawing Sheets

U.S. PATENT DOCUMENTS

| | | | | |
|---|---|---|---|---|
| 6,876,327 | B2 * | 4/2005 | Collins | 343/700 MS |
| 7,126,546 | B2 * | 10/2006 | Annamaa et al. | 343/702 |
| 7,190,322 | B2 * | 3/2007 | Apostolos et al. | 343/841 |
| 7,345,634 | B2 * | 3/2008 | Ozkar et al. | 343/702 |
| 2005/0116875 | A1 * | 6/2005 | Yuanzhu et al. | 343/846 |

FOREIGN PATENT DOCUMENTS

| | | | |
|---|---|---|---|
| JP | 03-231503 | A | 10/1991 |
| JP | 07-303005 | A | 11/1995 |
| JP | 10-126149 | A | 5/1998 |
| JP | 10-276032 | A | 10/1998 |
| JP | 11-205036 | | 7/1999 |
| JP | 11-205036 | A | 7/1999 |
| JP | 2000-077923 | A | 3/2000 |
| JP | 2003-101341 | A | 4/2003 |
| JP | 2003-142935 | A | 5/2003 |
| JP | 2003-209431 | A | 7/2003 |
| JP | 2003-338783 | A | 11/2003 |
| JP | 2004-072731 | A | 3/2004 |
| JP | 2005-020289 | A | 1/2005 |

OTHER PUBLICATIONS

Official Action of JPO in Japanese Patent Application No. 2007-218922, Jul. 2, 2010.

Examination Report of EPO regarding EP 07806066.2-2220, Jun. 6, 2011.

Office Action issued by Japan Patent Office (JPO) for Japanese Patent Application No. 2007-218939, mailed Nov. 22, 2011 (5 pages).

* cited by examiner

[Horizontal plane directionality]
(710MHz)

[Vertical plane directionality]
(470MHz)

[Vertically-polarized horizintal plane directionality]
(1GHz)

[Vertically-polarized horizintal plane directionality]
(1.6GHz)

[Vertically-polarized horizontal plane directionality]
($\theta$ =45° X-Y plane)
(0.7GHz)

[Vertically-polarized horizontal plane directionality]
($\theta$ =45° X-Y plane)
(1.7GHz)

[Vertically-polarized horizontal plane directionality]
($\theta$ =45° X-Y plane)
(2.7GHz)

[Vertically-polarized vertical plane directionality]
(Z-X plane)
(0.7GHz)

[Vertically-polarized vertical plane directionality]
(Z-Y plane)
(0.7GHz)

[Vertically-polarized vertical plane directionality]
(Z-X plane)
(1.7GHz)

[Vertically-polarized vertical plane directionality]
(Z-Y plane)
(1.7GHz)

[Vertically-polarized vertical plane directionality]
(Z-X plane)
(2.7GHz)

ANTENNA APPARATUS

CROSS REFERENCE TO RELATED APPLICATIONS

This is a Continuation Application of PCT Application No. PCT/JP2007/066480, filed Aug. 24, 2007, which was published under PCT Article 21(2) in Japanese.

This application is based upon and claims the benefit of priority from prior Japanese Patent Applications No. 2006-228197, filed Aug. 24, 2006; and No. 2007-029438, filed Feb. 8, 2007, the entire contents of both of which are incorporated herein by reference.

BACKGROUND OF THE INVENTION

1. Field of the Invention

The present invention relates to an antenna apparatus used in a relay unit.

2. Description of the Related Art

As an antenna for relay which re-transmits ground wave for a mobile phone, television broadcast, or the like to a blind zone such as an underground mall, a small-sized and weight-reduced antenna is demanded in view of a problem about an installation place, aesthetic purposes or the like. As an antenna for relay, vertical polarized and horizontal-plane nondirectional antenna is frequently used.

As a known technique relating to the present invention, a bidirectional polarized antenna apparatus which is provided with a bidirectional antenna for horizontal polarization having a plurality of linear radiating element portions configured to excite a linear or planar impedance matching element portion according to one-point power feeding from a back thereof and provided perpendicularly to the matching element portion, a plurality of distal ends of the linear radiating element portions being grounded, and a grounding plater where the bidirectional antenna for horizontal polarization is disposed on the grounding plate is known (see, Jpn. Pat. Appln. KOKAI Publication No. 11-205036).

BRIEF SUMMARY OF THE INVENTION

Since a relay antenna installed in an underground mall or the like is generally provided on a ceiling or the like, it is required to be small-sized and be reduced in profile (a total height is low).

However, since the abovementioned conventional monopole antenna must have a height of at least about ¼ wavelength and it is difficult to achieve further low profile, it is undesirable as a relay antenna installed in an underground mall or the like. A monopole antenna can obtain excellent characteristics in a single frequency band, but it basically corresponds to a narrow band and its specific bandwidth in a region where VSWR (voltage standing wave ratio) is low, for example, 2 or less is generally about ten and several percentages, so that it is difficult to apply the monopole antenna to an apparatus which performs bulk transmission according to a wideband communication.

The present invention has been made to solve the abovementioned problem and an object thereof is to provide an antenna apparatus which realizes size reduction and low profile, and wider band.

According to a first aspect of the present, there is provided an antenna apparatus comprising: a conductor plate; a radiating element arranged to face the conductor plate and partially short-circuited to the conductor plate; a feeding terminal provided on the conductor plate; and a feeding path connecting the feeding terminal and a feeding portion of the radiating element to each other. Furthermore, the antenna apparatus according to the first aspect further includes at least one passive element capacitance-coupled to a line path connecting the short-circuiting portion of the radiating element and the feeding path to each other.

According to a second aspect of the present, there is provided an antenna apparatus comprising: a conductor plate; a radiating element arranged to face the conductor plate and partially short-circuited to the conductor plate; a feeding terminal provided on the conductor plate; and a feeding path connecting the feeding terminal and a feeding portion of the radiating element to each other, wherein the feeding path has such a shape that a width thereof is expanded from the side of the feeding terminal toward the side of the feeding portion.

According to a third aspect of the present, there is provided an antenna apparatus comprising: a conductor plate; a radiating element arranged to face the conductor plate and partially short-circuited to the conductor plate; a feeding terminal provided at a central portion of the conductor plate; and a feeding path whose one end is connected to the feeding terminal and whose other end is capacitance-coupled to a feeding portion of the radiating element, wherein the feeding path has such a shape that a width thereof is expanded from the side of the feeding terminal toward the side of the feeding portion. Furthermore, according to the third aspect of the antenna apparatus, the other end is partially connected to the feeding portion.

Furthermore, each aspect of the above has the following characteristics.

The radiating element comprises a plurality of line paths expanding about the feeding portion radially at equal intervals and the line paths are short-circuited to the conductor plate, respectively.

The radiating element further includes line paths connecting end portions of adjacent line paths of the plurality of line paths.

The conductor plate further includes a matching portion near the short-circuiting portion of the radiating element.

The short-circuiting portions of the radiating element are provided on the circumference of a circle about the feeding path at equal intervals.

The radiating element is defined as a first radiating element and a second radiating element having a facing distance between the conductor plate and the second radiating element shorter than a facing distance between the conductor plate and the first radiating element is further disposed between the conductor plate and the first radiating element.

DETAILED DESCRIPTION OF THE INVENTION

First Embodiment

Figure 1:
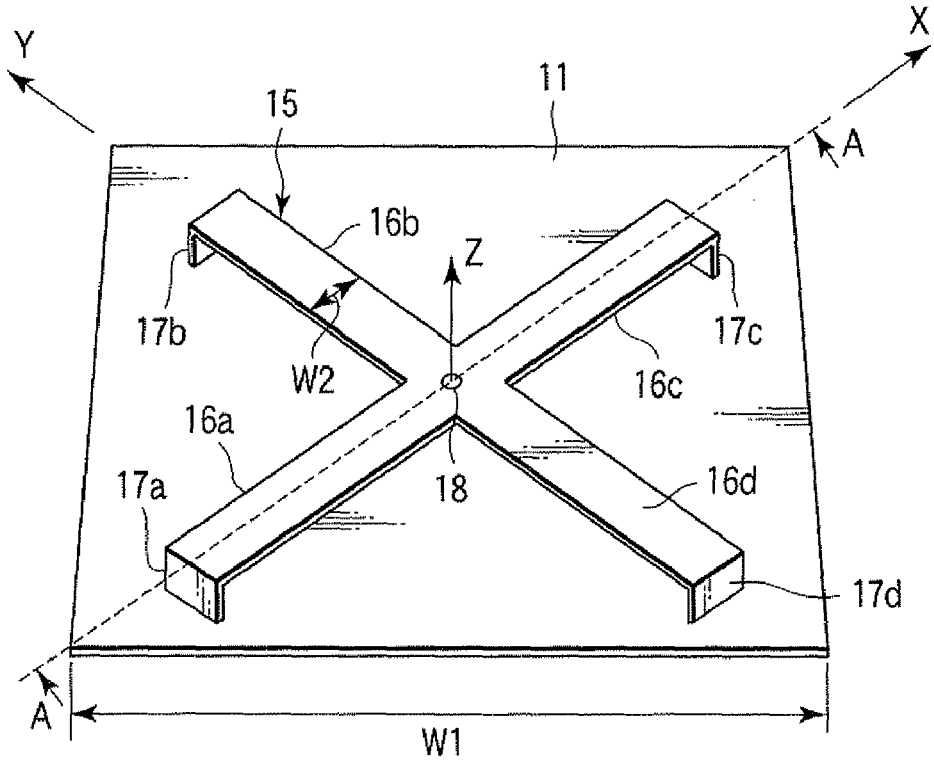
FIG. 1 is a perspective view showing a basic configuration of an antenna apparatus according to a first embodiment of the present invention.
Figure 2:
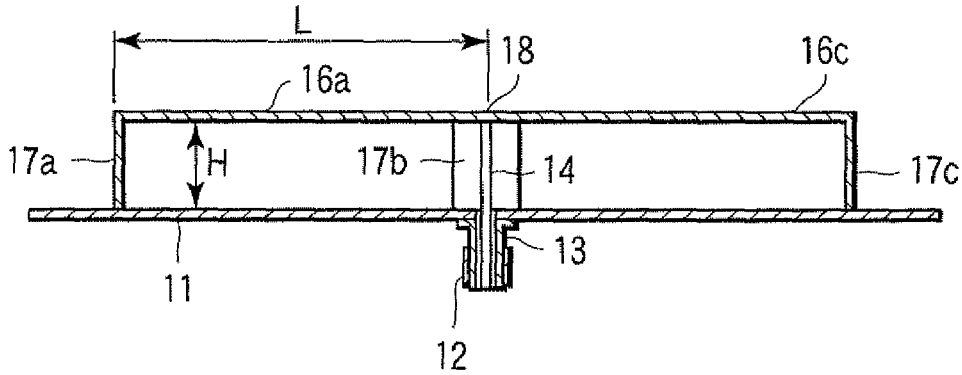
FIG. 2 is a side view of the antenna apparatus according to the first embodiment.

FIG. 1 is a perspective view showing a basic configuration of an antenna apparatus according to the present invention. FIG. 2 is a sectional view of the antenna apparatus taken in a direction of arrows A-A in FIG. 1.

In FIG. 1 and FIG. 2, a conductor plate 11 is formed using, for example, a square grounding plate and a length W1 of one side thereof is set to about $0.5\lambda_L$ or more ($\lambda_L$ represents a wavelength of the lowest frequency in a working frequency band).

A coaxial connector 12 of, for example, NJ type is attached to a central portion of a lower of the conductor plate 11 as a feeding terminal. The coaxial connector 12 is connected with a coaxial cable for feeding extending from an antenna input circuit of a radio unit (not shown). The coaxial connector 12 is provided with an outer conductor 13 and a central conductor 14. The outer conductor 13 is electrically connected to the conductor plate 11. The central conductor 14 is provided to extend through a through-hole provided at a central portion of the conductor plate 11 to project upwardly by a predetermined length in a state that it is insulated from the conductor plate 11 and it is used as a feeding path.

An antenna element 15 is provided on an upper side of the conductor plate 11. The antenna element 15 includes at least two, for example, four radiating elements 16*a* to 16*d*. The radiating elements 16*a* to 16*d* are radially provided at equal angles or at approximately equal angles, and a feeding point 18 is provided at a radial central portion, namely, starting end sides of the radiating elements 16*a* to 16*d*. When the antenna element 15 includes four radiating elements 16*a* to 16*d*, an arrangement angle of respective elements becomes 90° that the elements are formed in a cross shape. The radiating elements 16*a* to 16*d* are each formed using a plate-like element having, for example, a width W2 and a length L, where a width W2 of each radiating element is set to about $0.055\lambda_L$. The length L of each of the radiating elements 16*a* to 16*d* is basically set to about $\lambda_L/4$, but it is preferably set to about $0.275\lambda_L$ which is longer than about $\lambda_L/4$ by about 10%.

For example, plate-like short-circuiting elements 17*a* to 17*d* are provided on respective terminal ends of the radiating elements 16*a* to 16*d* so as to extend perpendicularly to the conductor plate 11. The short-circuiting elements 17*a* to 17*d* are formed by means such as, for example, bending the terminal ends of the radiating elements 16*a* to 16*d* downwardly, where widths of the short-circuiting elements 17*a* to 17*d* have the same width as the width W2 of the radiating elements 16*a* to 16*d* in FIG. 1. However, these widths are not required to be set to the same width necessarily. Distal ends of the short-circuiting elements 17*a* to 17*d* are connected to the conductor plate 11 by welding, screwing, or the like and heights H thereof are set to about $\lambda_L/10$ to $\lambda_L/16$.

The radiating elements 16*a* to 16*d* are provided so as to face the conductor plate 11, more specifically, to be parallel thereto, as described above, and the central conductor 14 of the coaxial connector 12 is connected to the feeding point 18 by screwing, soldering, or the like. In this case, for example, distal end portions of the radiating elements 16*a* to 16*d* positioned on the side of the short-circuiting elements 17*a* to 17*d* are provided so as to correspond to respective corner portions (four corners) of the conductor plate 11 so that the conductor plate 11 is preferably formed to have a small size.

As a specific size example of the antenna element 15, the length W1 of one side of the conductor plate 11 is set to a value falling in a range from 300 mm to 400 mm, the width W2 of the radiating elements 16*a* to 16*d* are set to about 35 mm, and the height H thereof is set to about 40 mm, for example, when the lowest frequency in the working frequency band is 470 MHz of UHF band.

When the antenna apparatus thus configured is installed, for example, on a ceiling in an underground mall, a plurality of antenna apparatuses are installed at intervals of several tens meters such that their antenna elements 15 are positioned on a lower side and their coaxial connectors 12 are positioned on an upper side. In this case, a protective cover (radome) protecting the antenna element 15 is provided in each antenna apparatus, if necessary.

For example, a large-sized outdoor antenna for ground wave (TV or mobile phone) reception is installed on the ground, so that ground wave received at the outdoor antenna is received and amplified at a receiver for relay to be fed to the feeding point 18 of the antenna apparatus through a coaxial cable. In the antenna apparatus, when the feeding point 18 is fed, feeding current flows from the feeding point 18 in directions of the short-circuiting elements 17*a* to 17*d* so that vertically-polarized radio wave is radiated from the respective radiating elements 16*a* to 16*d* downwardly. Incidentally, since the respective radiating elements 16*a* to 16*d* are provided at equal angles (or at approximately equal angles), horizontal plane directionality can be made nondirectional.

Accordingly, even in an underground mall or the like at which ground wave does not directly arrive, radio wave retransmitted from an antenna apparatus installed in the underground mall can be received by a mobile phone, a television, or a mobile device provided with a television receiving function.

Since the height of the antenna element 15 is is about 40 mm and even its height including the protective cover is in a range of about 45 mm to 50 mm, the antenna apparatus shown in the first embodiment is small-sized and of a low profile. Accordingly, the antenna apparatus can be installed even in a narrow installation space such as an underground mall so that aesthetic purposes can be maintained.

Incidentally, in the first embodiment, the case that four radiating elements 16*a* to 16*d* are provided as the antenna element 15 has been shown, but it is possible to set the number of radiating elements to at least two. The shapes of the radiating elements 16*a* to 16*d* are not limited to the plate-shaped elements, but linear elements may be used as the radiating elements. The terminal ends of the radiating elements 16*a* to 16*d* may be short-circuited using pin-shaped short-circuiting elements such as short pins instead of the plate-shaped short-circuiting elements 17*a* to 17*d*.

In the first embodiment, the case that the short-circuiting elements 17*a* to 17*d* are provided near four corners of the conductor plate 11 (namely, the radiating elements 16*a* to 16*d* are arranged on diagonal lines of the conductor plate 11) has been shown, but the short-circuiting elements 17*a* to 17*d* may be provided on other positions, for example, so as to correspond to respective sides of the conductor plate 11.

In the first embodiment, the case that gaps are formed among the respective radiating elements 16*a* to 16*d* has been shown, but a radiating element may be formed of one metal plate by excluding the gaps. In this case, the short-circuiting elements 17*a* to 17*d* are provided at equal intervals on a circle about the feeding point for the radiating elements. Thereby, since feeding current flows in the radiating element from the feeding point 18 in directions of the short-circuiting elements 17*a* to 17*d*, the radiating element serves in the same manner as the case that a plurality of radiating elements 16*a* to 16*d* is provided, so that horizontal plane non-directionality can be achieved.

Second Embodiment

Next, an antenna apparatus according to a second embodiment of the present invention will be explained.

Figure 3A:
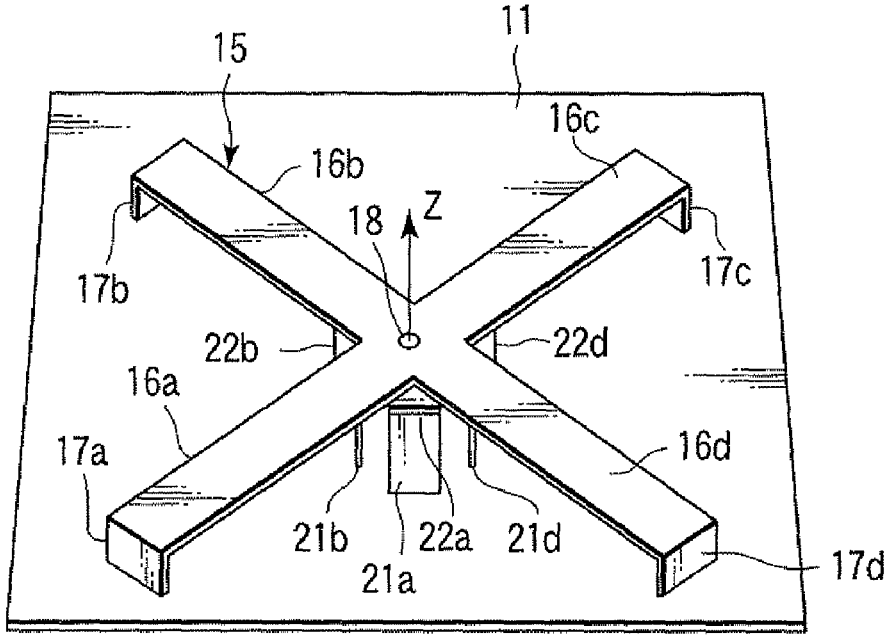
FIG. 3A is a perspective view showing a configuration of an antenna apparatus according to a second embodiment of the present invention.
Figure 3B:
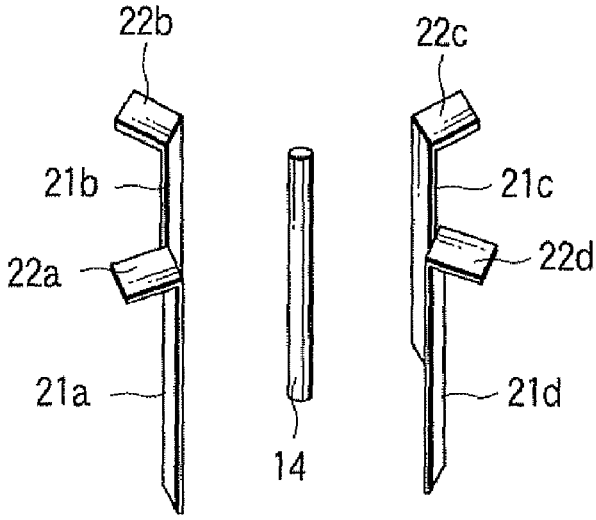
FIG. 3B is a perspective view showing an arrangement configuration of a passive element portion of the antenna apparatus.
Figure 4:
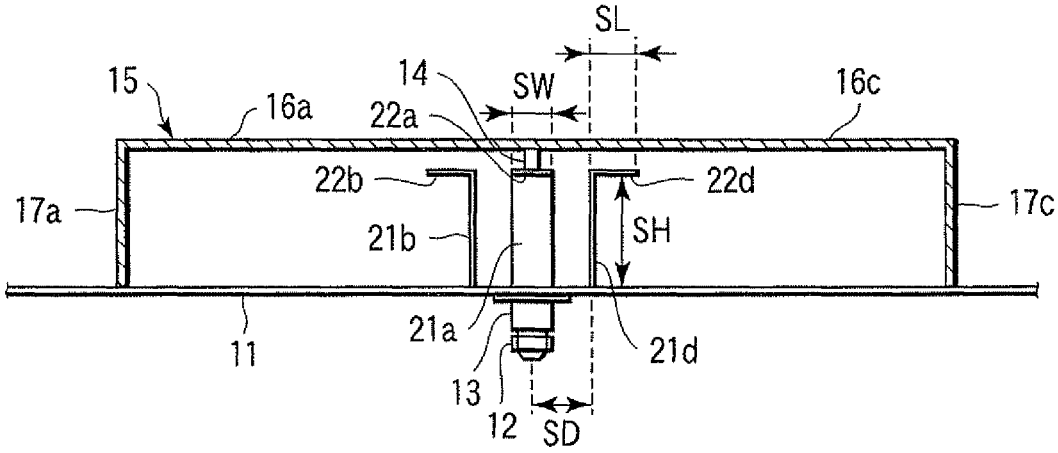
FIG. 4 is a side view of the antenna apparatus according to the second embodiment.

FIG. 3A is a perspective view of an antenna apparatus according to the second embodiment of the present invention, FIG. 3B is a perspective view showing a main portion (a passive element portion), and FIG. 4 is a side view of the antenna apparatus. Incidentally, same portions as those in the first embodiment are attached with same reference numerals and detailed explanation thereof is omitted.

The second embodiment has such a configuration that at least one, for example, four matching passive elements 21*a* to 21*d* are provided at equal intervals (at equal angles) on a concentric circle of a feeding portion, namely, the central conductor 14 of the coaxial connector 12 protruded above the conductor plate 11 in the antenna apparatus according to the first embodiment.

By arranging the passive elements 21*a* to 21*d* near the central conductor 14, electromagnetic coupling is obtained between vertical portions of the passive elements 21*a* to 21*d* and the central conductor 14. The passive elements 21*a* to 21*d* are provided with horizontal portions 22*a* to 22*d*. The horizontal portions 22*a* to 22*d* are formed on respective line paths connecting short-circuiting portions of the respective radiating elements 16*a* to 16*d* and the feeding point 18 or near them such that the horizontal portions 22*a* to 22*d* are capacitance-coupled to the line paths. As shown in FIG. 3B, for example, the horizontal portions 22*a* to 22*d* are formed in inverted L shapes by using metal plates and bending their upper portions in an outward direction, namely, in directions opposite to the central conductor 14 by about 90°.

The passive elements 21*a* to 21*d* are set, for example, such that a distance SD from the center is about $0.026\lambda_L$, a width SW is $0.019\lambda_L$, a height SH is about $0.055\lambda_L$, and a length SL of the horizontal portions 22*a* to 22*d* is about $0.023\lambda_L$. The abovementioned passive elements 21*a* to 21*d* can be provided at any rotated positions on a concentric circle, and they may be provided at arbitrary positions thereon. Characteristics of the passive elements 21*a* to 21*d* can be finely adjusted according to their installation positions.

As a specific size example of the passive elements 21*a* to 21*d*, setting is performed such that the distance SD from the center is about 17 mm, the width SW is 12 mm, the height SH is about 36 mm, and the length SL of the horizontal portion is about 15 mm, for example, when the lowest frequency in the working frequency band is 470 MHz.

In the antenna apparatus according to the second embodiment, the passive elements 21*a* to 21*d* serve as stubs. That is, capacitance coupling between the horizontal portions 22*a* to 22*d* and current line paths flowing in the radiating elements can be achieved by providing the passive elements 21*a* to 21*d*. Electromagnetic coupling between the vertical portions of the passive elements 21*a* to 21*d* and the central conductor 14 can be achieved by arranging the passive elements 21*a* to 21*d* near the central conductor 14. Thereby, the number of setting parameters determining impedance characteristics is increased so that a stable state over a wide band can be held.

Figure 5:
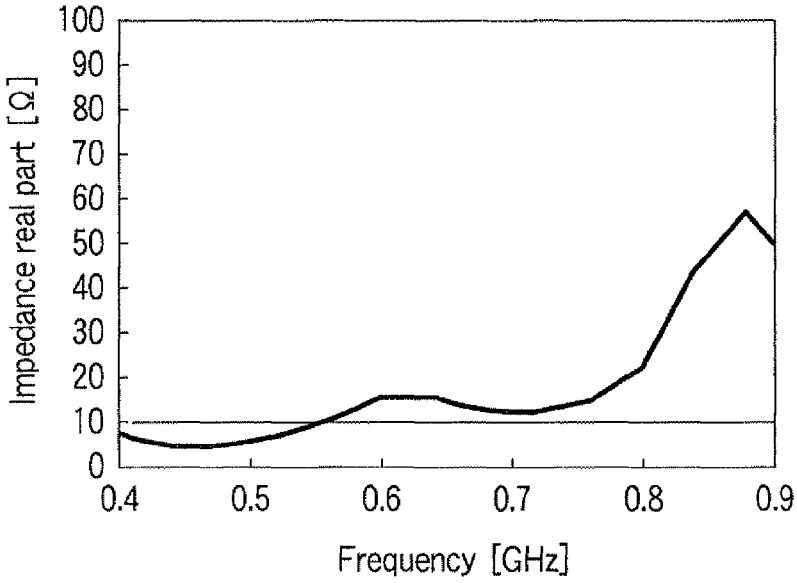
FIG. 5 is a real part impedance characteristic diagram of the antenna apparatus according to the second embodiment.

FIG. 5 shows a real part impedance characteristic at the feeding point 18 of the antenna apparatus according to the second embodiment, where a horizontal axis takes frequency [GHz] and a vertical axis takes impedance real part [Ω]. As the real part impedance characteristic, approximately constant impedance (resistance value) can be obtained in a range from 400 to 800 MHz, as apparent from FIG. 5.

Figure 6:
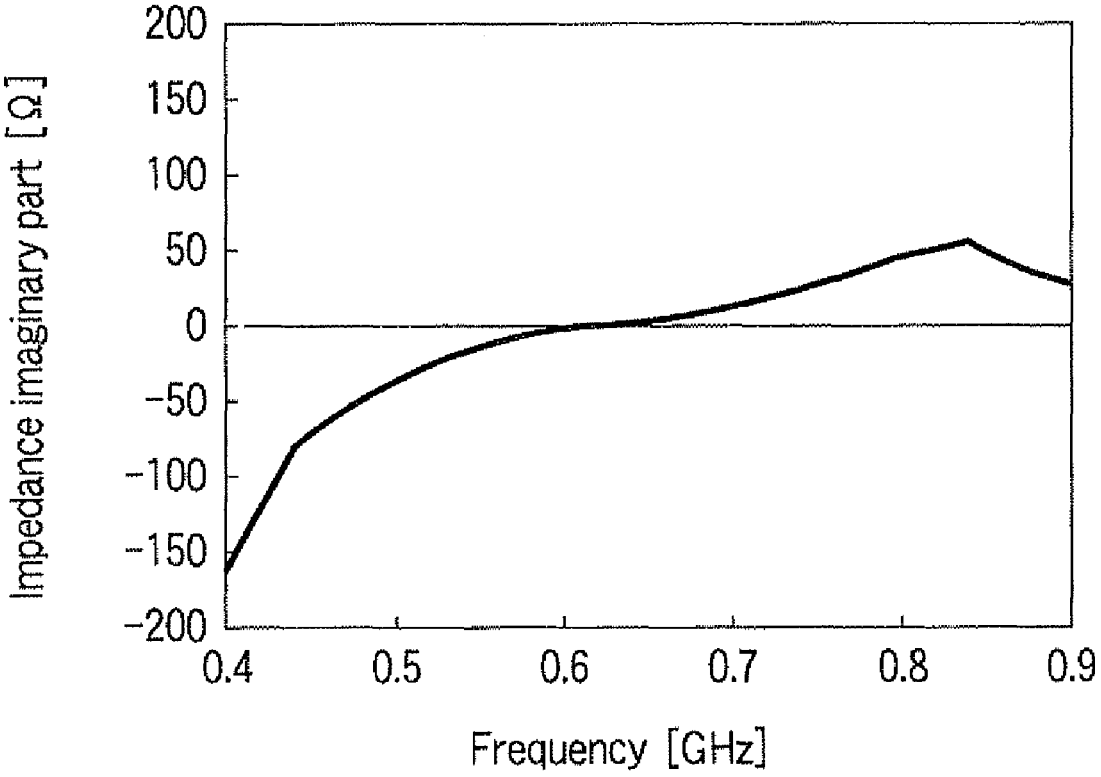
FIG. 6 is an imaginary part impedance characteristic diagram of the antenna apparatus according to the second embodiment.

FIG. 6 shows an imaginary part impedance characteristic at the feeding point 18 of the antenna apparatus, where a horizontal axis takes frequency [GHz] and a vertical axis takes reactance [Ω]. As the imaginary part impedance characteristic, a reactance value of (0±50Ω) can be obtained over a wide band from 500 to 800 MHz, as apparent from FIG. 6.

In the antenna apparatus according to the second embodiment, regarding the real part impedance characteristic, approximately constant impedance can be obtained in a range from 400 to 800 MHz, but a value of the impedance is about 10Ω and it is slightly lower than 50Ω generally used (characteristic impedance of the coaxial cable for feeding). Accordingly, by utilizing a combination with an impedance converter to convert the impedance to about 50Ω, the antenna apparatus can be used as an antenna having wide band characteristic in a range of 400 to 800 MHz.

Figure 7:
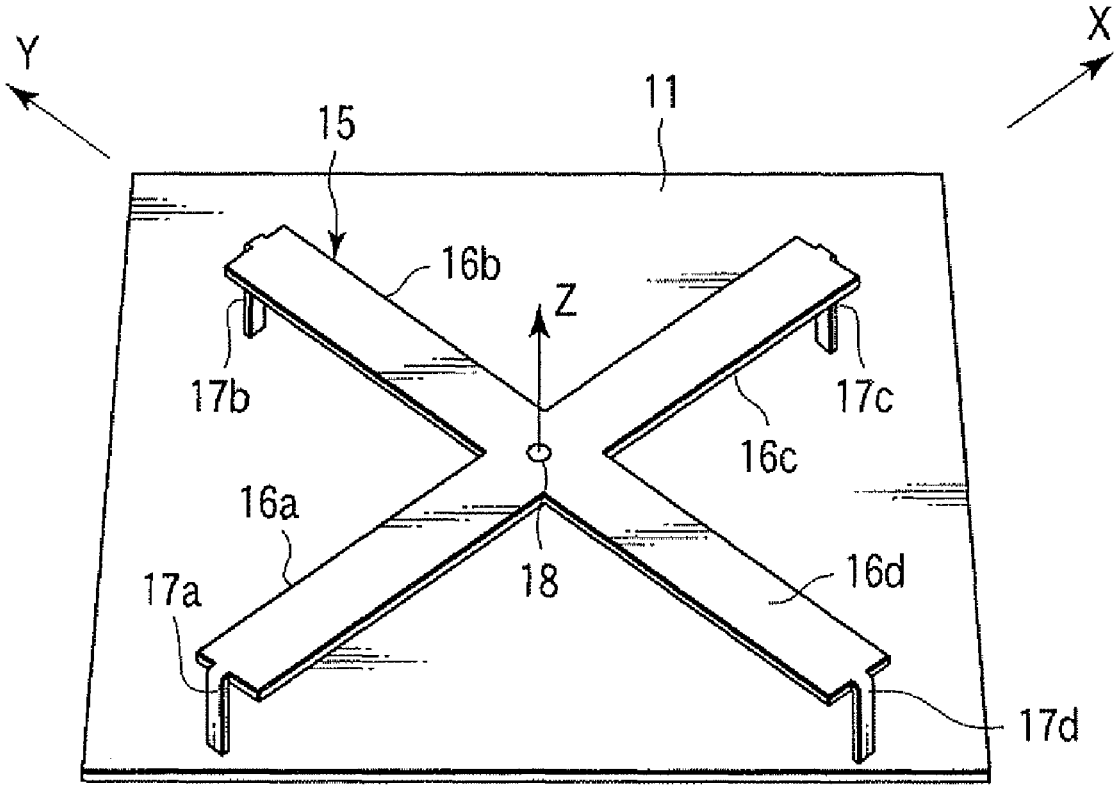
FIG. 7 is a perspective view of an antenna apparatus where a passive element is not provided.
Figure 8:
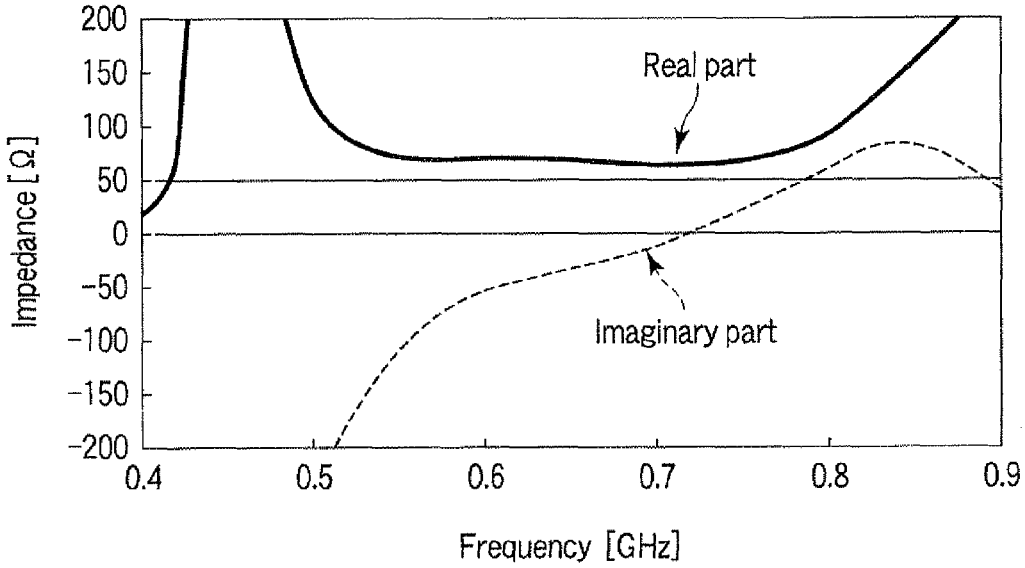
FIG. 8 is an impedance characteristic diagram of the antenna apparatus shown in FIG. 7.
Figure 9:
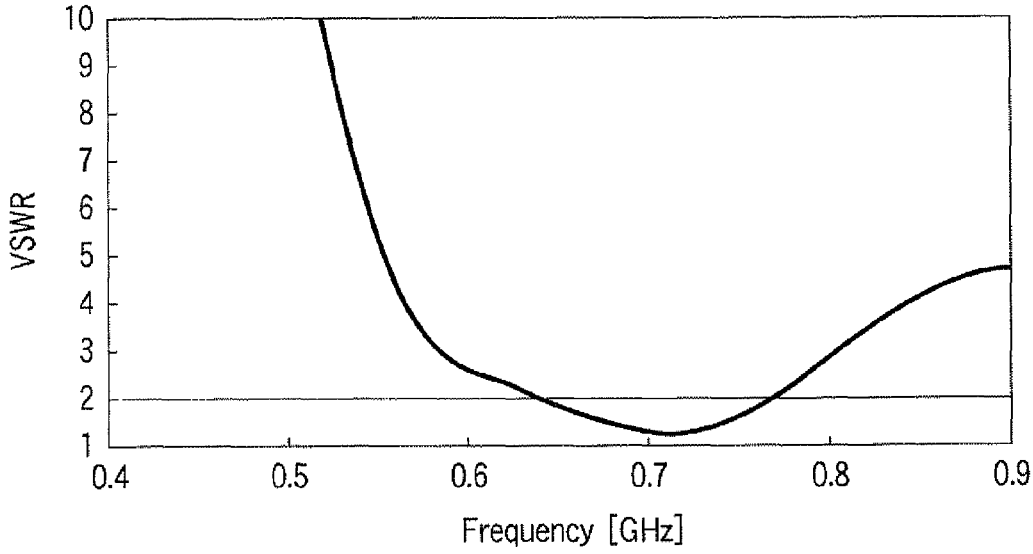
FIG. 9 is a VSWR characteristic diagram of the antenna apparatus shown in FIG. 7.
Figure 10:
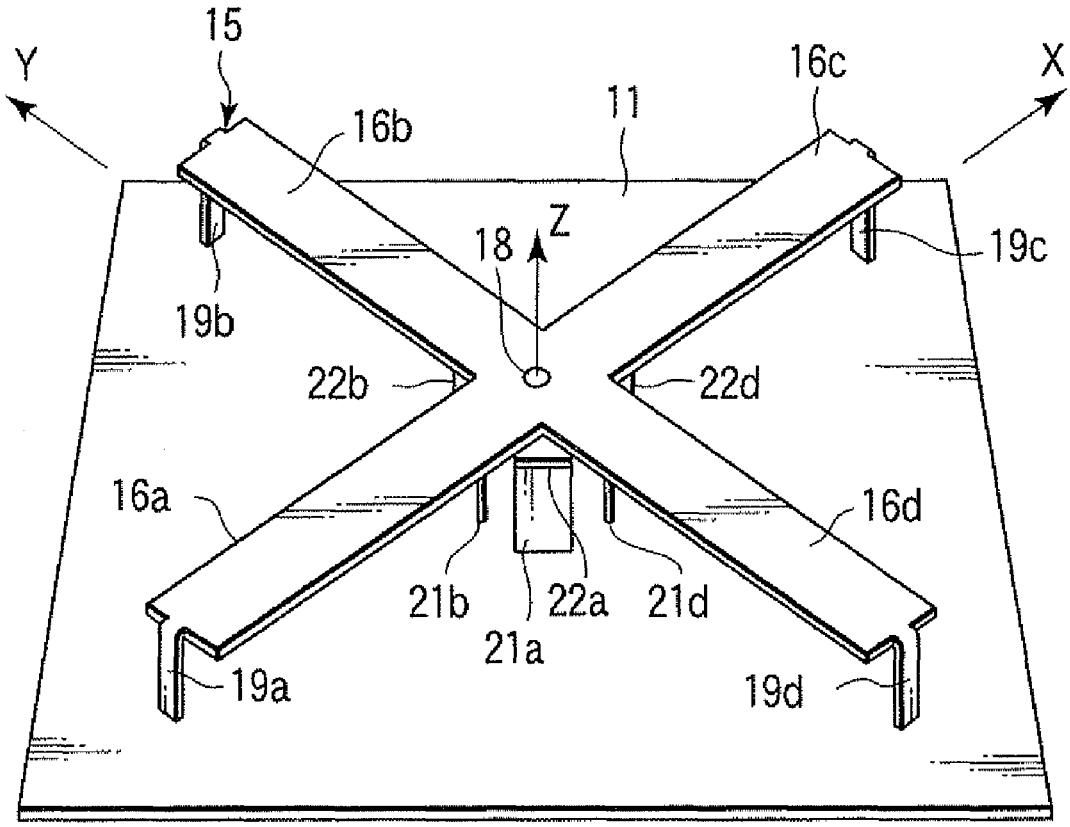
FIG. 10 is a perspective view of an antenna apparatus where a passive element is provided.
Figure 11:
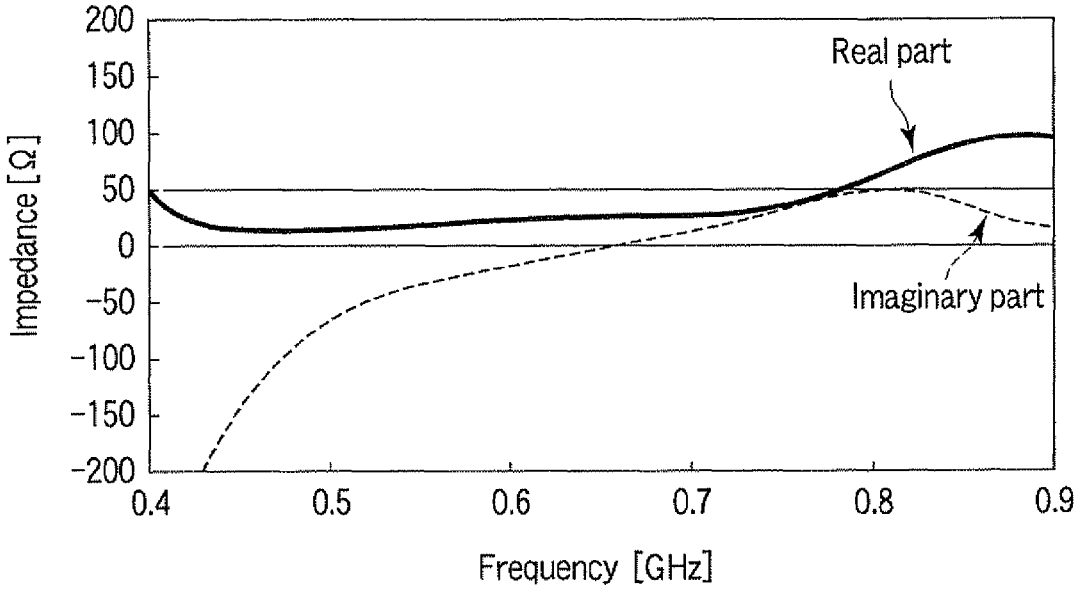
FIG. 11 is an impedance characteristic diagram of the antenna apparatus shown in FIG. 10.
Figure 12:
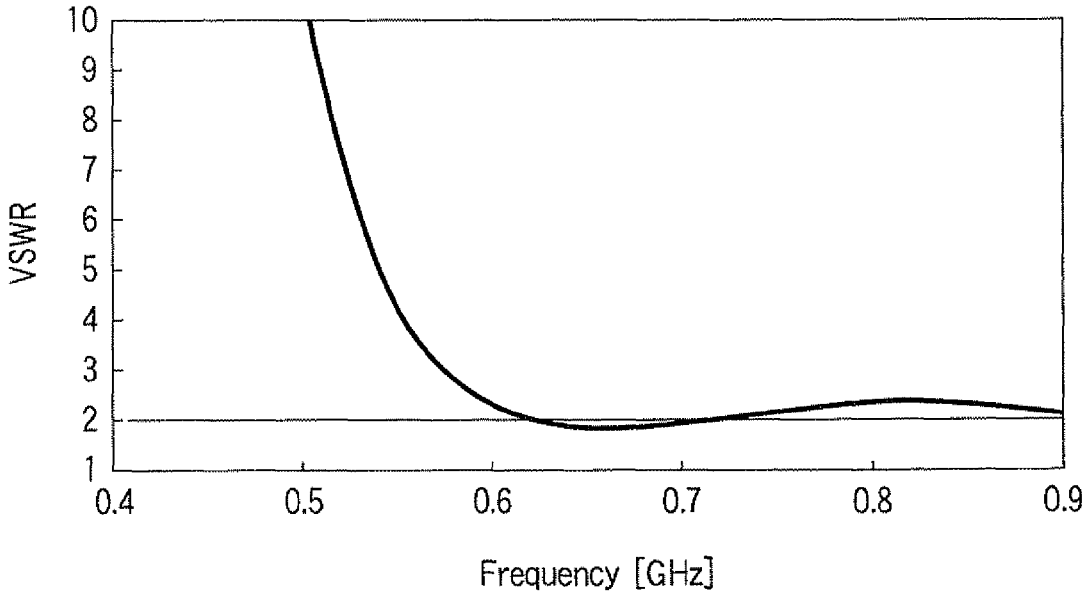
FIG. 12 is a VSWR characteristic diagram of the antenna apparatus shown in FIG. 10.

Here, a simulation result for confirming an effect of the antenna apparatus according to the second embodiment is shown. FIG. 7 is a perspective view of an antenna apparatus where a passive element is not provided. FIG. 8 is an impedance characteristic diagram of the antenna apparatus shown in FIG. 7 and FIG. 9 is a VSWR characteristic diagram of the antenna apparatus shown in FIG. 7. FIG. 10 is a perspective view of an antenna apparatus where passive elements are provided in the antenna apparatus shown in FIG. 7. FIG. 11 is an impedance characteristic diagram of the antenna apparatus shown in FIG. 10 and FIG. 12 is a VSWR characteristic diagram of the antenna apparatus shown in FIG. 10.

Incidentally, in FIG. 7 and FIG. 10, a height of the radiating elements 16*a* to 16*d* is 45 mm. A width of the short-circuiting elements 17*a* to 17*d* is set to be narrower than the width W2 of the radiating elements 16*a* to 16*d*, but even if the width is set to be equal to the width W2, similar function is obtained so that the width may be set to narrower than or equal to the width W2. In FIG. 10, when the frequency $\lambda_L$ has a free space wavelength of 470 MHz, the passive elements 21*a* to 21*d* are set such that the distance from the central conductor 14 is 19 mm ($\approx 0.03\lambda_L$) and the height is 35 mm ($=0.55\lambda_L$).

From comparison between impedance characteristics in FIG. 8 and FIG. 11, it is understood that the real part shows an approximately constant value near 50Ω over a band wider than that shown in FIG. 8 and the imaginary part shows a value of (0±50Ω) in FIG. 11. From comparison between VSWR characteristics in FIG. 9 and FIG. 12, it is read that the VSWR in FIG. 12 lowers especially in a high frequency region. Therefore, it can be said that a wider band can be achieved by providing the passive elements.

Incidentally, in the second embodiment, the case that the horizontal portions 22*a* to 22*d* of the passive elements 21*a* to 21*d* are formed in a rectangular shape has been shown, but they may be formed in another shape such as a triangular shape or a fan shape. The passive elements 21*a* to 21*d* may be formed in a T shape, for example.

Third Embodiment

Next, an antenna apparatus according to a third embodiment of the present invention will be explained.

Figure 13:
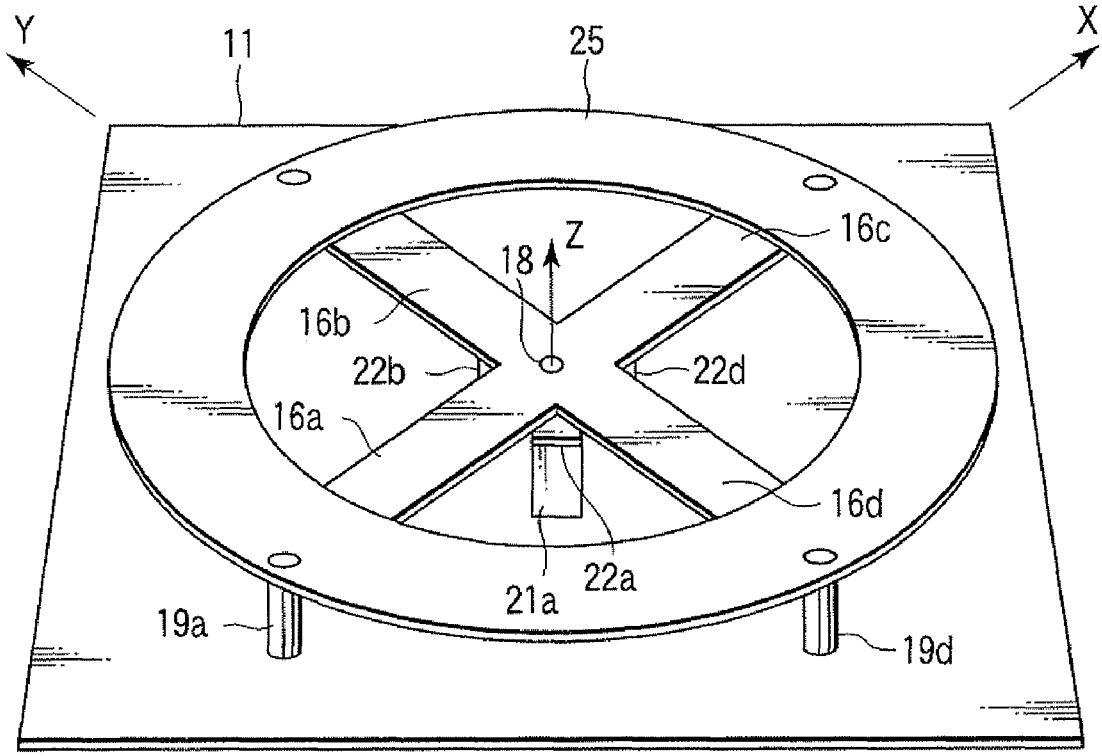
FIG. 13 is a perspective view showing a configuration of an antenna apparatus according to a third embodiment of the present invention.

FIG. 13 is a perspective view of an antenna apparatus according to the third embodiment of the present invention.

The third embodiment has such a configuration that the antenna apparatus according to the second embodiment is further provided with line paths connecting end portions of adjacent ones of the radiating elements 16*a* to 16*d*. As seen in FIG. 13, the radiating elements 16*a* to 16*d* extend radially from the feeding portion at equal circumferentially spaced intervals. The third embodiment is configured such that excellent impedance characteristic is obtained over wider band, for example, by providing a ring-shaped element 25 on upper portions of the radiating elements 16*a* to 16*d* in parallel with the conductor plate 11.

Incidentally, in the third embodiment, short pins 19*a* to 19*d* are used instead of the short-circuiting elements 17*a* to 17*d* shown in the second embodiment. Diameters of the short pins 19*a* to 19*d* are set to about ½ of the width W2 of the radiating elements 16*a* to 16*d*. The short pins 19*a* to 19*d* are provided between the radiating elements 16*a* to 16*d* and the conductor plate 11 by screwing, welding, or the like. Since the short-circuiting elements 17*a* to 17*d* and the short pins 19*a* to 19*d* function similarly, one of the both can be used.

The ring-shaped element 25 is disposed on the upper side of the radiating elements 16*a* to 16*d* and it is fixed on upper end portions of the short pins 19*a* to 19*d* by screwing, welding, or the like. Since the other configuration is similar to that of the second embodiment, same portions are attached with same reference numerals and detailed explanation thereof is omitted.

The ring-shaped element 25 is obtained by using a metal plate to form the same in a ring shape, and, for example, a size thereof is set such that an inner diameter thereof is about $0.303\lambda_L$ and an outer diameter thereof is about $0.359\lambda_L$. A width of the ring-shaped element 25 is set to the same value or approximately the same value as that of the width W2 of the radiating elements 16*a* to 16*d*.

Figure 14:
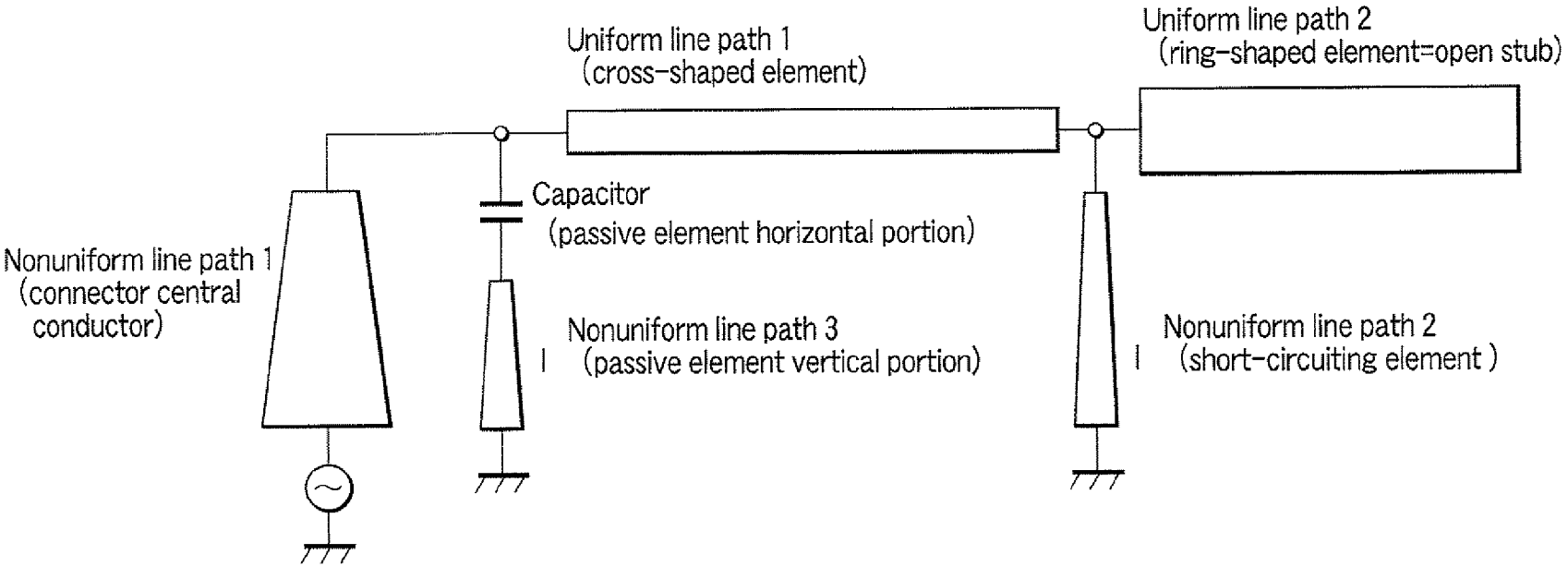
FIG. 14 is a diagram showing an equivalent circuit of the antenna apparatus shown in FIG. 13.

FIG. 14 is a diagram showing an equivalent circuit of the antenna apparatus according to the third embodiment. In FIG. 14, modeling can be performed such that the central conductor 14 is a nonuniform line path 1, the radiating elements 16*a* to 16*d* are uniform line paths 1, the passive elements 21*a* to 21*d* are nonuniform line paths 3, the short-circuiting elements 17*a* to 17*d* are nonuniform line paths 2, the ring-shaped element 25 is an uniform line path 2. The passive elements 21*a* to 21*d* function as a series resonance circuit of L and C and the ring-shaped element 25 functions as an open stub. Voltage amplitude becomes the maximum at a distal end of the open stub, and the voltage amplitude becomes zero at a root thereof. The impedance characteristic can be adjusted easily by adjusting a length of the open stub.

Figure 15:
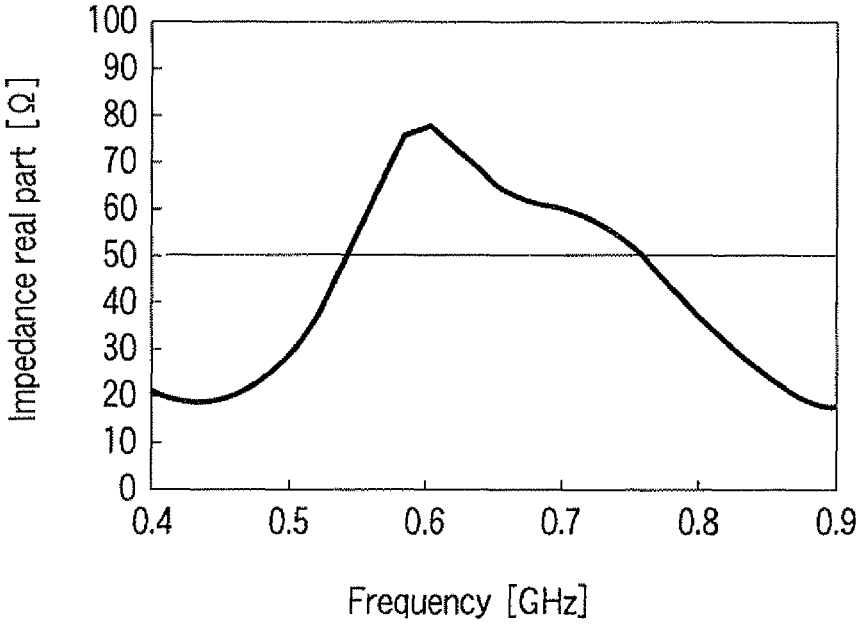
FIG. 15 is a real part impedance characteristic diagram of the antenna apparatus according to the third embodiment.

FIG. 15 is a diagram showing a real part impedance characteristic at the feeding point 18 of the antenna apparatus according to the third embodiment, where a horizontal axis takes frequency [GHz] and a vertical axis takes impedance real part [Ω]. The real part impedance characteristic is held in a range of 50±(20 to 30)Ω over a wide band from 400 to 800 MHz by providing the ring-shaped element 25.

Figure 16:
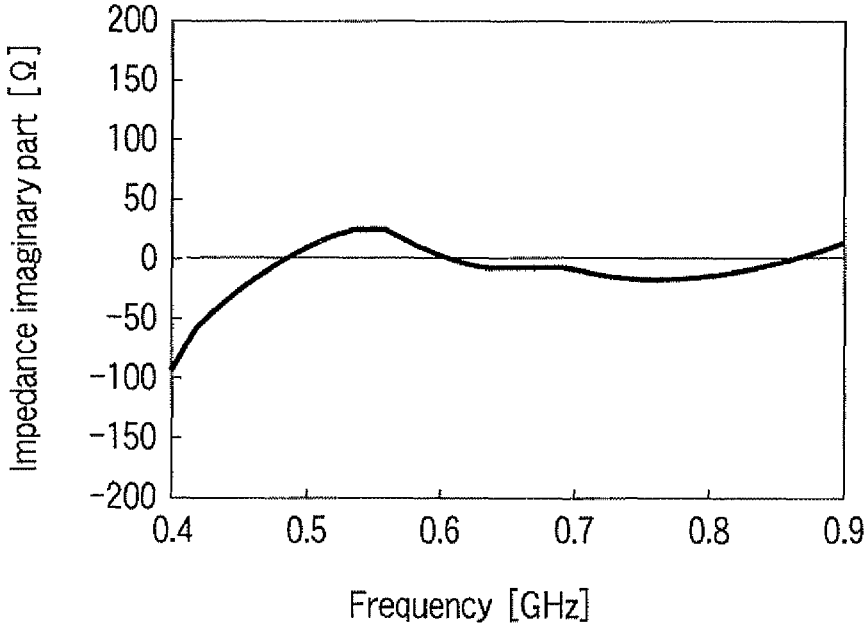
FIG. 16 an imaginary part impedance characteristic diagram of the antenna apparatus according to the third embodiment.

FIG. 16 is a diagram showing an imaginary part impedance characteristic at the feeding point 18 of the antenna apparatus, where a horizontal axis takes frequency [GHz] and a vertical axis takes reactance [Ω]. Regarding the imaginary part impedance characteristic, a reactance value of 0±20Ω is obtained over a wide band from 450 to 900 MHz.

Figure 17:
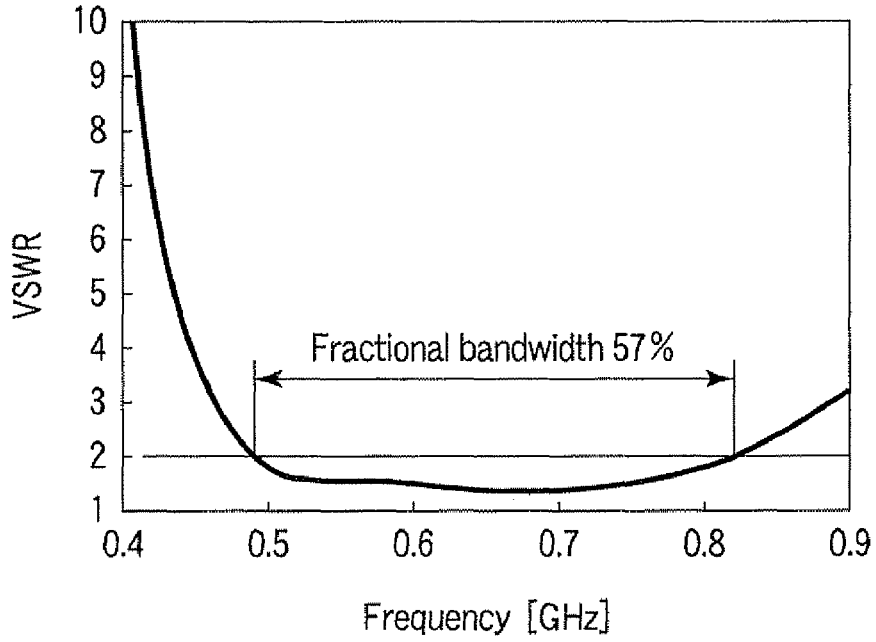
FIG. 17 is a VSWR characteristic diagram of the antenna apparatus according to the third embodiment.

FIG. 17 is a diagram showing a VSWR characteristic when the length W1 of one side of the conductor plate 11 is set to 400 mm, where a horizontal axis takes frequency [GHz] and a vertical axis takes VSWR. Regarding the VSWR characteristic, VSWR≦2 is obtained over a wide band from 480 to 820 MHz and a fractional bandwidth is about 57%.

Figure 18:
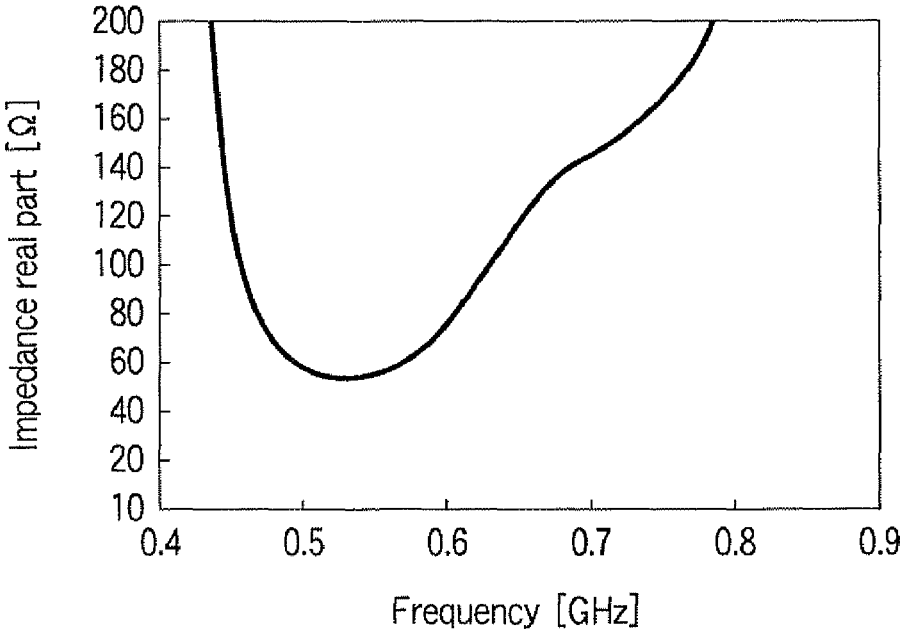
FIG. 18 is a real part impedance characteristic diagram when a passive element is not provided in the antenna apparatus according to the third embodiment.
Figure 19:
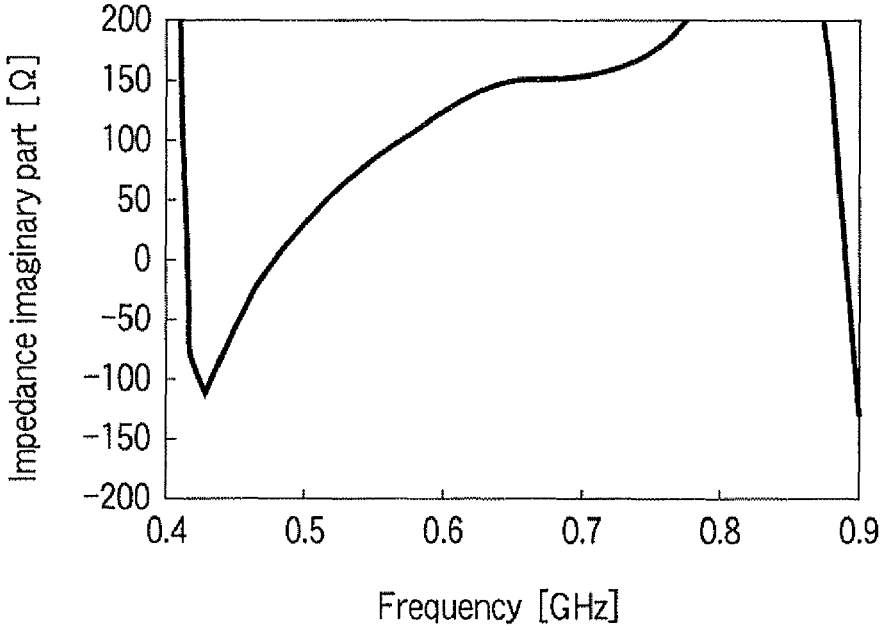
FIG. 19 is an imaginary part impedance characteristic diagram when a passive element is not provided in the antenna apparatus according to the third embodiment.
Figure 20:
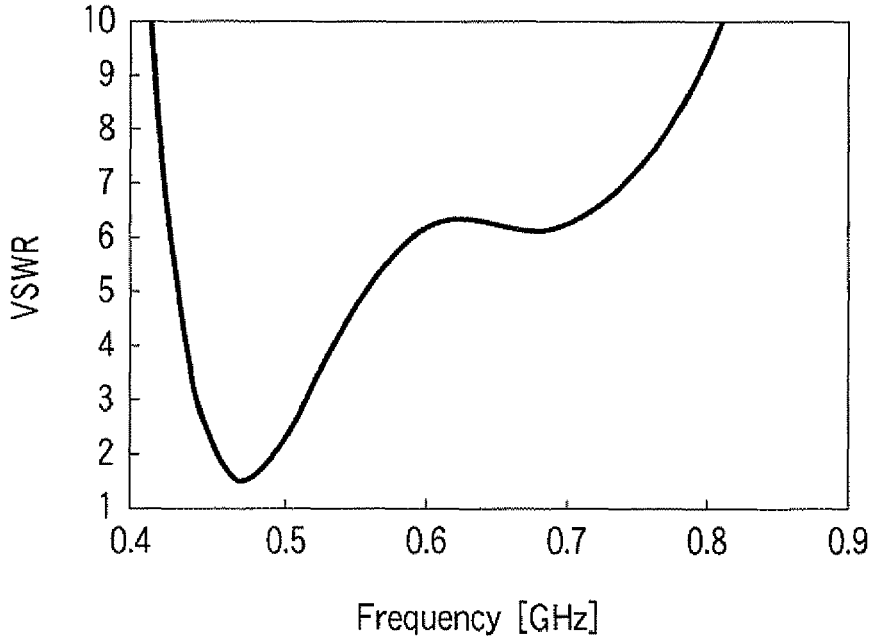
FIG. 20 is a VSWR characteristic diagram when a passive element is not provided in the antenna apparatus according to the third embodiment.

Here, an effect of the passive elements 21*a* to 21*d* in the antenna apparatus according to the third embodiment is confirmed. FIG. 18 is a real part impedance characteristic diagram of a model where the passive elements 21*a* to 21*d* are removed from the configuration shown in FIG. 13. FIG. 19 is an imaginary part impedance characteristic diagram of the model and FIG. 20 is a VSWR characteristic diagram of the model.

From comparison between the real part impedances characteristic shown in FIG. 15 and FIG. 18, it is understood that a frequency region holding about 50Ω extends over a wide band in FIG. 15. From comparison between the imaginary part impedances characteristic shown in FIG. 16 and FIG. 19, it is understood that a reactance value near 0Ω is obtained over a wide band in FIG. 16. From comparison between VSWR characteristics shown in FIG. 17 and FIG. 20, it is read that a region satisfying VSWR≦2 is expanded to wider bandwidth in FIG. 17. With the configuration of the antenna apparatus according to the third embodiment, it is confirmed that a wider bandwidth can be achieved by providing the passive elements 21*a* to 21*d*.

In the antenna apparatus according to the third embodiment, since impedance of about 50Ω is maintained over a wide frequency band, the antenna apparatus can be used as a wide bandwidth antenna without using an impedance converter.

Incidentally, in the third embodiment, the case that the ring-shaped element 25 is formed in a annular shape, the ring-shaped element 25 can be formed in any shape such as a rectangular shape or a polygonal shape.

Figure 21:
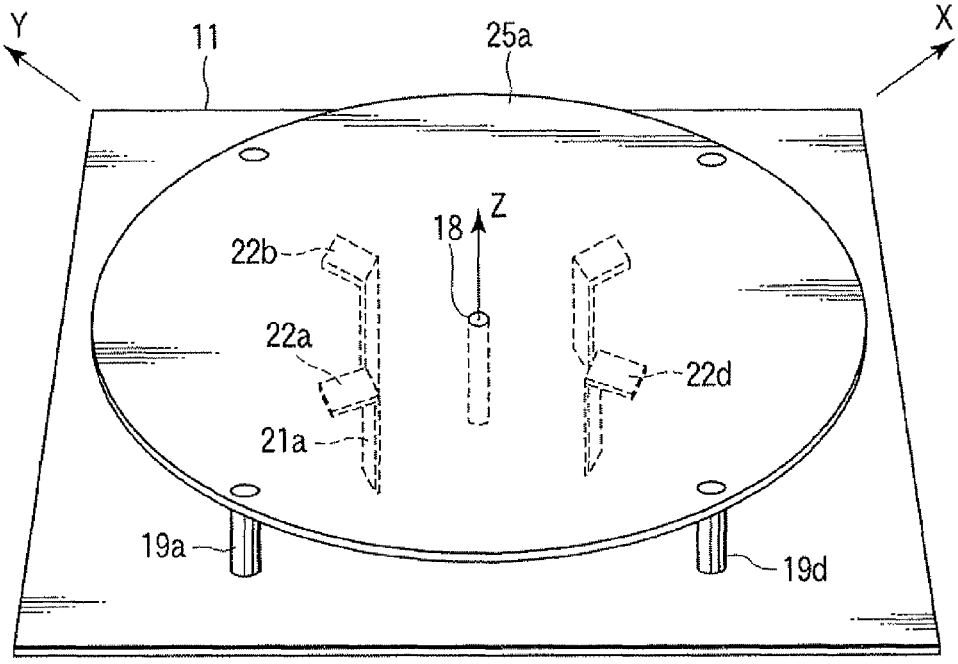
FIG. 21 is a perspective view of an antenna apparatus having a disk-like antenna element.
Figure 22:
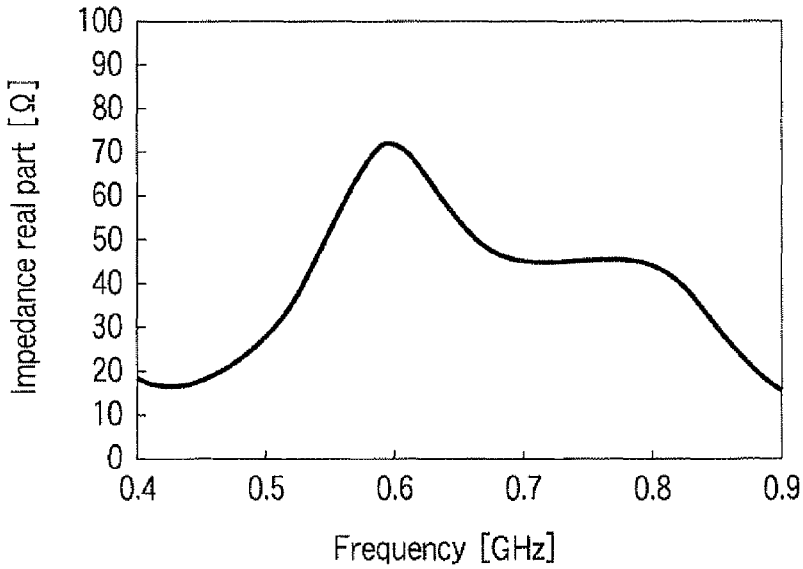
FIG. 22 is a real part impedance characteristic diagram of the antenna apparatus shown in FIG. 21.

Further, in the third embodiment, the case that a gap is formed between each of the radiating elements 16*a* to 16*d* and the ring-shaped element 25 has been shown, but such a configuration can be adopted that the gap is excluded and a disk-like radiating element is formed of a sheet of metal plate. FIG. 21 is a perspective view of an antenna apparatus having a disk-shaped antenna element. FIG. 22 is a real part impedance characteristic diagram of the antenna apparatus shown in FIG. 21, FIG. 23 is an imaginary part impedance characteristic diagram of the antenna apparatus and FIG. 24 is a VSWR characteristic diagram of the antenna apparatus.

In FIG. 21, by providing short pins 19*a* to 19*d* on a circle of a disk-like element 25*a* at equal intervals, feeding current flows in the disk-like element 25*a* from the feeding point 18 in directions of the short pins 19*a* to 19*d*, and it further partially flows along an outer periphery of the disk-like element 25*a*.

Figure 23:
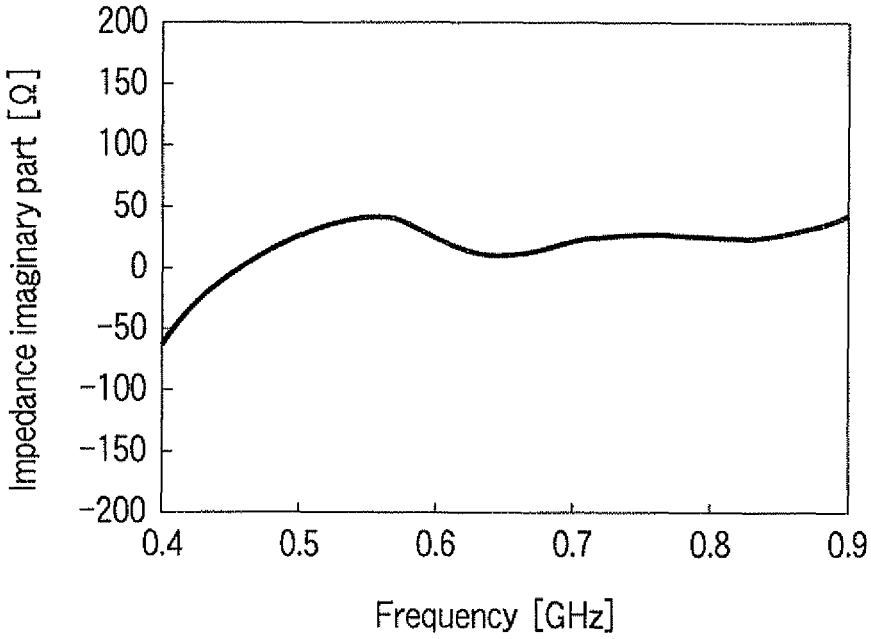
FIG. 23 is an imaginary part impedance characteristic diagram of the antenna apparatus shown in FIG. 21.
Figure 24:
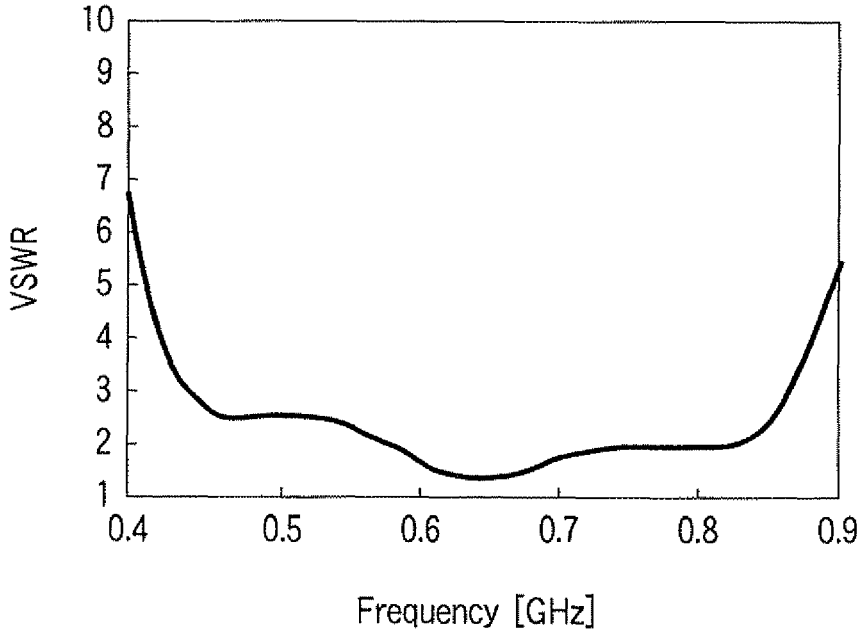
FIG. 24 is a VSWR characteristic diagram of the antenna apparatus shown in FIG. 21.

As shown in FIG. 22 and FIG. 23, excellent impedance characteristics can be obtained just like the case of the configuration shown in FIG. 13. As apparent from FIG. 24, even when such a configuration is adopted, VSWR can be suppressed to 2 or less over a wide bandwidth from 570 MHz to 840 MHz. Incidentally, the shape of disk-like element 25*a* is not limited to the disk shape but it may be rectangular, polygonal, or the like.

Fourth Embodiment

Next, an antenna apparatus according to a fourth embodiment of the present invention will be explained.

Figure 25:
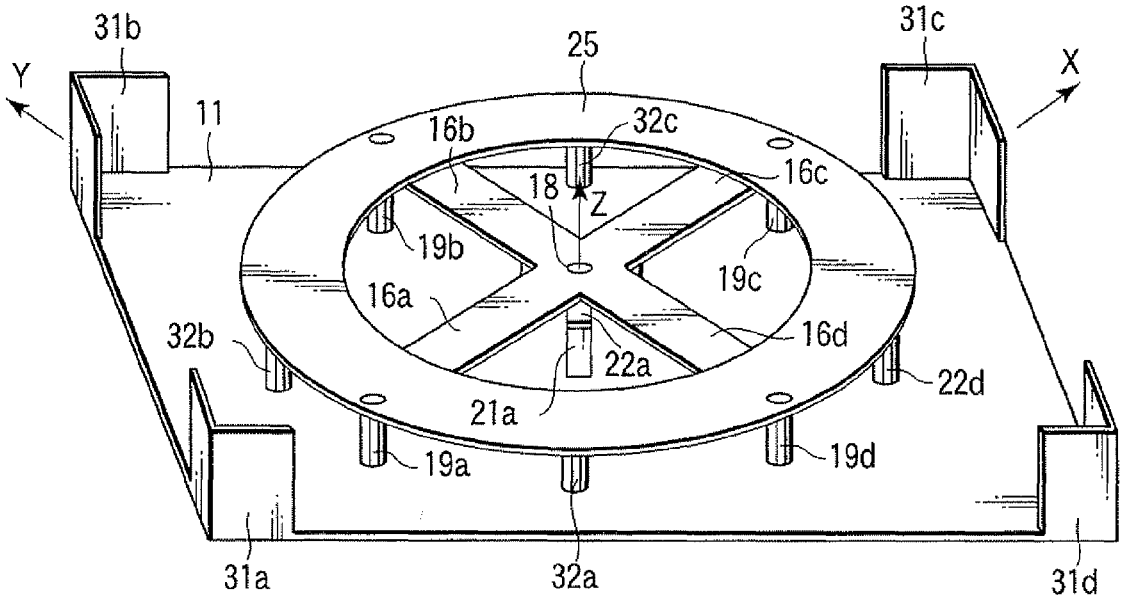
FIG. 25 is a perspective view showing a configuration of an antenna apparatus according to a fourth embodiment of the present invention.

FIG. 25 is a perspective view of an antenna apparatus according to the fourth embodiment of the present invention.

The fourth embodiment has such a configuration that matching plates 31*a* to 31*d* are further provided on the conductor plate 11 near the short pins 19*a* to 19*d* of the radiating elements 16*a* to 16*d* in the antenna apparatus according to the third embodiment. As shown in FIG. 25, for example, the matching plates 31*a* to 31*d* are formed by forming four corners of the conductor plate 11 (namely, portions positioned on extension lines of the radiating elements 16*a* to 16*d*) to have portions wider than the other portion of the conductor plate 11 to bend the wider portions upwardly by 90°. A length of one side of the matching plates 31*a* to 31*d* is set to about 15±5% of the length of the conductor plate 11.

Spacers 32*a* to 32*d* made from insulating material such as synthetic resin are provided between the ring-like element 25 and the conductor plate 11, for example, at approximately central positions between adjacent ones of the respective short pins 19*a* to 19*d*, so that the ring-like element 25 is held to be parallel with the conductor plate 11. The spacers 32*a* to 32*d* can be formed in an arbitrary shape such as, for example, a cylindrical shape or a prismatic shape.

Portions of the conductor plate 11 positioned near the short pins 19*a* to 19*d* are portions in which current flows from the radiating portions 16*a* to 16*d* via the short pins 19*a* to 19*d*. That is, by providing the matching portions 31*a* to 31*d* on straight extension lines connecting the feeding point 18 and the short-circuiting portions of the radiating elements 16*a* to 16*d*, respectively, line paths of current flowing in the conductor plate 11 can be extended. Thereby, a plane area of the conductor plate 11 can be reduced. Accordingly, by providing the matching portions 31*a* to 31*d* at these portions, the conductor plate 11 can be caused to serve efficiently, and even if the conductor plate 11 is formed in a small size, excellent VSWR characteristic can be held. Further, by adjusting distances between the short-circuiting portions of the radiating elements 16*a* to 16*d* and the matching plates 31*a* to 31*d*, electromagnetic coupling can be achieved, so that the number of setting parameters can be increased and further wider bandwidth can be achieved.

Incidentally, it is thought that a matching plate is formed on the whole circumferential portion of the conductor plate 11 instead of providing the matching plates 31*a* to 31*d* on the four corners of the conductor plate 11, but since such a case that, when the matching plate is formed over the whole circumferential portion of the conductor plate 11 in a state that the conductor plate 11 is formed in a small size, desired characteristics cannot be obtained occurs, an excellent result can be obtained by providing the matching plates 31*a* to 31*d* at nearest portions of the short pins 19*a* to 19*d*.

Figure 26:
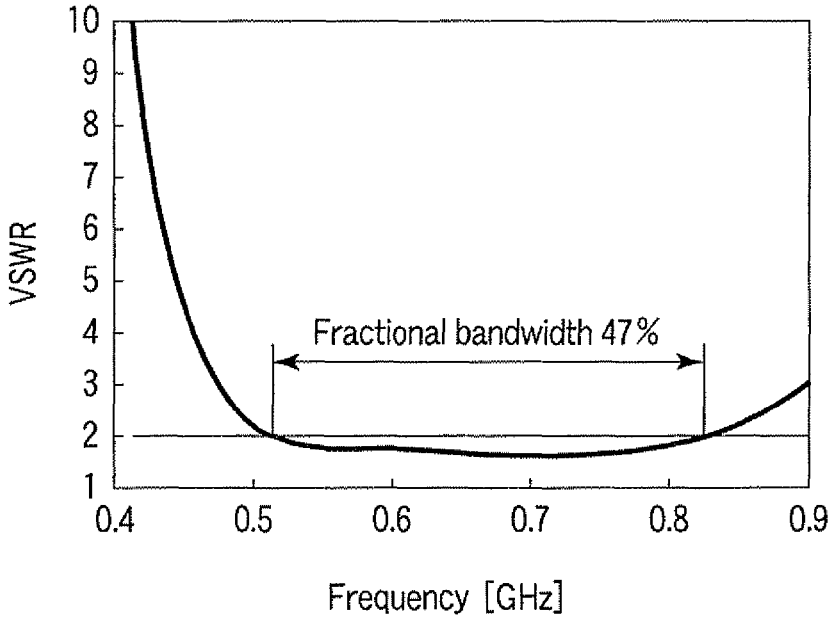
FIG. 26 is a VSWR characteristic diagram when a matching plate is not provided in the antenna apparatus according to the fourth embodiment.

FIG. 26 is a VSWR characteristic diagram when the length W1 of one side of the conductor plate 11 is set 350 mm (350×350 mm) and the matching plates 31*a* to 31*d* are not provided, where a horizontal axis takes frequency [GHz] and a vertical axis takes VSWR. At this time, regarding the VSWR characteristic, VSWR≦2 is obtained in a bandwidth from 520 to 830 MHz and the fractional bandwidth is about 47%.

Figure 27:
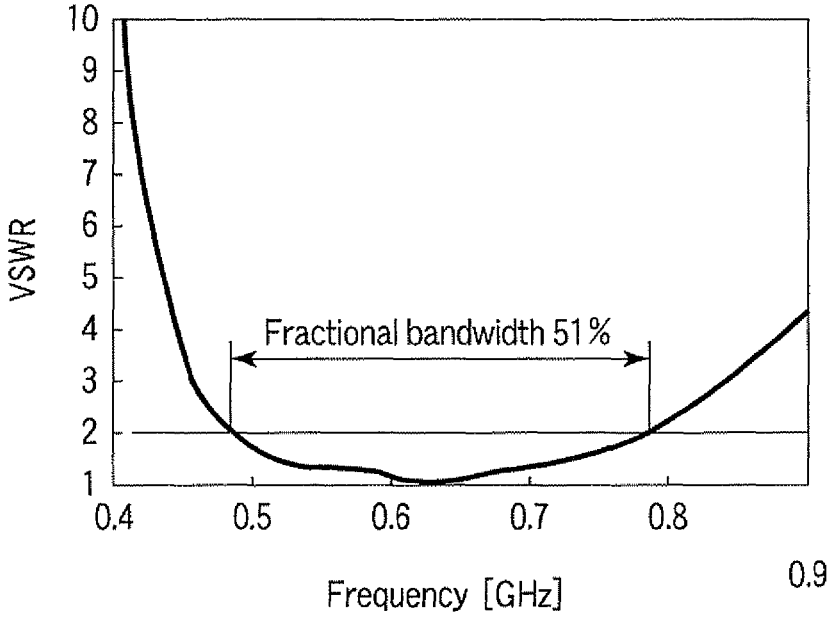
FIG. 27 is a VSWR characteristic diagram of the antenna apparatus according to the fourth embodiment.

FIG. 27 is a VSWR characteristic diagram when a size of the conductor plate 11 is set to 350×350 mm and the matching plates 31*a* to 31*d* are provided at four corners of the conductor plate 11 in the antenna apparatus shown in FIG. 25. Regarding the VSWR characteristic at this time, VSWR≦2 is obtained in a bandwidth from 470 to 790 MHz and the fractional bandwidth of about 51% is obtained.

By providing the matching plates 31*a* to 31*d*, the fractional bandwidth of VSWR≦2 is improved and the operating lowest frequency lowers from 520 MHz to 470 MHz so that the VSWR value comes close to 1 as a whole and matching is obtained.

Figure 28:
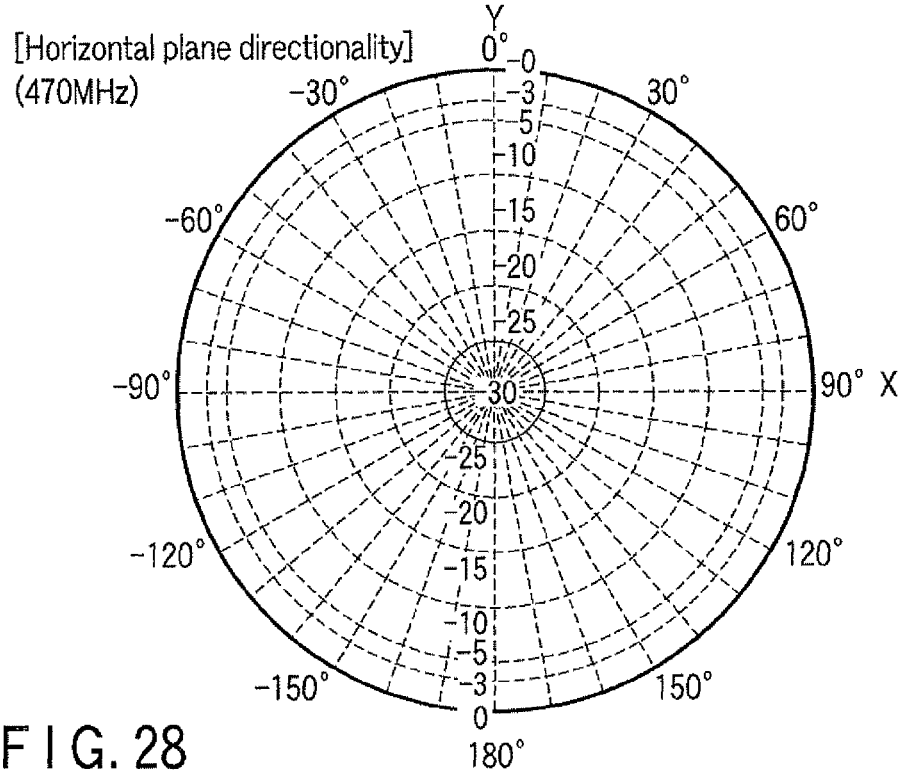
FIG. 28 is a diagram showing a vertically-polarized horizontal plane directionality of the antenna apparatus according to the fourth embodiment at a frequency of 470 MHz.
Figure 29:
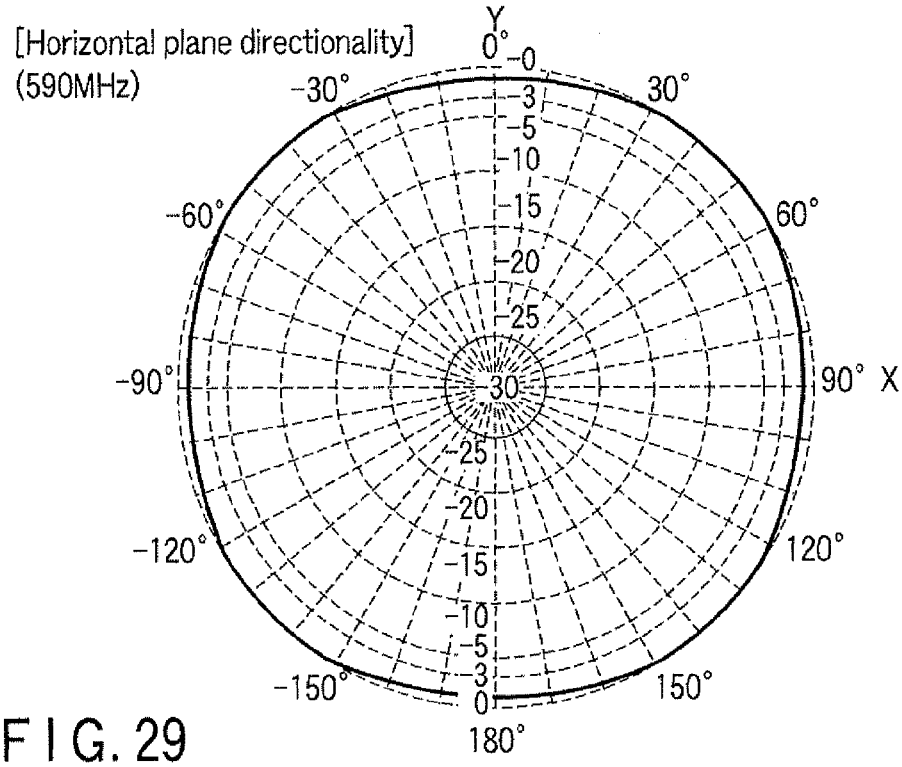
FIG. 29 is a diagram showing a vertically-polarized horizontal plane directionality of the antenna apparatus according to the fourth embodiment at a frequency of 590 MHz.
Figure 30:
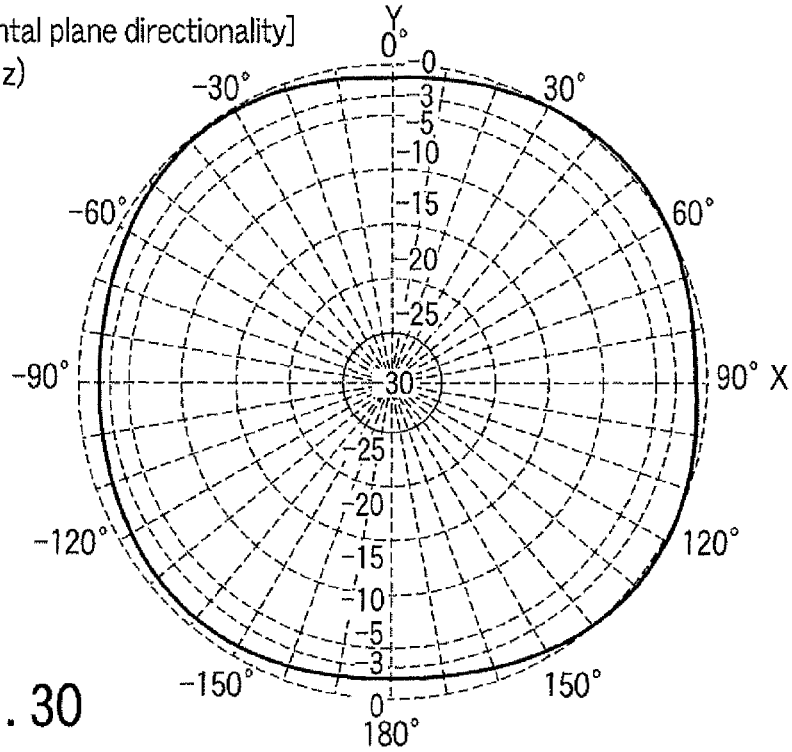
FIG. 30 is a diagram showing a vertically-polarized horizontal plane directionality of the antenna apparatus according to the fourth embodiment at a frequency of 710 MHz.

FIG. 28 to FIG. 30 show vertically-polarized horizontal plane (X-Y plane) directionality of the antenna apparatus according to the fourth embodiment, FIG. 28 showing characteristic at a frequency of 470 MHz, FIG. 29 showing characteristic at a frequency of 590 MHz, and FIG. 30 showing characteristic at a frequency of 710 MHz.

The horizontal plane directionality of the antenna apparatus according to the fourth embodiment appears as non-directionality suppressed to deflection of 2 dB or less at the respective frequency bands, as apparent from FIG. 28 to FIG. 30.

Figure 31:
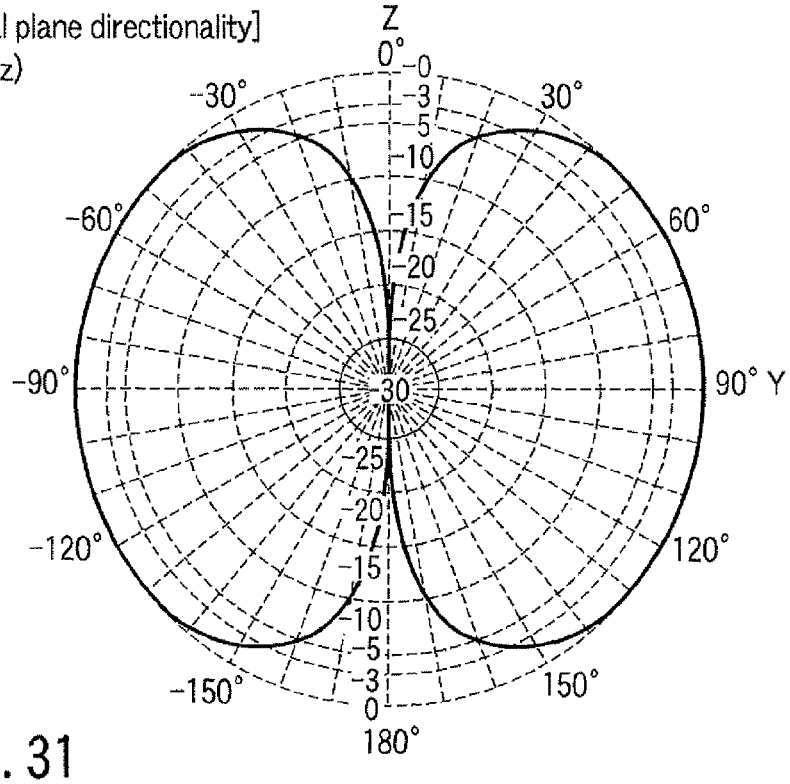
FIG. 31 is a diagram showing a vertically-polarized vertical plane directionality of the antenna apparatus according to the fourth embodiment at a frequency of 470 MHz.
Figure 32:
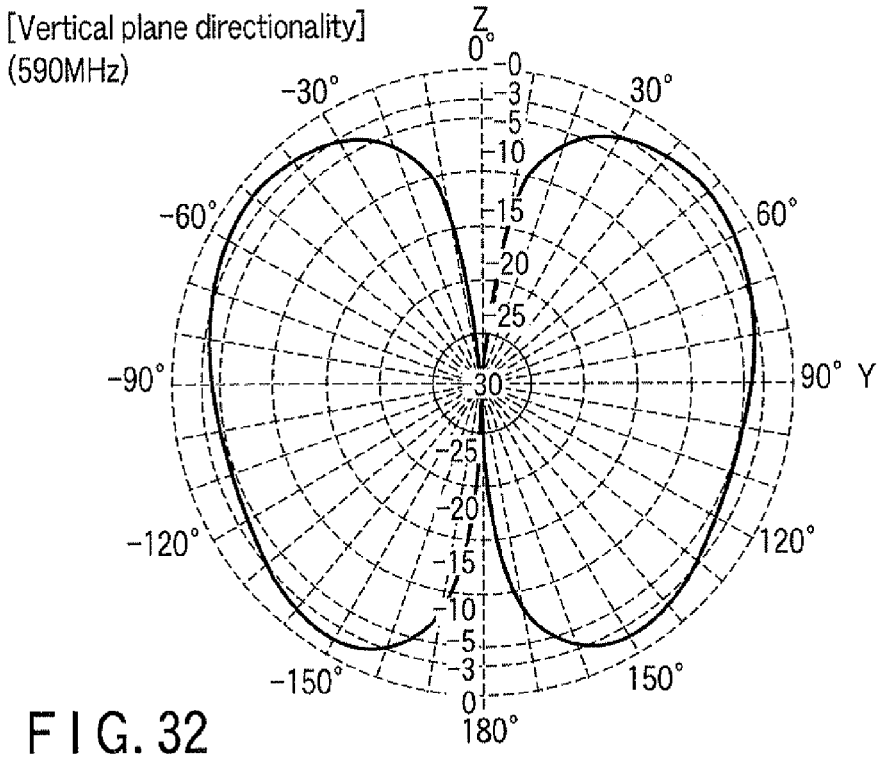
FIG. 32 is a diagram showing a vertically-polarized vertical plane directionality of the antenna apparatus according to the fourth embodiment at a frequency of 590 MHz.
Figure 33:
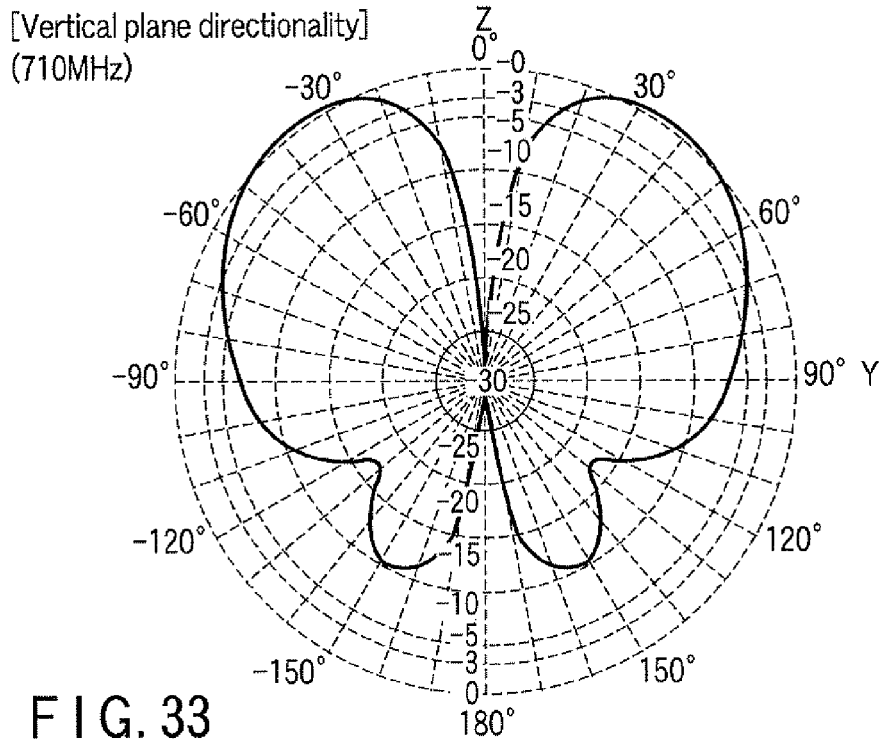
FIG. 33 is a diagram showing a vertically-polarized vertical plane directionality of the antenna apparatus according to the fourth embodiment at a frequency of 710 MHz.

FIG. 31 to FIG. 33 show vertically-polarized vertical plane (Y-Z plane) directionality, FIG. 31 showing characteristic at a frequency of 470 MHz, FIG. 32 showing characteristic at a frequency of 590 MHz, and FIG. 33 showing characteristic at a frequency of 710 MHz. Since an antenna configuration is set to a bilaterally symmetrical structure, the directionality is also symmetrical.

According to the fourth embodiment, by providing the matching plates 31*a* to 31*d*, the VSWR characteristic can be improved and the conductor plate 11 can be reduced, which can result in size reduction of the antenna. Even when the matching plates 31*a* to 31*d* are provided, it is unnecessary to further increase the height of the radiating elements 16*a* to 16*d*, and desired emission characteristic can be obtained while the height shown in the first embodiment is maintained.

By providing the spacers 32*a* to 32*d* between the ring-shaped element 25 and the conductor plate 11, the whole ring-shaped element 25 can be kept parallel with the conductor plate 11, so that stable characteristic can be always held.

Incidentally, in the fourth embodiment, the case where the matching plates 31*a* to 31*d* are formed by expanding portions of the conductor plate 11 and bending the expanded portions has been shown, but the matching plates 31*a* to 31*d* can be formed by attaching other members to the conductor plate 11. Portions to be attached with the other members are not limited to four corners of the conductor plate 11. Such a configuration can be adopted that the matching plates 31*a* to 31*d* are formed by attaching these members any portions on straight extension lines connecting the feeding point 18 and the short-circuiting portions of the radiating elements 16*a* to 16*d* near the short-circuiting portions.

In the fourth embodiment, the case where the matching plates 31*a* to 31*d* are formed by bending the expanded portions of the conductor plate 11 by 90° has been shown, but the expanded portions may be utilized as the matching plates 31*a* to 31*d* as they are without bending the expanded portions, so that an effect similar to that obtained in the case that the expanded portions are bent can be obtained.

In the fourth embodiment, the case where the matching plates 31*a* to 31*d* are formed at four corners of the conductor plate 11 has been shown, but the matching plates 31*a* to 31*d* may be provided on side portions of the conductor plate 11 positioned near the short pins 19*a* to 19*d* when the short pins 19*a* to 19*d* of the radiating elements 16*a* to 16*d* are provided corresponding to the side portions of the conductor plate 11.

In the fourth embodiment, the case that implementation is performed to the antenna provided with the ring-shaped element 25 has been shown, but an effect of matching can be obtained even when the matching plates 31*a* to 31*d* are provided to an antenna which does not include the ring-shaped element 25.

Fifth Embodiment

Next, an antenna apparatus according to a fifth embodiment of the present invention will be explained.

Figure 34:
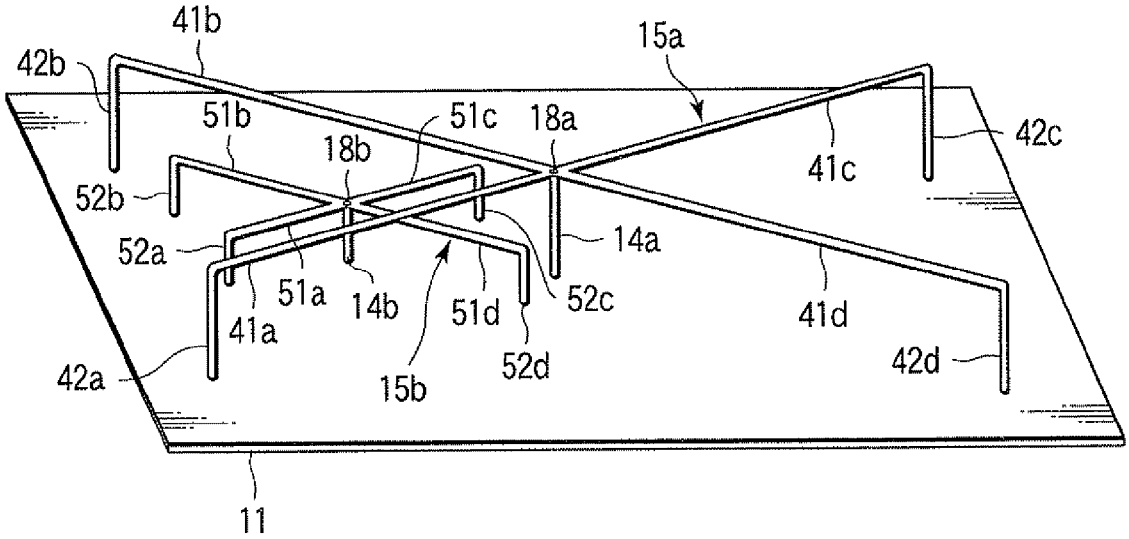
FIG. 34 is a perspective view showing a configuration of an antenna apparatus according to a fifth embodiment of the present invention.

FIG. 34 is a perspective view of an antenna apparatus according to the fifth embodiment of the present invention.

The antenna apparatus according to the fifth embodiment has such a configuration that a plurality of, for example, first antenna element 15*a* and second antenna element 15*b* is provided on one conductor plate 11. In the embodiment, a case where the antenna elements 15*a* and 15*b* are formed using linear elements has been shown. The first antenna element 15*a* is set such that its respective sections are resonated according to a signal falling in a low frequency band and the second antenna element 15*b* is set such that its respective sections are resonated according to a signal falling in a frequency band higher than the frequency applied to the first antenna element 15*a*.

Since the first antenna element 15*a* and the second antenna element 15*b* have a configuration similar to that of the antenna element 15 shown in each embodiment, detailed explanation thereof is omitted, but the first and second antenna elements 15*a* and 15*b* are formed using at least three radiating elements 41*a* to 41*d* and 51*a* to 51*d* and short pins (or short plates) 42*a* to 42*d* and 52*a* to 52*d* connecting outer ends of the respective radiating elements to the conductor plate 11, where feeding is performed to feeding points 18*a* and 18*b* provided at central portions of the respective radiating elements by central conductors 14*a* and 14*b* of coaxial connectors. Further, passive elements may be provided around feeding line paths. A ring-shaped element explained regarding the third embodiment may be provided at an upper portion of each of the antenna elements 15*a* and 15*b*.

The first antenna element 15*a* is set so as to be resonated according to a signal falling in a low frequency band. On the other hand, since lengths of respective sections of the second antenna element 15*b* are set so as to be resonated according to a signal in falling in a frequency band higher than a resonant frequency of the first antenna element 15*a*, sizes of the respective sections are shorter than those of is corresponding sections of the first antenna element 15*a* and the second antenna element 15*b* can be provided utilizing a space occurring among the respective radiating elements 41*a* to 41*d* of the first antenna element 15*a* and below them. Therefore, two antenna elements 15*a* and 15*b* can be arranged without forming the conductor plate 11 to have an especially large size.

By arranging two antenna elements 15*a* and 15*b* on one conductor plate 11 in the above manner, the antenna apparatus can be caused to respond to different frequency bands while maintaining a small size and a low profile.

Incidentally, in the fifth embodiment, the case where two antenna elements 15*a* and 15*b* are provided on one conductor plate 11 has been shown, but at least three antenna elements may be provided.

Since the antenna apparatus according to the present invention is configured to correspond to a wide band and have horizontal plane nondirectionality while maintaining a small size and a low profile, it can produce a large effect in use for not only a relay unit for one-segment broadcasting but also a relay station or a wireless LAN in a mobile communication, or the like. In a high frequency band such as a GHz band, an antenna is further reduced in size, so that it can be used for a mobile device.

Sixth Embodiment

Next, an antenna apparatus according to a sixth embodiment of the present invention will be explained.

Figure 35:
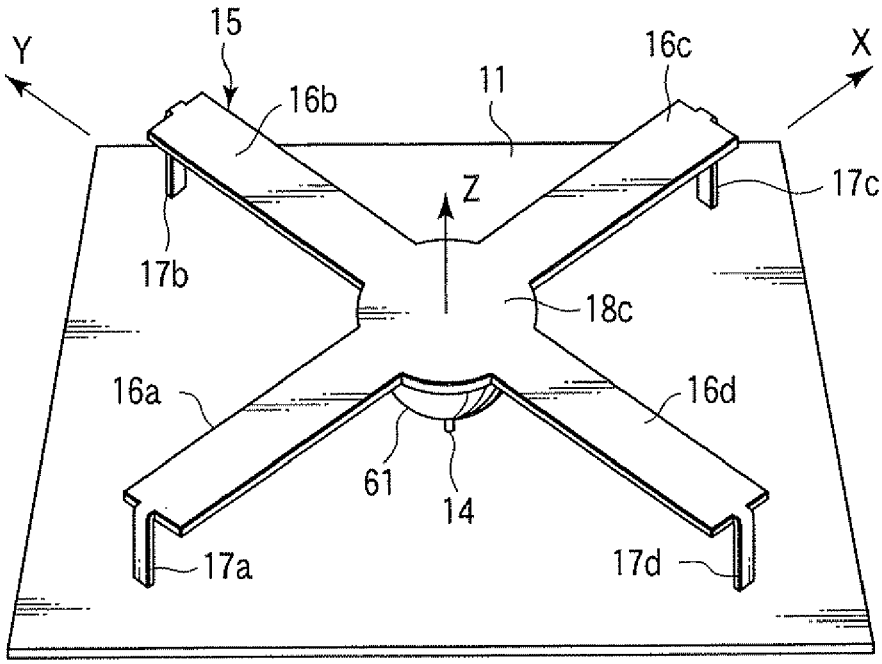
FIG. 35 is a perspective view showing a configuration of an antenna apparatus according to a sixth embodiment of the present invention.
Figure 36:
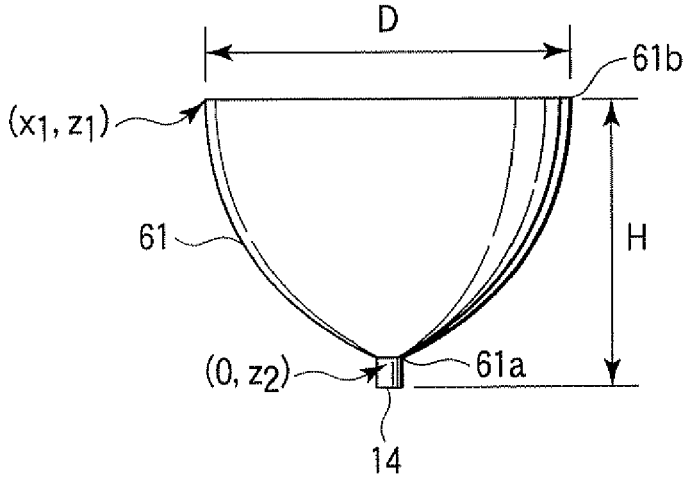
FIG. 36 is a side view showing details of a feeding path portion in the sixth embodiment.

FIG. 35 is a perspective view of an antenna apparatus according to the sixth embodiment and FIG. 36 is a side view showing details of a feeding path 61 portion.

The sixth embodiment has such a configuration that a feeding path 61 obtained by forming a hemispherical outer peripheral surface to have a curve of an exponent function is provided below a feeding portion 18*c* formed at a central portion of the radiating elements 16*a* to 16*d* in the antenna apparatus shown in the first embodiment. Regarding the feeding path 61, its circular portion is positioned at an upper side to be connected to the feeding portion 18*c* and its top portion having the exponent function curve positioned at a lower side is connected to a central conductor 14 of a coaxial connector 12 provided at an upper portion of the conductor plate 11 by soldering or the like. A height of the central conductor 14 of the coaxial connector 12 provided on the upper portion of conductor plate 11 is set to have a value falling in a range from about 0 to several millimeters.

As illustrated, the feeding path 61 is formed such that its end portion (an upper end) 61*b* on the side of the feeding portion 18*c* has a width wider than (width expanded as compared with) its end portion (a lower end) 61*a* on a feeding terminal (the coaxial connector 12). The upper side circular portion of the feeding path 61 is fixed and electrically connected to the feeding portion 18*c* for the radiating elements 16*a* to 16*d* at several portions by screwing or the like. In this case, the feeding portion 18*c* is set such that its shape and size correspond to the upper side circular portion of the feeding path 61 at a crossing central portion of the radiating elements 16*a* to 16*d*. The shape of the feeding path 61 is set, for example, such that its height H (shown in FIG. 36) is about $\lambda_L/10$ and a diameter D of the upper side circular portion is about $\lambda_L/13$. Incidentally, the diameter D of the upper side circular portion is preferably about $\lambda_L/13$, but it can be set to a value falling in a range of $\lambda_L/13\pm50\%$. The height H of the feeding path 61 is preferably set to have a value of about $\lambda_L/10$, but it can be lowered to have a value lower than about $\lambda_L/10$, for example, about $\lambda_L/16$.

An outer peripheral surface of the feeding path 61 can be obtained by rotating a generating line obtained from the following equation about a vertical axis line.

$$x=-[\exp\{-a(z-z_1)\}-1]+x_1$$

Here, as shown in FIG. 36, (x, y) coordinate position of the upper side of the feeding path 61 is defined as $(x_1, z_1)$, and (x, z) coordinate position of the lower side top is defined as $(0, z_2)$. In the equation, "a" is a constant.

Incidentally, in the sixth embodiment, the width of the short-circuiting elements 17*a* to 17*d* is narrow, for example, it is set to about $\lambda_L/120$, but it may be the same as the width W2 of the radiating elements 16*a* to 16*d*, as shown in the first embodiment. Since the other configuration is similar to that of the first embodiment, same portions are attached with same reference numerals and detailed explanation thereof is omitted.

Figure 37:
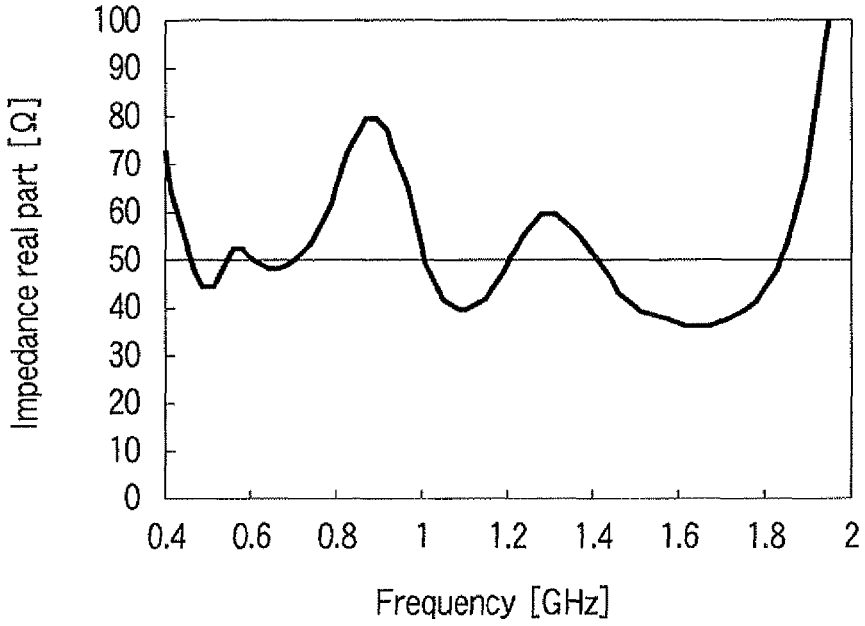
FIG. 37 is a real part impedance characteristic diagram in a feeding portion of the antenna apparatus according to the sixth embodiment.

FIG. 37 shows a frequency characteristic of input resistance at the feeding portion 18*c* of the antenna apparatus according to the sixth embodiment, where a horizontal axis takes frequency [GHz] and a vertical axis takes resistance [Ω]. The frequency characteristic of the input resistance is kept in an impedance of 50 (characteristic impedance of a feeding coaxial cable)±(20~30)Ω between 450 and 1850 MHz.

Figure 38:
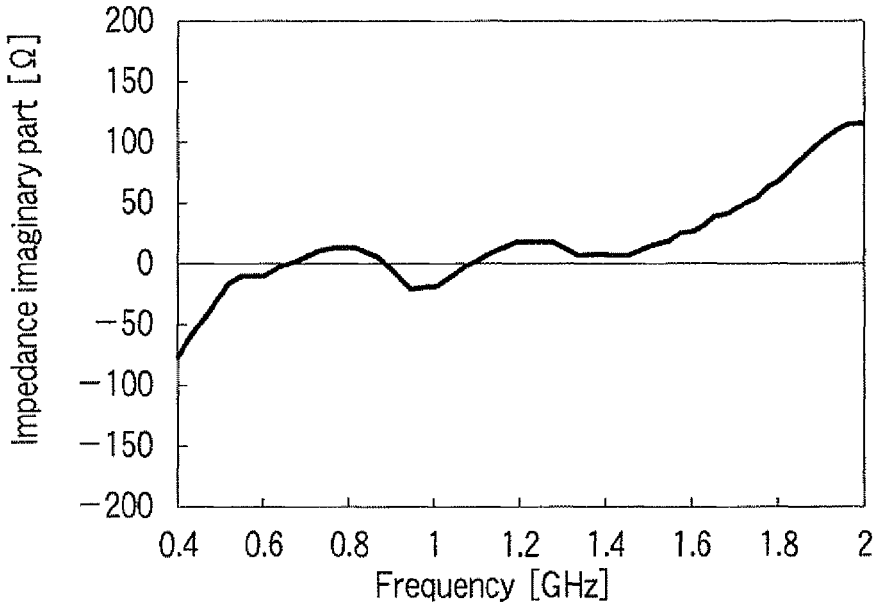
FIG. 38 is an imaginary part impedance characteristic diagram of the antenna apparatus according to the sixth embodiment.

FIG. 38 shows an imaginary part impedance characteristic at the feeding portion 18*c* of the antenna apparatus, where a horizontal axis takes frequency [GHz] and a vertical axis takes reactance [Ω]. Regarding the imaginary part impedance characteristic, a reactance value of 0±50Ω can be obtained over a wide bandwidth from 450 to 1750 MHz, as apparent from FIG. 38.

Figure 39:
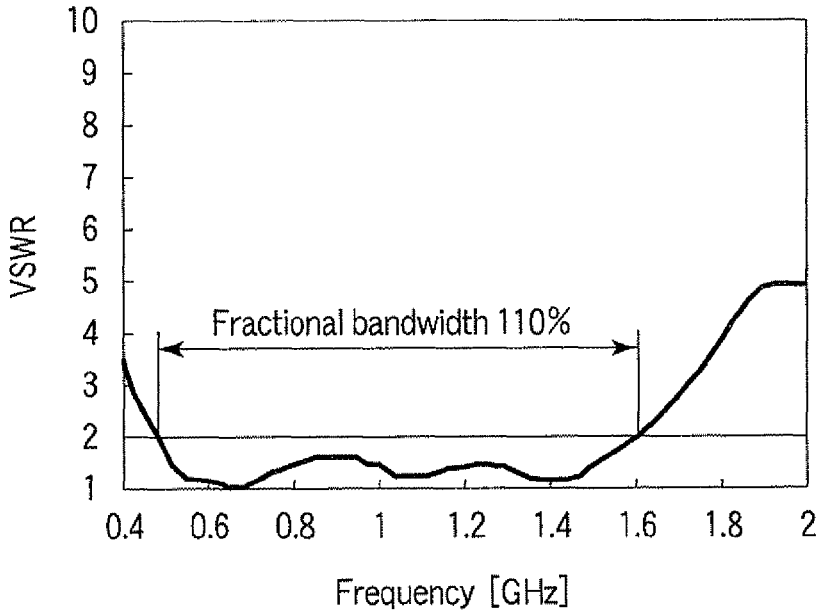
FIG. 39 is a VSWR characteristic diagram of the antenna apparatus according to the sixth embodiment.

FIG. 39 is a VSWR characteristic when a length W1 of one side of the conductor plate 11 is set to 400 mm in the antenna apparatus, where a horizontal axis takes frequency [GHz] and a vertical axis takes VSWR. Regarding the VSWR characteristic, VSWR≦2 is obtained over a wide bandwidth from 470 to 1600 MHz, so that a fractional bandwidth of about 110% is obtained.

Figure 40:
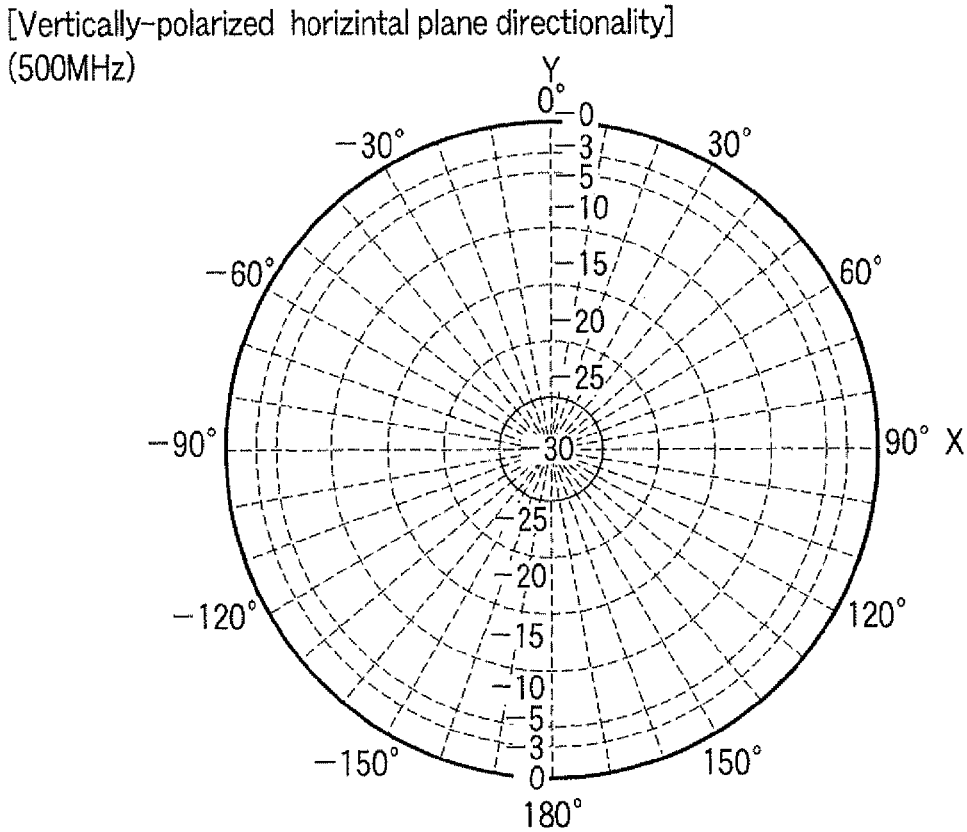
FIG. 40 is a diagram showing vertically-polarized horizontal plane directionality (X-Y plane) of the antenna apparatus according to the sixth embodiment at a frequency of 500 MHz.
Figure 41:
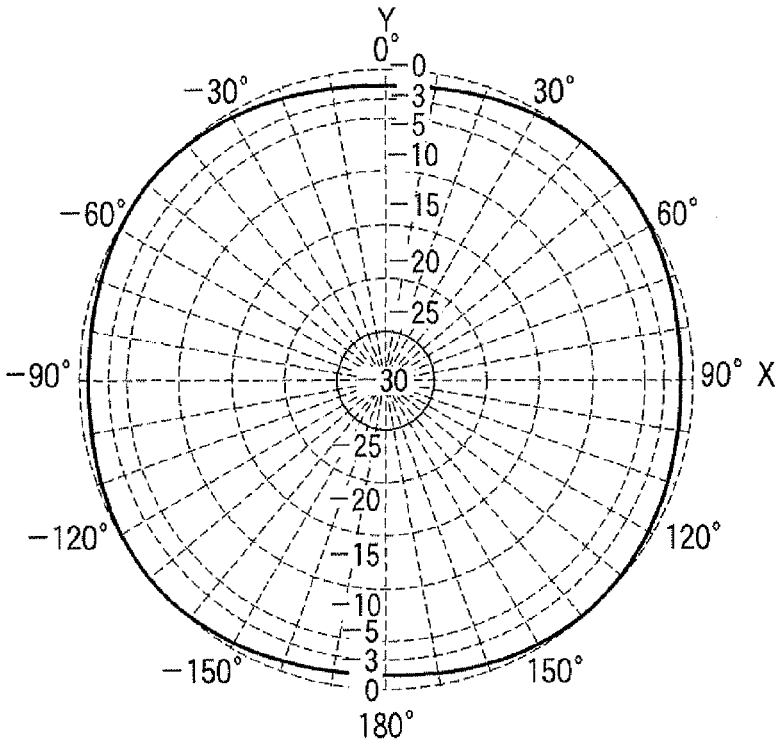
FIG. 41 is a diagram showing vertically-polarized horizontal plane directionality (X-Y plane) of the antenna apparatus according to the sixth embodiment at a frequency of 1 GHz.
Figure 42:
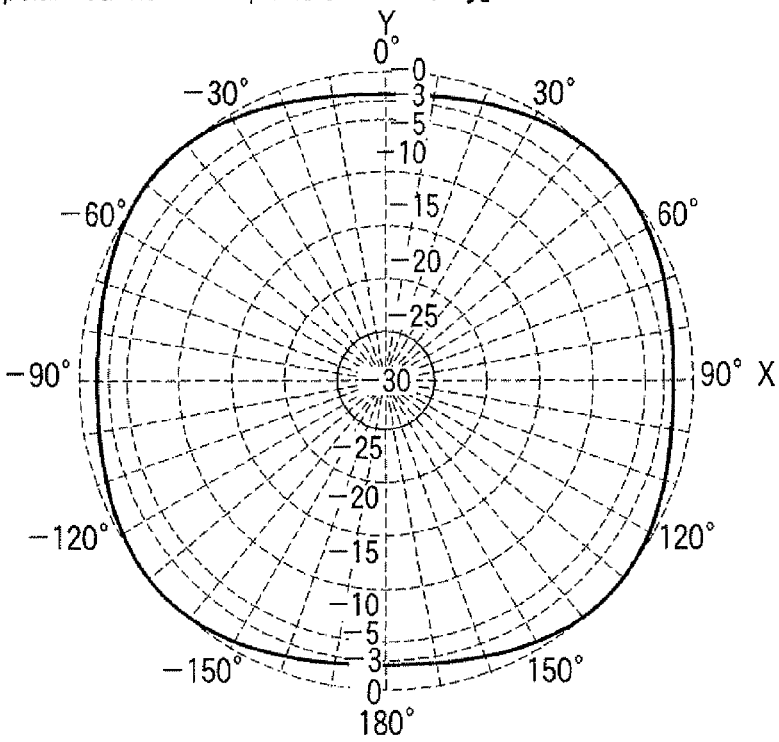
FIG. 42 is a diagram showing vertically-polarized horizontal plane directionality (X-Y plane) of the antenna apparatus according to the sixth embodiment at a frequency of 1.6 GHz.

FIG. 40 to FIG. 42 show vertically-polarized horizontal plane directionality (X-Y plane) of the antenna apparatus according to the sixth embodiment, FIG. 40 showing characteristic at a frequency of 500 MHz, FIG. 41 showing characteristic at a frequency of 1 GHz, and FIG. 42 showing characteristic at a frequency of 1.6 GHz.

The horizontal plane directionality of the antenna apparatus according to the sixth embodiment appears as non-directionality suppressed to deflection of 2 dB or less at each frequency, as also apparent from FIG. 40 to FIG. 42.

According to the sixth embodiment, the antenna apparatus can be formed to be reduced in size and have a lower profile, it can be installed easily even in a place where an installation space is narrow, such as an underground mall, and it can maintain aesthetic purposes.

By making formation such that the outer peripheral surface of the feeding path 61 forms a curve represented by an exponent function, namely, a curve using exponential, input resistance can be kept at about 50Ω approximately equal to characteristic impedance of the feeding coaxial cable and the antenna apparatus can be used as a wideband antenna without using an impedance converter. Therefore, the number of parts can be reduced, a size of the whole antenna can be reduced, and work for mounting an antenna can be simplified.

Incidentally, in the sixth embodiment, the length L of the respective radiating elements 16*a*, 16*b*, . . . is set utilizing a point on the center line of the feeding path 61, namely, the extension line of the central conductor 14 as a starting end. This is similarly applied to the following embodiments.

Seventh Embodiment

Next, an antenna apparatus according to a seventh embodiment of the present invention will be explained.

Figure 43:
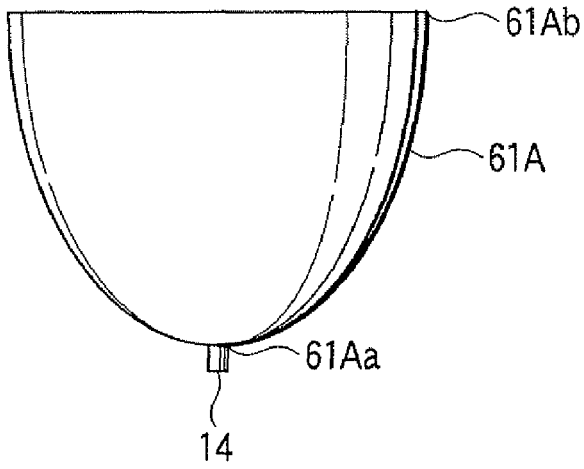
FIG. 43 is a side view showing details of a feeding path portion of an antenna apparatus according to a seventh embodiment of the present invention.

An antenna apparatus according to the seventh embodiment has such a configuration that a feeding path 61A whose hemispherical outer peripheral surface is formed in an approximately semi-elliptical shape is used instead of the feeding path 61 having a curve of an exponent function in the sixth embodiment, as shown in FIG. 43. As illustrated, the feeding path 61A is width-expanded such that an upper end 61Ab is wider than a lower end 61Aa. Since the other configuration is the same as that of the sixth embodiment, detailed explanation thereof is omitted. An ellipsoid ellipticity of the feeding path 61A is about 60%, for example.

Figure 44:
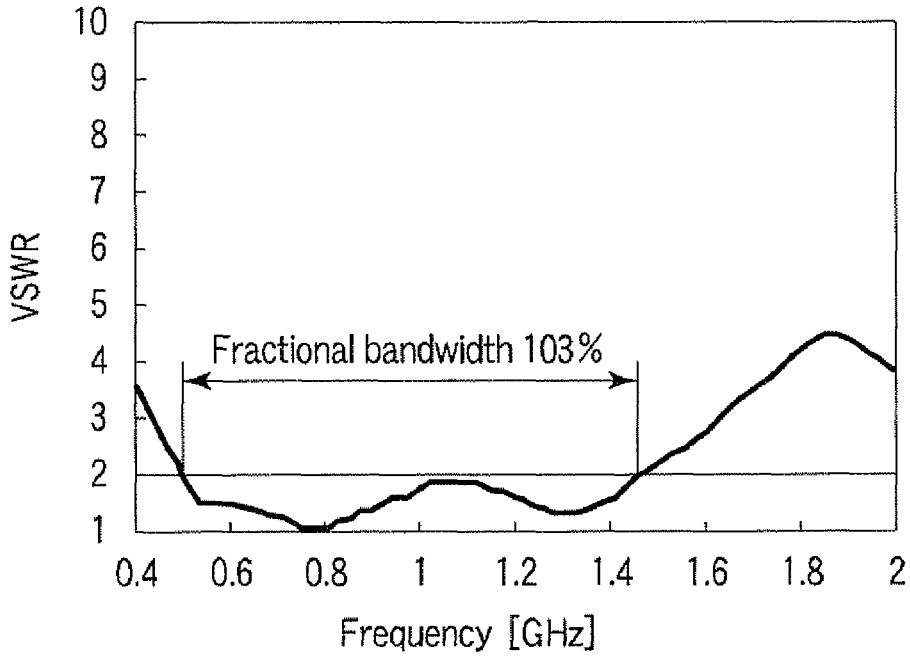
FIG. 44 is a VSWR characteristic diagram of the antenna apparatus according to the seventh embodiment.

FIG. 44 shows VSWR characteristic of the antenna apparatus according to the seventh embodiment, where a horizontal axis takes frequency [GHz] and a vertical axis takes VSWR. Regarding the VSWR characteristic, VSWR≦2 is obtained over a wide bandwidth from 500 to 1450 MHz, and a fractional bandwidth of about 103% is obtained.

In the antenna apparatus according to the seventh embodiment, the input resistance can be kept in a value of about 50Ω over a wide frequency bandwidth in the same manner as the antenna apparatus according to the sixth embodiment, and the antenna apparatus can be used as a wideband antenna without using an impedance converter.

Figure 45A:
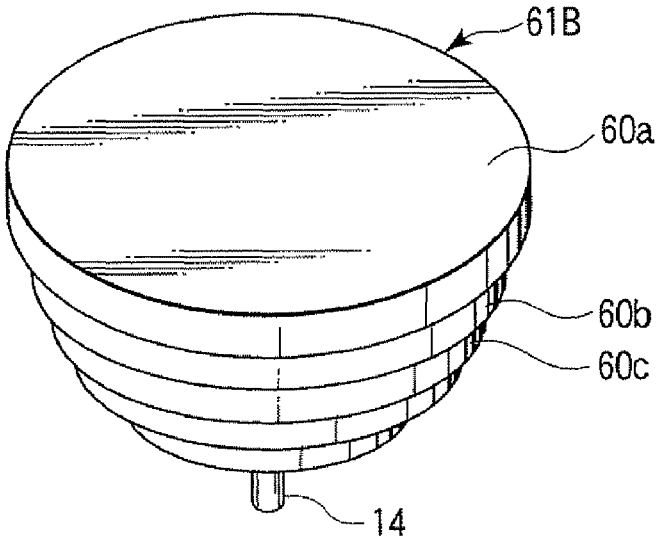
FIG. 45A is a perspective view showing another configuration example of a feeding path in the seventh embodiment.
Figure 45B:
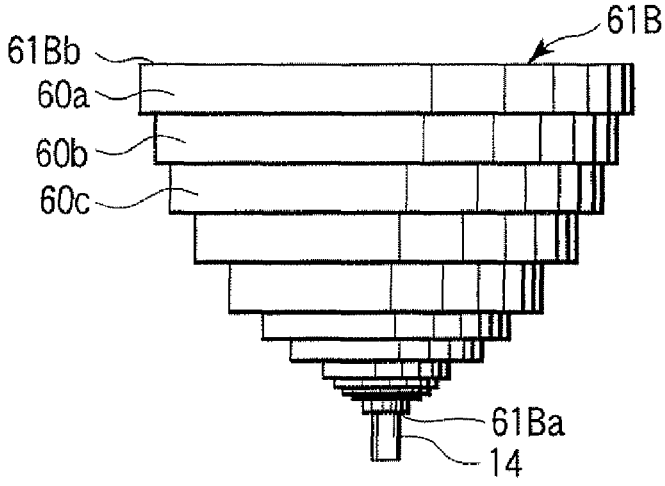
FIG. 45B is a side view showing another configuration example of a feeding path in the seventh embodiment.

Incidentally, in the sixth embodiment, the case where the outer peripheral surface of the feeding path 61 is formed in the exponent function curve has been shown and in the seventh embodiment, the case where the outer peripheral surface of the feeding path 61A is formed in the semi-elliptical shape has been shown, but characteristic similar to that of the antenna apparatus shown in the sixth embodiment or the seventh embodiment can be further obtained even when a feeding path 61B whose outer peripheral surface has a shape (the upper end 61Bb has a width wider than the lower end 61Ba) similar to an exponent function curve or a semi-elliptical shape is formed by stacking a plurality of circular metal plates 60*a*, 60*b*, . . . different in diameter, for example, as shown in FIGS. 45A and 45B. The abovementioned FIG. 45A is a perspective view of the feeding path 61B and FIG. 45B is a side view thereof.

Eighth Embodiment

Next, an antenna apparatus according to an eighth embodiment of the present invention will be explained.

Figure 46:
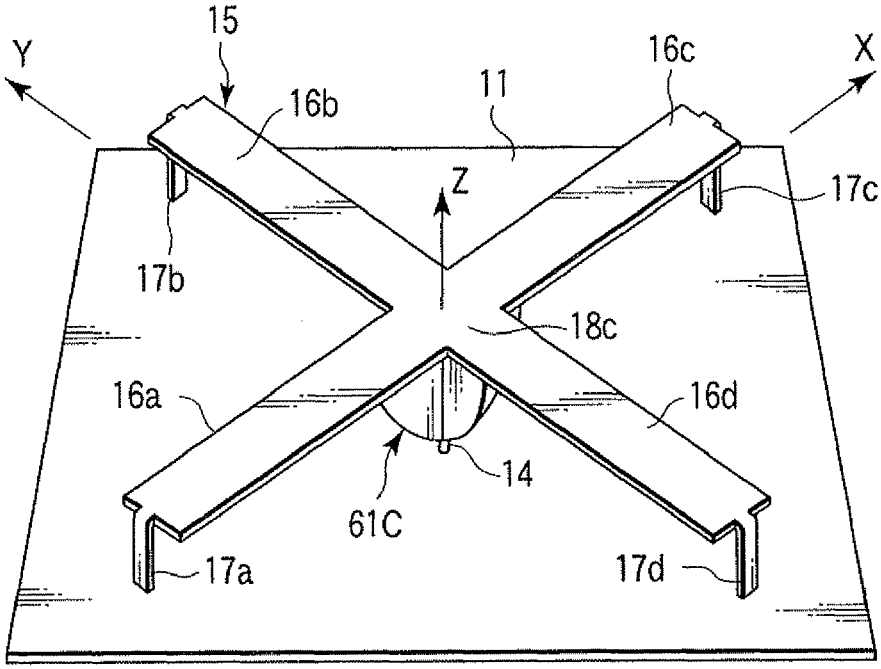
FIG. 46 is a perspective view showing a configuration of an antenna apparatus according to an eighth embodiment of the present invention.
Figure 47:
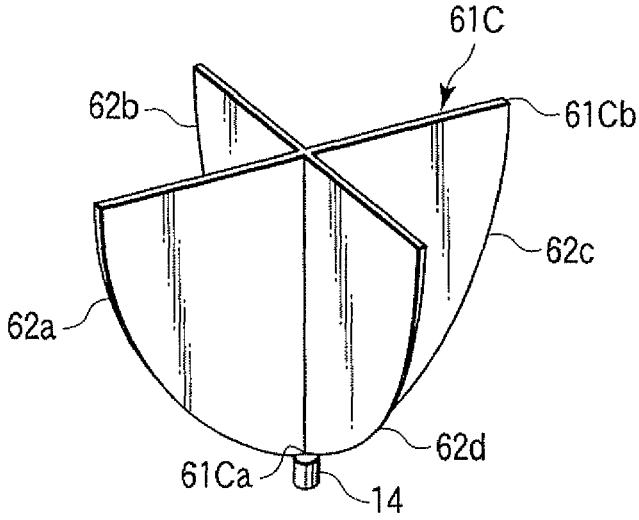
FIG. 47 is a perspective view showing details of a feeding path portion in the eighth embodiment.

FIG. 46 is a perspective view of an antenna apparatus according to the eighth embodiment of the present invention and FIG. 47 is a perspective view showing details of a feeding path portion.

The antenna apparatus according to the eighth embodiment has such a configuration that a feeding path 61C comprising a plurality of, for example, four metal plates 62*a* to 62*d* whose outer peripheral surfaces are formed in a curve of an exponent function, in other word, whose upper ends 61Cb are wider than lower ends 61Ca is used instead of the feeding path 61 having the exponent function curve in the sixth embodiment, as shown in FIG. 46 and FIG. 47. In this case, the metal plates 62*a* to 62*d* configuring the feeding path 61C are disposed to be positioned below the radiating elements 16*a* to 16*d*. Since the other configuration is the same as that of the sixth embodiment, same portions are attached with same reference numerals and detailed explanation thereof is omitted.

Even when the feeding path 61C comprising the plurality of metal plates 62*a*, 62*b*, . . . whose outer peripheral surfaces are formed in a curve of an exponent function is used as described above, the input resistance can be kept at a value of about 50Ω over a wide frequency band in the same manner as the sixth embodiment, and wideband characteristic can be obtained without using an impedance converter.

Incidentally, in the eighth embodiment, the case where the feeding path 61C is configured using four metal plates 62*a* to 62*d* has been shown, but when the number of radiating elements 16 is changed, the feeding path is configured using metal plates 62*a*, 62*b*, . . . of the same number as the number of radiating elements 16 and the metal plates 62*a*, 62*b*, . . . are disposed to be positioned below the respective radiating elements 16*a*, 16*b*, . . . .

In the eight embodiment, the case where the outer peripheral surfaces of the metal plates 62*a* to 62*d* configuring the feeding path 61C are formed in the curve of an exponent function has been shown, but similar characteristic can be obtained even by forming the outer peripheral surfaces of the metal plates 62*a* to 62*d* in a semi-elliptical shape. That is, by forming a width of the feeding path 61C comprising the respective metal plates such that its upper end is wider than its lower end, wideband characteristic can be realized.

Ninth Embodiment

Next, an antenna apparatus according to a ninth embodiment of the present invention will be explained.

Figure 48:
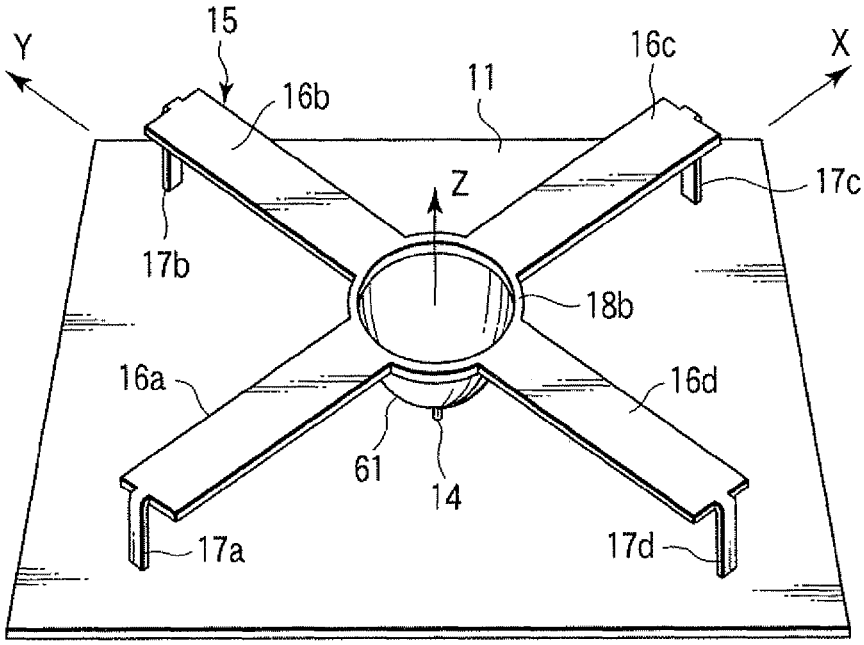
FIG. 48 is a perspective view showing a configuration of an antenna apparatus according to a ninth embodiment of the present invention.

FIG. 48 is a perspective view of an antenna apparatus according to the ninth embodiment of the present invention.

The antenna apparatus according to the ninth embodiment has such a configuration that a feeding path 61 having the curve of the exponent function in the sixth embodiment is formed to have a hollow structure. In this case, thought not illustrated, for example, a plurality of supporting pieces is formed on a periphery of an upper side circular portion of the feeding path 61 to correspond to the respective radiating elements 16*a* to 16*d* and the feeding path 61 is fixed to the radiating elements 16*a* to 16*d* by screwing or the like and utilizing the supporting pieces. Since the other configuration is the same as that of the sixth embodiment, same portions are attached with same reference numerals and detailed explanation thereof is omitted.

Even if the feeding path 61 is formed to be hollow in the above manner, a characteristic similar to that of the antenna apparatus according to the sixth embodiment can be obtained.

Incidentally, in the above FIG. 48, the case where the radiating elements 16*a* to 16*d* are not provided on the hollow section of the feeding path 61 has been shown, but the radiating elements 16*a* to 16*d* may be positioned at an upper opening portion of the feeding path 61.

In the ninth embodiment, the case that the feeding path 61 having the curve of the exponent function is formed to be hollow has been shown, but the feeding path 61A whose outer peripheral surface is formed in a semi-elliptical shape, shown in the seventh embodiment may be formed to be hollow.

As shown in FIG. 45A and FIG. 45B, such a configuration can be adopted that the feeding path 61B having a shape similar to the curve of the exponent function or the semi-elliptical shape, formed by stacking circular metal plates 60*a*, 60*b*, . . . different in diameter is formed to be hollow.

Tenth Embodiment

Next, an antenna apparatus according to a tenth embodiment of the present invention will be explained.

Figure 49:
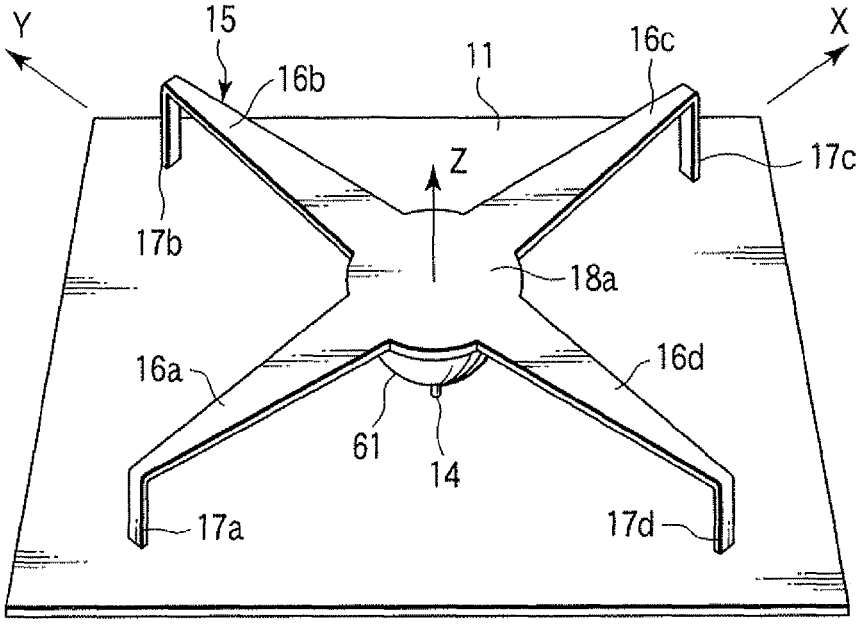
FIG. 49 is a perspective view showing a configuration of an antenna apparatus according to a tenth embodiment of the present invention.

FIG. 49 is a perspective view of an antenna apparatus according to a tenth embodiment of the present invention. The tenth embodiment has such a configuration that the radiating elements 16*a* to 16*d* are formed to have a shape other than a rectangle, for example, such that their portions positioned on the sides of their short-circuiting elements 17*a* to 17*d* become narrow, namely, such that they become approximately triangular as viewed from the above in the antenna apparatus according to each of the abovementioned embodiment, for example, the sixth embodiment. Since the other configuration is similar to that of the antenna apparatus according to the sixth embodiment, detailed explanation thereof is omitted.

Even when the respective radiating elements 16*a* to 16*d* are formed to be approximately triangular in the above manner, characteristic approximately equivalent to that of the sixth embodiment can be obtained.

Eleventh Embodiment

Next, an antenna apparatus according to an eleventh embodiment of the present invention will be explained.

Figure 50:
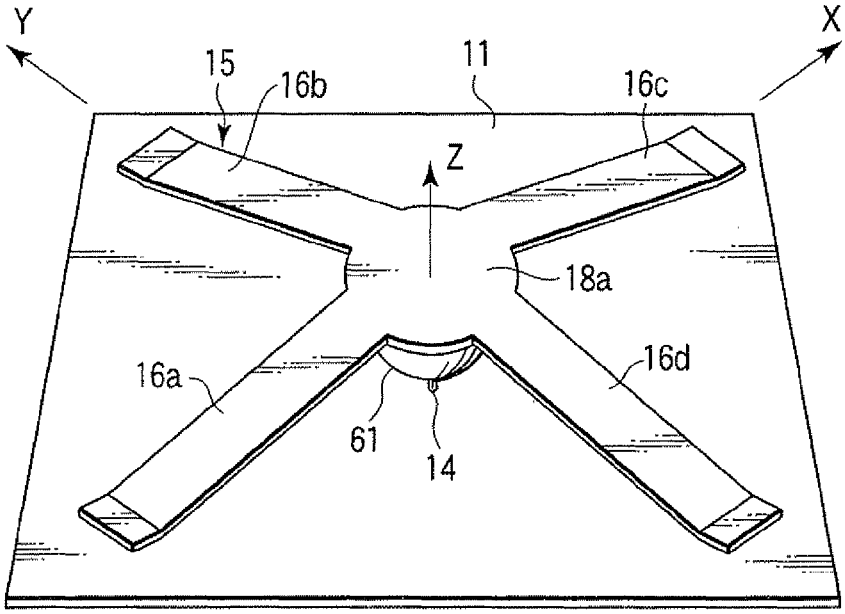
FIG. 50 is a perspective view showing a configuration of an antenna apparatus according to an eleventh embodiment of the present invention.

FIG. 50 is a perspective view of an antenna apparatus according to the eleventh embodiment of the present invention. The eleventh embodiment has such a configuration that respective radiating elements 16*a* to 16*d* are arranged so as to be inclined toward the conductor plate 11 and distal ends thereof are directly connected to the conductor plate 11 so that the short-circuiting elements 17*a* to 17*d* are omitted in the antenna apparatus according to each of the abovementioned embodiment, for example, the sixth embodiment. Since the other configuration is similar to that of the antenna apparatus according to the sixth embodiment, detailed explanation thereof is omitted.

Even when the respective radiating elements 16*a* to 16*d* are arranged so as to be inclined in the above manner and the distal ends thereof are directly connected to the conductor plate 11 characteristic approximately equivalent to that of the sixth embodiment can be obtained.

Twelfth Embodiment

Next, an antenna apparatus according to a twelfth embodiment of the present invention will be explained.

Figure 51:
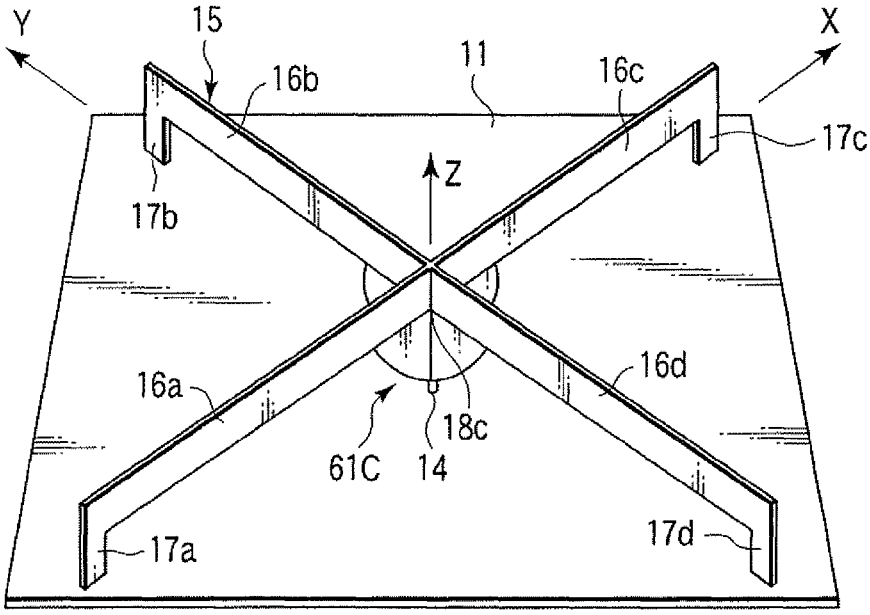
FIG. 51 is a perspective view showing a configuration of an antenna apparatus according to a twelfth embodiment of the present invention.

FIG. 51 is a perspective view of an antenna apparatus according to the twelfth embodiment of the present invention. The twelfth embodiment has such a configuration which surfaces of respective radiating elements 16*a* to 16*d* are arranged so as to be positioned perpendicularly to the conductor plate 11 in the antenna apparatus according to each of the embodiments, for example, the eighth embodiment shown in FIG. 46 and FIG. 47. In this case, it is desirable that a feeding path 61C comprising the same number of metal plates 62*a* to 62*d* as the number of the radiating elements 16*a* to 16*d* is used, as shown in the eighth embodiment, and the respective metal plates 62*a* to 62*d* are disposed to be positioned below the radiating elements 16*a* to 16*d*. Since the other configuration is similar as that of the antenna apparatus according to the eighth embodiment, detailed explanation thereof is omitted.

Even when arrangement is performed such which surfaces of the respective radiating elements 16*a* to 16*d* are positioned to be perpendicular to the conductor plate 11, an characteristic approximately equivalent to that of the sixth embodiment can be obtained.

Thirteenth Embodiment

Next, an antenna apparatus according to a thirteenth embodiment of the present invention will be explained.

Figure 52:
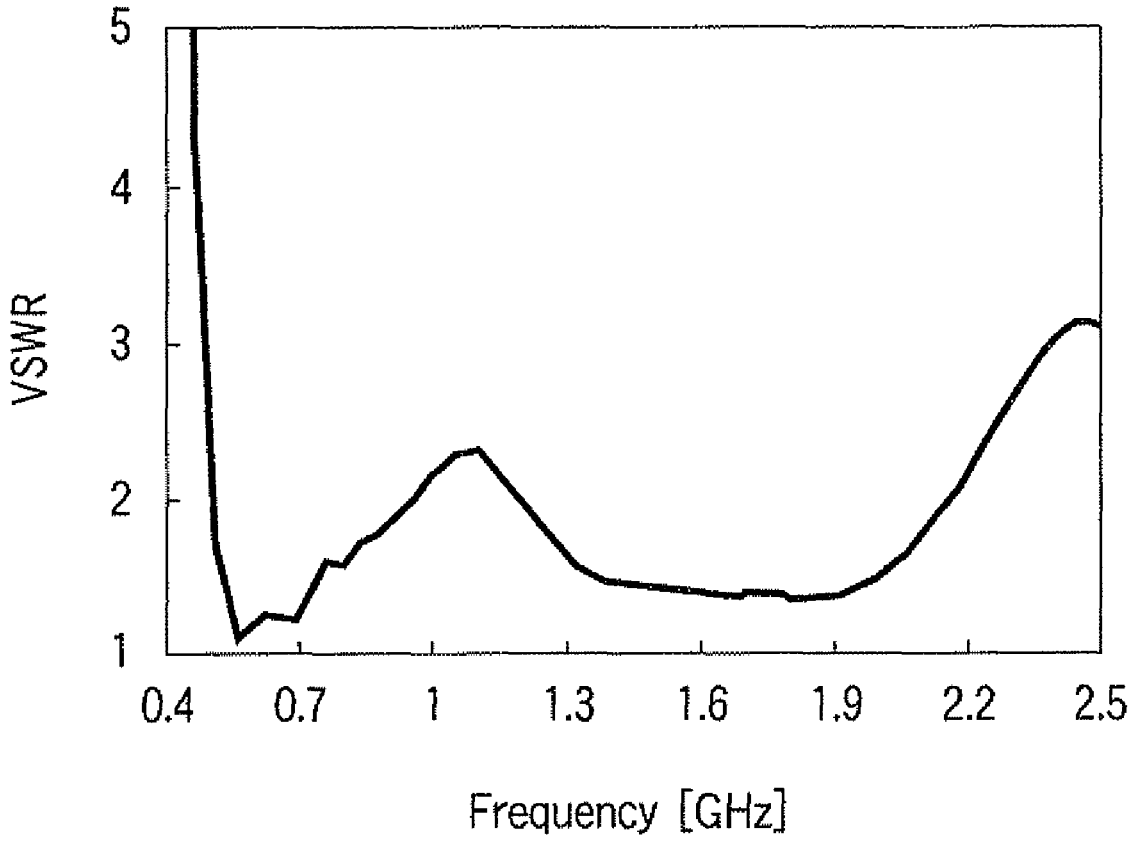
FIG. 52 is a VSWR characteristic diagram when a length of a radiating element is made long and an operation frequency is set to be low.

A frequency band can be adjusted by adjusting a length of the radiating elements 16*a* to 16*d*, a shape of the feeding path, or the like in each of the embodiments. However, when the frequency band is expanded, a value of VSWR near a specific frequency band (near 1.1 GHz in FIG. 52) may deteriorate like VSWR characteristic as shown in FIG. 52. Even when an antenna height is reduced without changing the length of the radiating elements, an impedance real part becomes high, so that a similar phenomenon takes place.

Figure 53A:
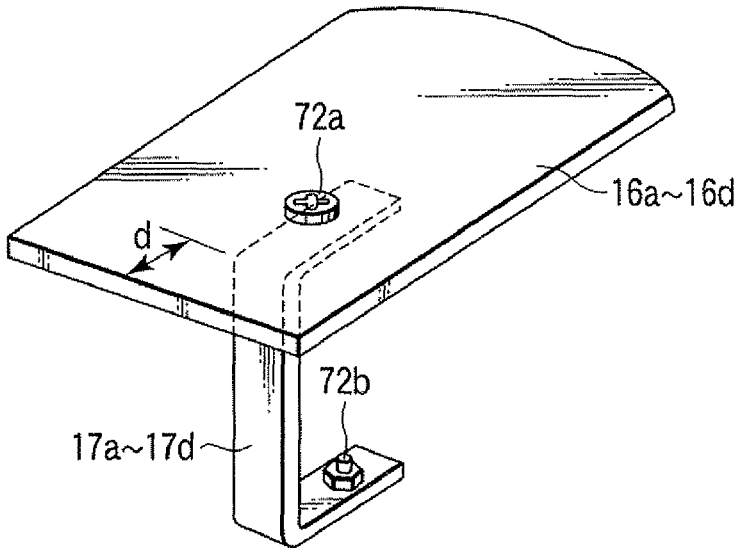
FIG. 53A is a perspective view showing a configuration example of a short-circuiting element in an antenna apparatus according to a thirteenth embodiment of the present invention.
Figure 53B:
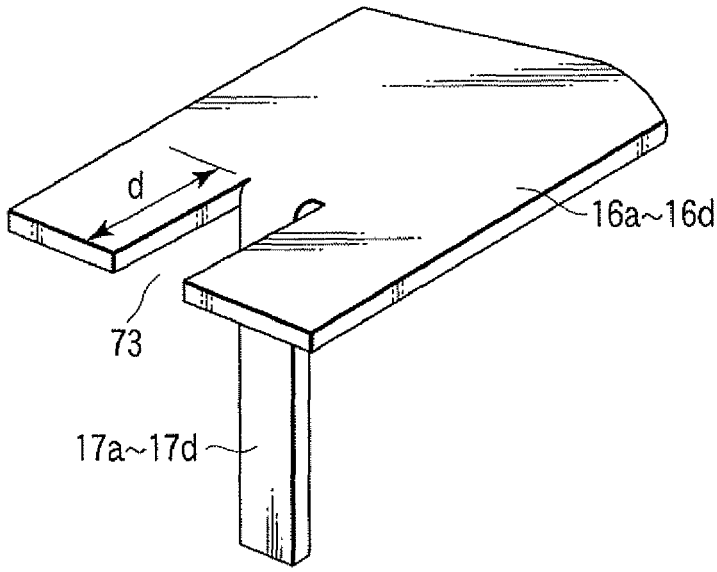
FIG. 53B is a perspective view showing another configuration example of the short-circuiting element in the antenna apparatus according to the thirteenth embodiment.

In order to solve such a problem, the short-circuiting elements 17*a* to 17*d* are provided to be positioned at inner sides by a predetermined distance d from end portions of the radiating elements 16*a* to 16*d* in the thirteenth embodiment, as shown in FIG. 53A or FIG. 53B. The predetermined distance d is set to a proper value corresponding to $\lambda_L$ and a frequency at which VSWR has deteriorated. By providing the predetermined distance d, the impedance real part near the frequency at which VSWR has deteriorated can be lowered and fluctuation of the impedance imaginary part can be reduced. Thereby, VSWR can be improved.

FIG. 53A shows an example where flanges are formed on upper ends and lower ends of short-circuiting elements 17*a* to 17*d* and the respective flanges are fixed to the radiating elements 16*a* to 16*d* and the conductor plate 11 by screws 72*a* and 72*b* so that the radiating elements 16*a* to 16*d* and the conductor plate 11 are short-circuited.

FIG. 53B shows an example where cuts 73 having a length d are provided in end portions of radiating elements 16*a* to 16*d*, portions defined by the cuts are bent to the side of the conductor plate 11 to form short-circuiting elements 17*a* to 17*d*, and distal ends of the portions are connected to the conductor plate 11 so that the radiating elements 16*a* to 16*d* and the conductor plate 11 are short-circuited.

Figure 54:
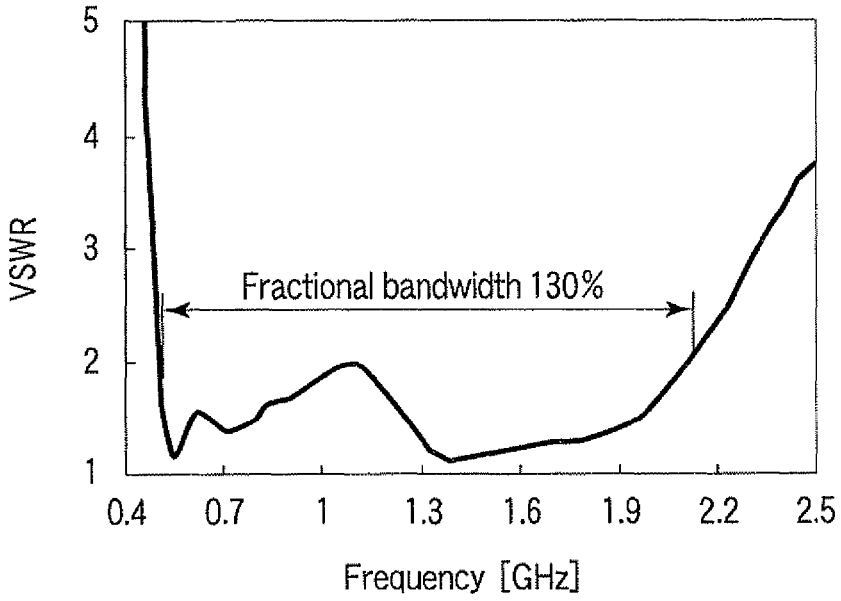
FIG. 54 is a VSWR characteristic diagram of the antenna apparatus according to the thirteenth embodiment.

FIG. 54 is a VSWR characteristic diagram obtained when impedance matching is performed by setting the predetermined distance d in a range from about $\lambda_L/55$ to $\lambda_L/25$ in the antenna apparatus showing the VSWR characteristic shown in FIG. 52. By providing the short-circuiting elements 17*a* to 17*d* at inner sides by the predetermined distance d from end portions of the radiating elements 16*a* to 16*d* like the above, the value of VSWR near 1.1 GHz can be suppressed to 2 or less, as shown in FIG. 54. Incidentally, the VSWR characteristic shown in FIG. 54 shows the case that a frequency band from 470 MHz to 2.1 GHz is set as a working bandwidth by adjusting the length of the radiating elements 16*a* to 16*d*, the shape of the feeding path, or the like. Regarding the VSWR characteristic shown in FIG. 54, VSWR≦2 is obtained in the bandwidth from 470 MHz to 2.1 GHz, and a fractional bandwidth of about 130% can be obtained.

Fourteenth Embodiment

Next, an antenna apparatus according to a fourteenth embodiment of the present invention will be explained.

Figure 55:
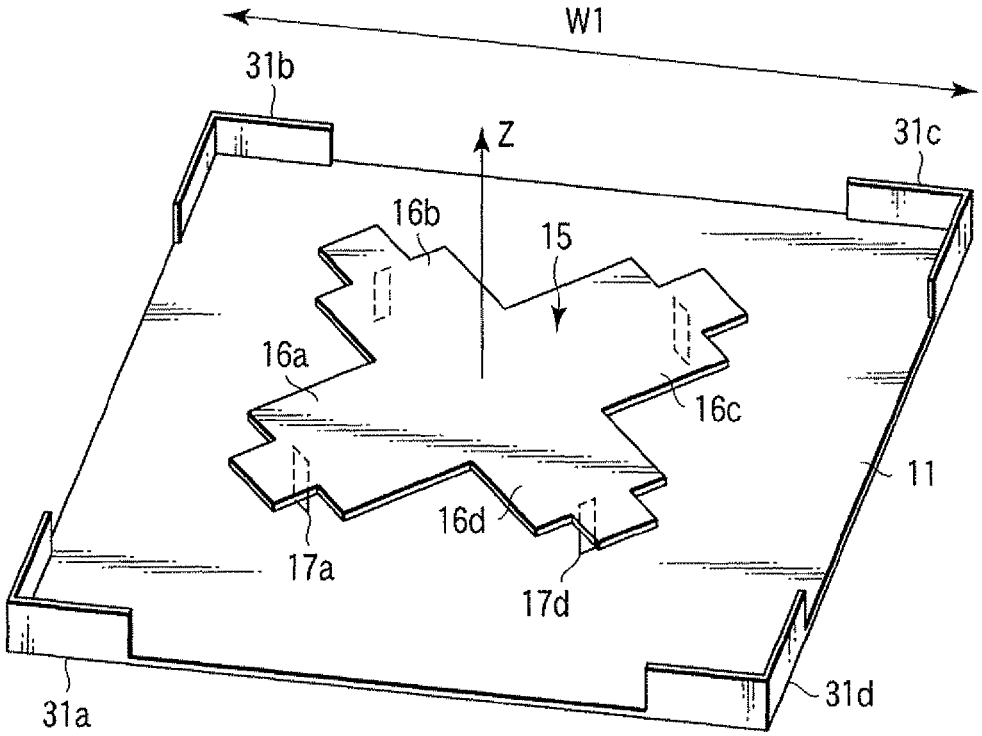
FIG. 55 is a perspective view showing a configuration example of an antenna apparatus according to a fourteenth embodiment of the present invention.
Figure 56:
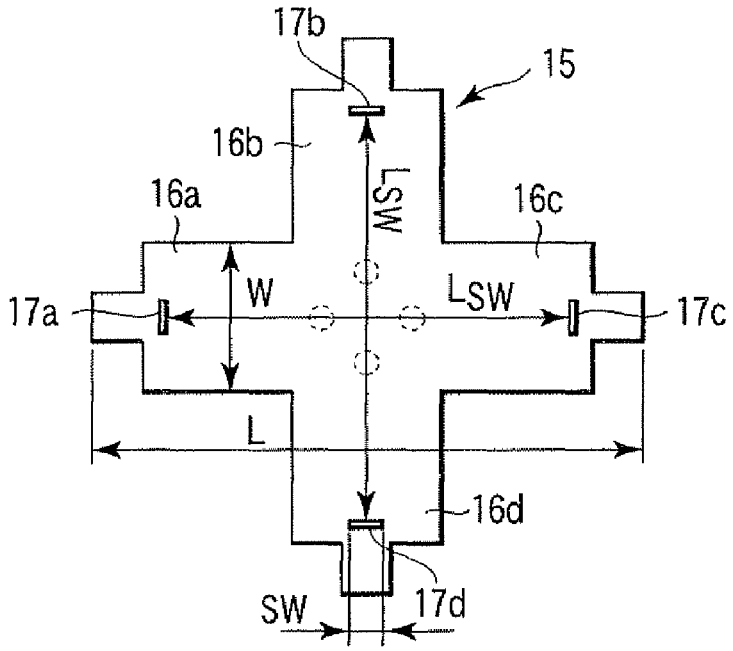
FIG. 56 is a plan view of a radiating element of the antenna apparatus according to the fourteenth embodiment.
Figure 57:
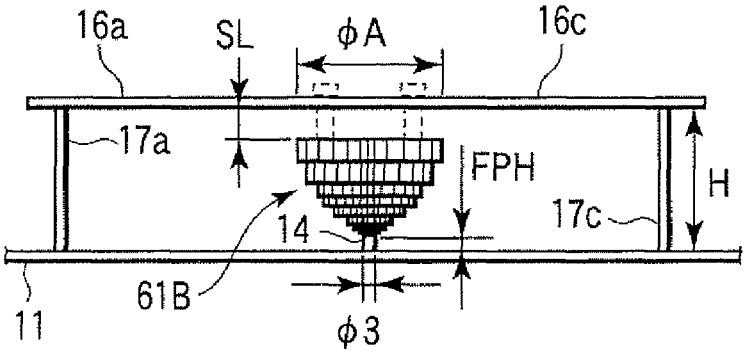
FIG. 57 is a side view of the antenna apparatus according to the fourteenth embodiment.

FIG. 55 is a perspective view of an antenna apparatus according to the fourteenth embodiment of the present invention, FIG. 56 is a plan view of an antenna element 15, and FIG. 57 is a side view of the antenna element 15. The antenna apparatus according to the fourteenth embodiment has such a configuration that the feeding path 61B shown in FIGS. 45A and 45B is capacitance-coupled with four radiating elements 16*a* to 16*d*. Incidentally, same portions as those shown in each of the embodiments are attached with same reference numerals and detailed explanation thereof is omitted.

The radiating elements 16*a* to 16*d* have such a configuration that their widths W are wider than the width W2 in the first embodiment and their end portion are formed with projecting portions. The projecting portions are formed by cutting corners at distal ends of a flat plate cross-shaped element in a form of a square. The radiating elements 16*a* to 16*d* are arranged so as to be spaced upwardly from the conductor plate 11 by a height H. The height H is set to about λ/18, for example, when the lowest frequency in the working frequency band is 470 MHz.

In the feeding path 61B, a top portion of an exponent function curve positioned on a lower side is connected to a central conductor 14 extending on an upper portion of the conductor plate 11 by soldering or the like. An upper side circular portion of the feeding path 61B and the radiating elements 16*a* to 16*d* are arranged to be spaced from each other by a distance of 0.1 H so as to perform capacitance coupling.

As a specific size example, setting is performed such that a length L between end portions (terminal ends) of the radiating elements is 315 mm, a length LSW between the short-circuiting elements is 238 mm, and a width SW of the short-circuit element is 9 mm in FIG. 56. In FIG. 57, a height H of the radiating elements 16*a* to 16*d* is set to 35 mm. The feeding path 61B is formed such that a diameter A of its upper side circular portion is 60 mm, a diameter of the central conductor 14 is 3 mm, and its height FPH is 6 mm. A distance SL between the radiating elements 16*a* to 16*d* and the upper side circular portion of the feeding path 613 is set to 3.5 mm. Incidentally, a length W1 of one side of the conductor plate 11 is set to 460 mm.

Figure 58:
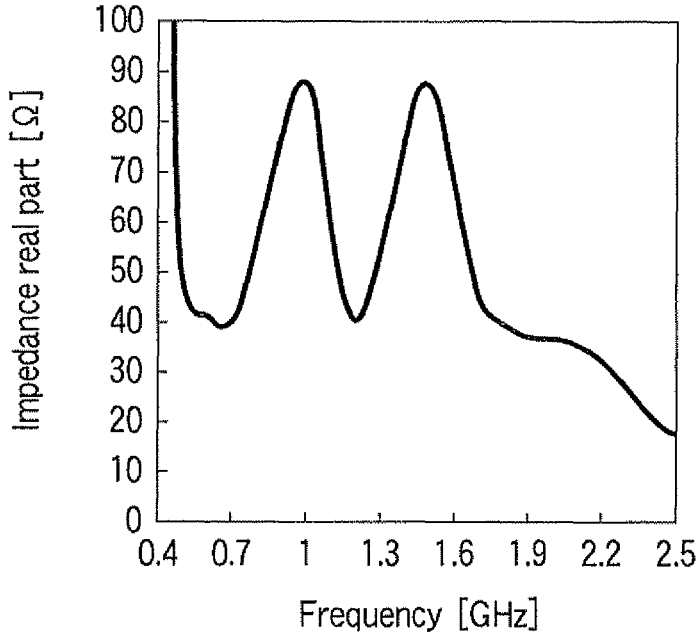
FIG. 58 is a real part impedance characteristic diagram when the radiating element and a feeding path are directly connected to each other in the antenna apparatus according to the fourteenth embodiment.
Figure 59:
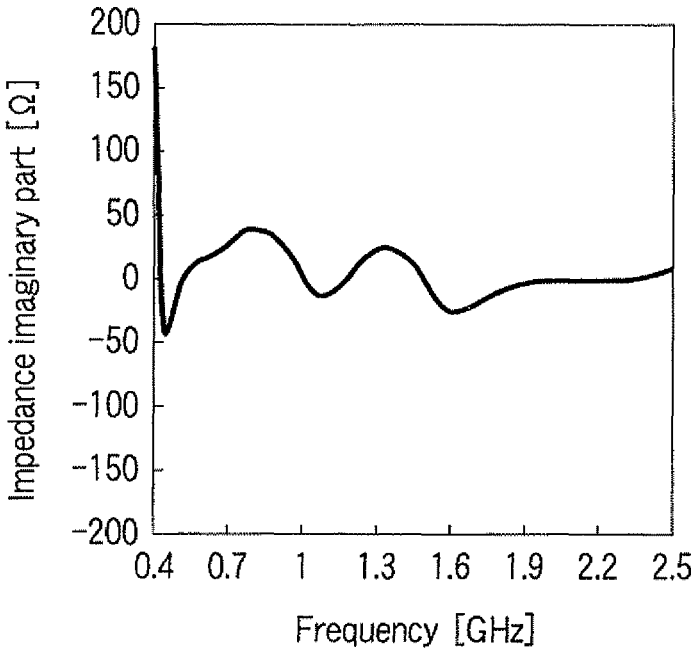
FIG. 59 is an imaginary part impedance characteristic diagram when the radiating element and the feeding path are directly connected to each other in the antenna apparatus according to the fourteenth embodiment.
Figure 60:
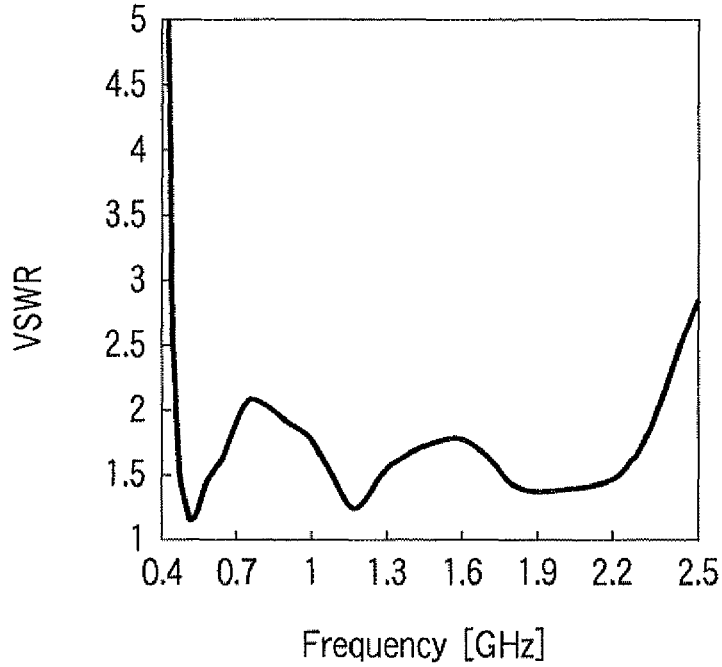
FIG. 60 is a VSWR characteristic diagram when the radiating element and the feeding path are directly connected to each other in the antenna apparatus according to the fourteenth embodiment.
Figure 61:
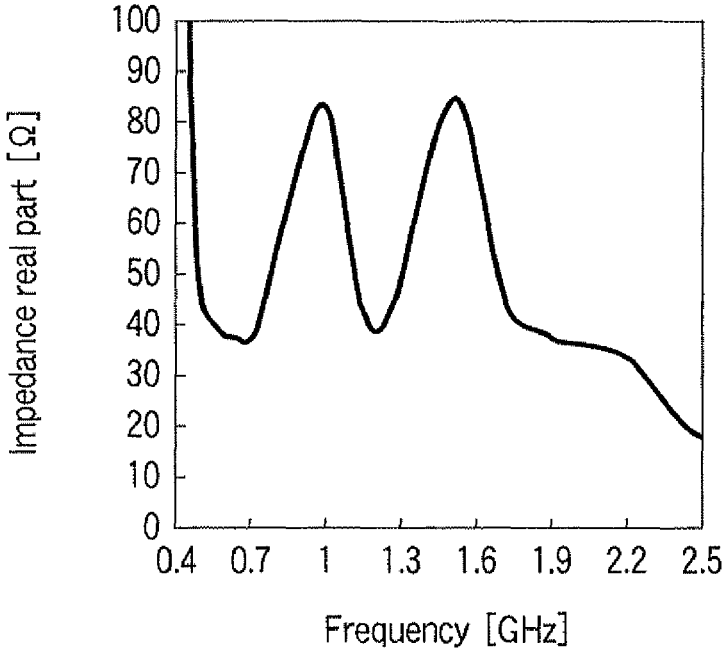
FIG. 61 is a real part impedance characteristic diagram of the antenna apparatus according to the fourteenth embodiment.
Figure 62:
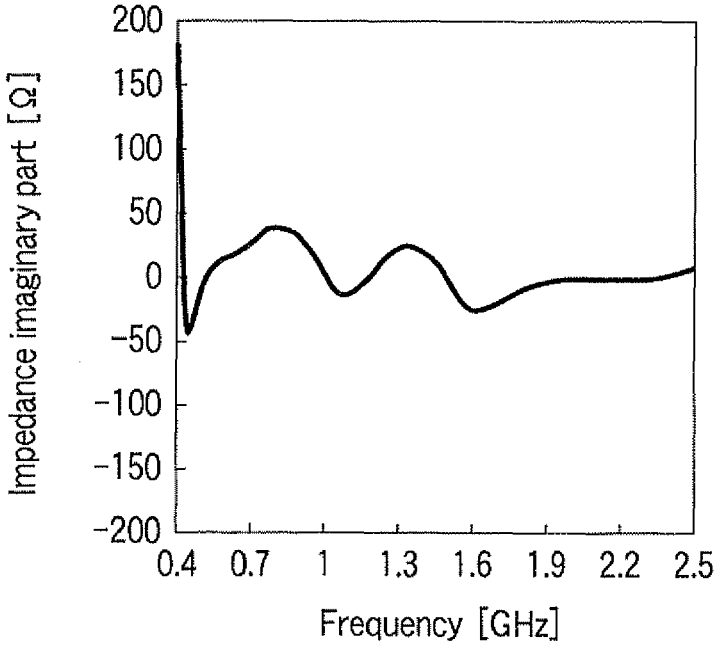
FIG. 62 is an imaginary part impedance characteristic diagram of the antenna apparatus according to the fourteenth embodiment.
Figure 63:
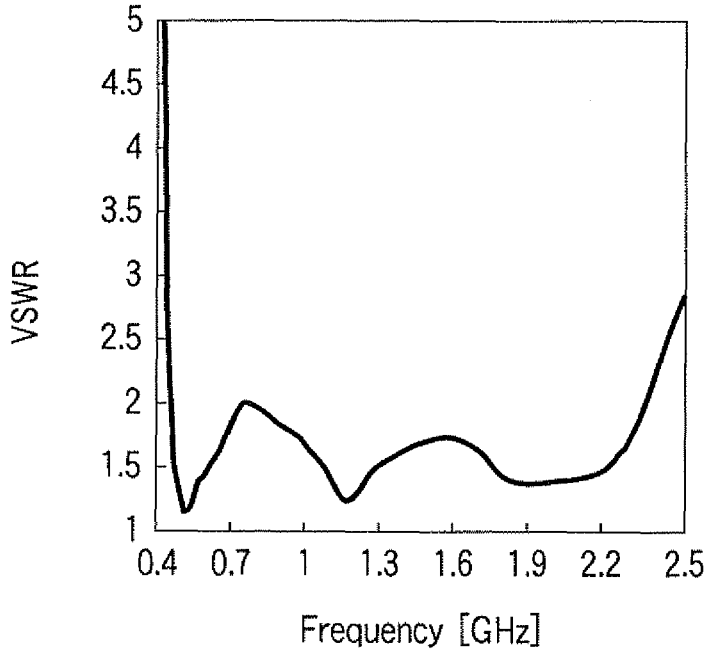
FIG. 63 is a VSWR characteristic diagram of the antenna apparatus according to the fourteenth embodiment.

As shown in FIG. 55, the conductor plate 11 is formed with matching plates 31*a* to 31*d*. The matching plates 31*a* to 31*d* are provided on straight extension lines connecting a central portion of the radiating elements 16*a* to 16*d* and short-circuiting portions. For example, the matching plates 31*a* to 31*d* are formed by expanding four corners (namely, portions positioned on extension lines of the radiating elements 16*a* to 16*d*) of the conductor plate 11 to be larger than the other portions thereof and bending the expanded portions upwardly by about 90°. A length of one side of the matching plates 31*a* to 31*d* is set to about 15±5% of the length of the conductor plate 11. As a specific size example, formation is made such that the length of one side of the matching plates 31*a* to 31*d* is 70 mm and a height thereof is 28 mm Here, characteristics in the antenna apparatus according to the fourteenth embodiment and in a case that the feeding path 61B is directly connected to the radiating elements 16*a* to 16*d* are compared with each other. FIG. 58 is a real part impedance characteristic diagram obtained when the radiating elements and the feeding path are directly connected to each other in the antenna apparatus according to the fourteenth embodiment, FIG. 59 is an imaginary part impedance characteristic diagram obtained at that time, and FIG. 60 is a VSWR characteristic diagram obtained at that time. FIG. 61 is a real part impedance characteristic diagram in the antenna apparatus according to the fourteenth embodiment, FIG. 62 is an imaginary part impedance diagram therein, and FIG. 63 is a VSWR characteristic diagram therein.

From comparison between FIGS. 58 and 59 and FIGS. 61 and 62, it is understood that local deterioration in a case of capacitance coupling is suppressed as compared with a case of direct connection so that further excellent impedance characteristic is obtained in the case of capacitance coupling. According to FIG. 60, a frequency band where the VSWR value exceeds 2 is present in the case of direct connection due to local deterioration of the impedance characteristic. On the other hand, in the case of capacitance coupling, since local deterioration is suppressed, as described above, VSWR≦2 is obtained in a range from 450 MHz to 2.3 GHz, as apparent from FIG. 63, so that further excellent result can be obtained.

In the fourteenth embodiment, the feeding path 61B and the radiating elements 16*a* to 16*d* are connected to each other utilizing a capacitance coupling system. By adopting such a configuration, the number of setting parameters is increased as compared with the case of direct connection, so that further wide bandwidth can be realized. Assembling and configuration can be performed easily according to realization of the capacitance coupling system.

Incidentally, as shown by a broken line in FIG. 56 and FIG. 57, a portion such as a portion on the circumference of the upper portion circular portion of the feeding path 61B or a central portion thereof may be directly connected to the feeding portion 18*c* by a bolt or the like. By adopting such a configuration, while improvement of the characteristic according to capacitance coupling is achieved, earthquake protection of the feeding path 61B can be improved.

Fifteenth Embodiment

Next, an antenna apparatus according to a fifteenth embodiment of the present invention will be explained.

Figure 64:
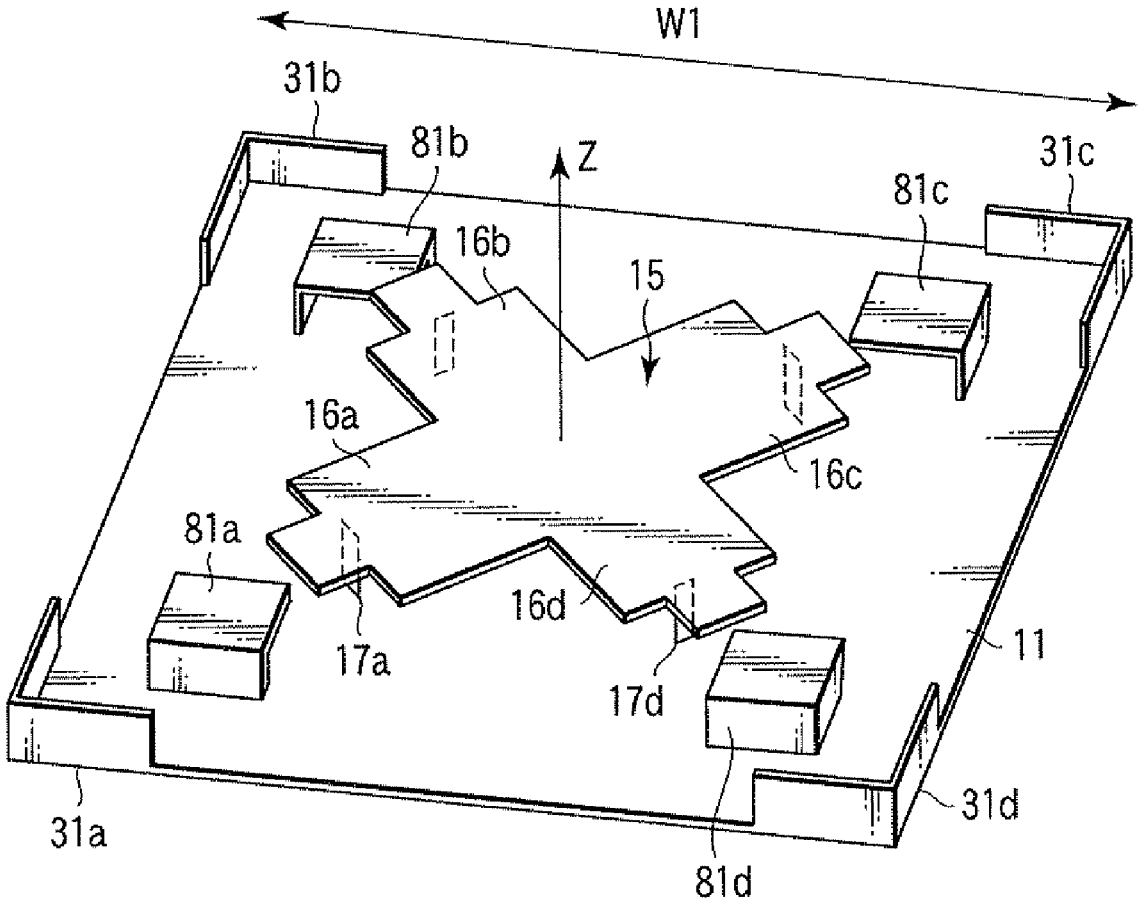
FIG. 64 is a perspective view showing a configuration of an antenna apparatus according to a fifteenth embodiment of the present invention.

FIG. 64 is a perspective view of an antenna apparatus according to the fifteenth embodiment of the present invention. The antenna apparatus according to the fifteenth embodiment has such a configuration that one side of a conductor plate 11 is reduced and matching plates 81*a* to 81*d* are further provided near short-circuiting elements 17*a* to 17*d* in the antenna apparatus according to the fourteenth embodiment. Since the other configuration is similar to that shown in the fourteenth embodiment, same portions are attached with same reference numerals and detailed explanation thereof is omitted.

As shown in FIG. 64, the matching plates 81*a* to 81*d* are provided between the matching plates 31*a* to 31*d* and the short-circuiting elements 17*a* to 17*d*, where the matching plates 81*a* to 81*d* each have a shape where a square member is attached on an upper. The matching plates 81*a* to 81*d* are formed by bending members different from the conductor plate 11 and they are attached on the conductor plate 11 so as to be spaced from the short-circuiting elements 17*a* to 17*d* by a predetermined distance. As a specific size example, formation is made such that a length of one side of the matching plates 81*a* to 81*d* is 50 mm and a height thereof is 28 mm. A length W1 of one side of the conductor plate 11 is set to 410 mm (410 mm×410 mm).

Figure 65:
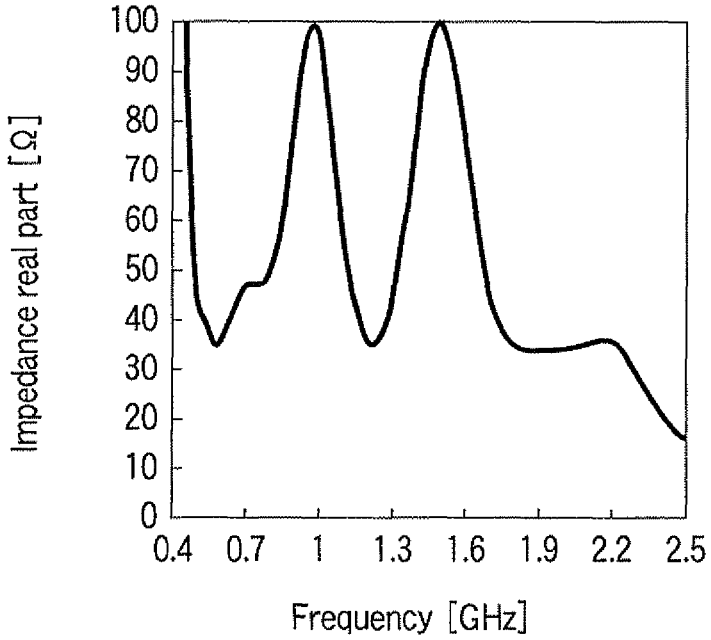
FIG. 65 is a real part impedance characteristic diagram when a conductor plate is set to 410 mm and direct connection is performed in the antenna apparatus according to the fourteenth embodiment.
Figure 66:
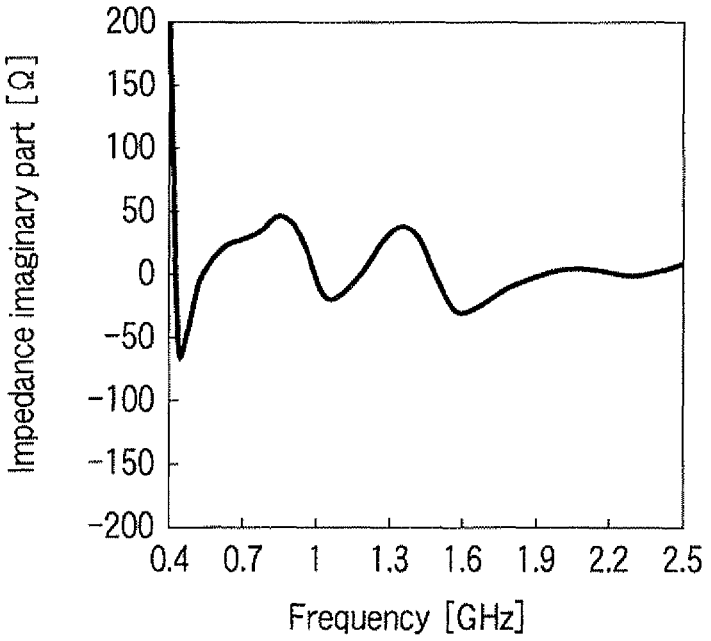
FIG. 66 is an imaginary part impedance characteristic diagram when the conductor plate is set to 410 mm and direct connection is performed in the antenna apparatus according to the fourteenth embodiment.
Figure 67:
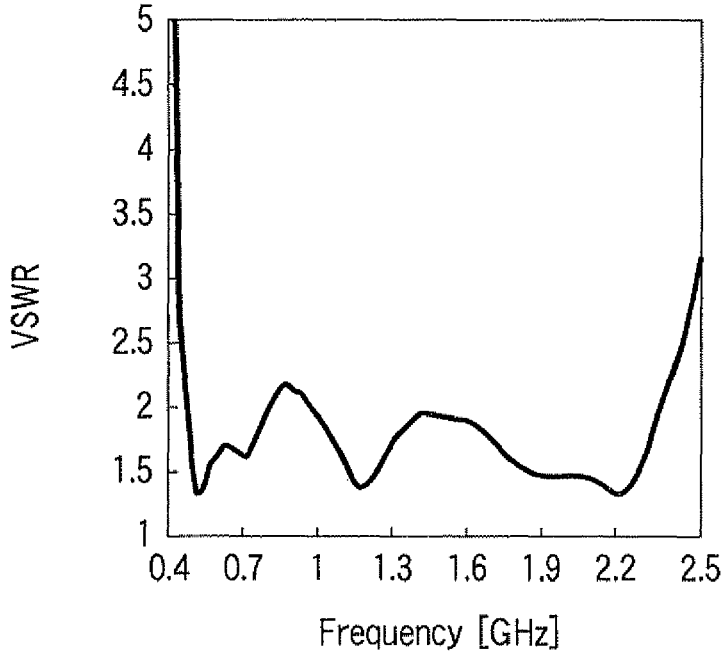
FIG. 67 is a VSWR characteristic diagram when the conductor plate is set to 410 mm and direct connection is performed in the antenna apparatus according to the fourteenth embodiment.

FIG. 65 is a real part impedance characteristic diagram obtained when the feeding path 61B and the radiating elements 16*a* to 16*d* are directly connected to each other, where the matching plates 81*a* to 81*d* are not provided. FIG. 66 is an imaginary part impedance characteristic diagram in this case and FIG. 67 is a VSWR characteristic diagram in this case.

Figure 68:
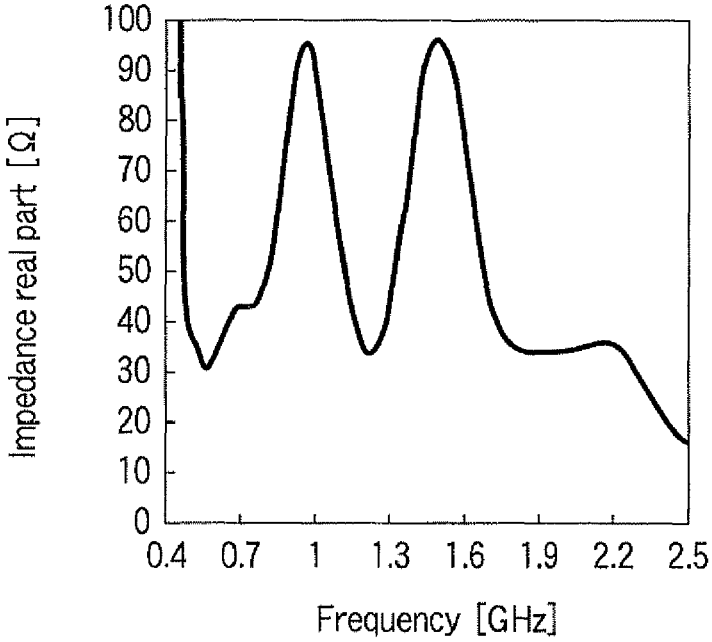
FIG. 68 is a real part impedance characteristic diagram when the conductor plate is set to 410 mm and capacitance coupling is performed in the antenna apparatus according to the fourteenth embodiment.
Figure 69:
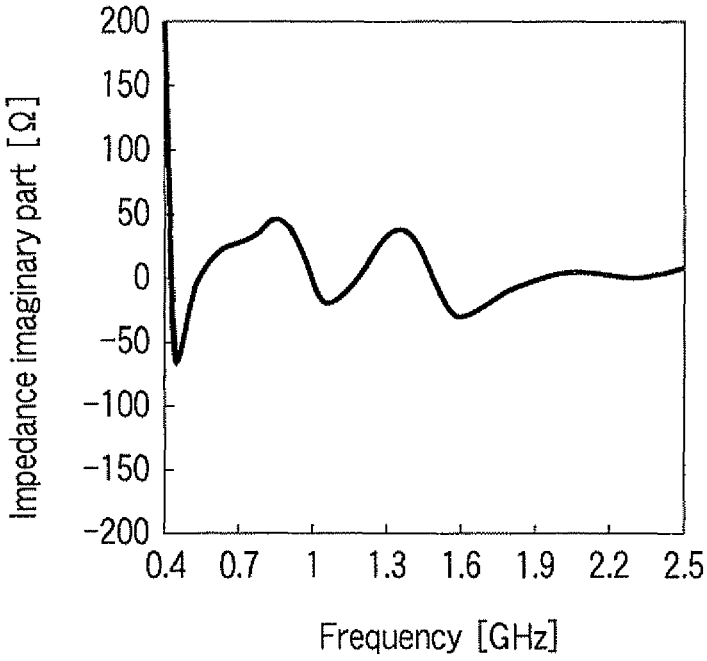
FIG. 69 is an imaginary part impedance characteristic diagram when the conductor plate is set to 410 mm and capacitance coupling is performed in the antenna apparatus according to the fourteenth embodiment.
Figure 70:
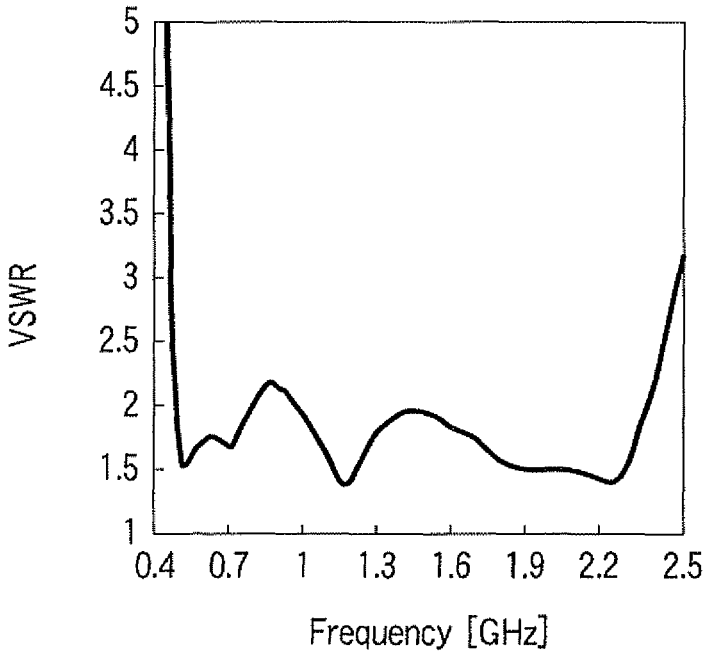
FIG. 70 is a VSWR characteristic diagram when the conductor plate is set to 410 mm and capacitance coupling is performed in the antenna apparatus according to the fourteenth embodiment.

FIG. 68 is a real part impedance characteristic diagram obtained when the feeding path 61B and the radiating elements 16*a* to 16*d* are capacitance-coupled with each other and the matching plates 81*a* to 81*d* are not provided. FIG. 69 is an imaginary part impedance characteristic diagram in this case and FIG. 70 is a VSWR characteristic diagram in this case.

In comparison between FIGS. 65 to 70 and FIGS. 58 to 63, since the length of one side of the conductor 11 is changed from 460 mm to 410 mm, mismatching occurs in impedance matching in each of the direct connection and the capacitance coupling, so that VSWR>2 occurs in a range from about 800 MHz to about 1 GHz, which results in deterioration of the characteristic.

Figure 71:
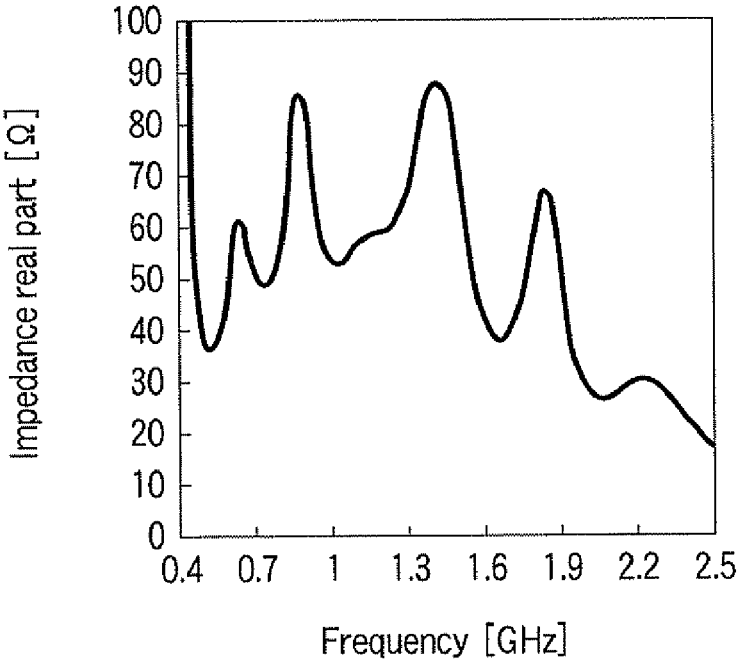
FIG. 71 is a real part impedance characteristic diagram when direct connection is performed in an antenna apparatus according to a fifteenth embodiment.
Figure 72:
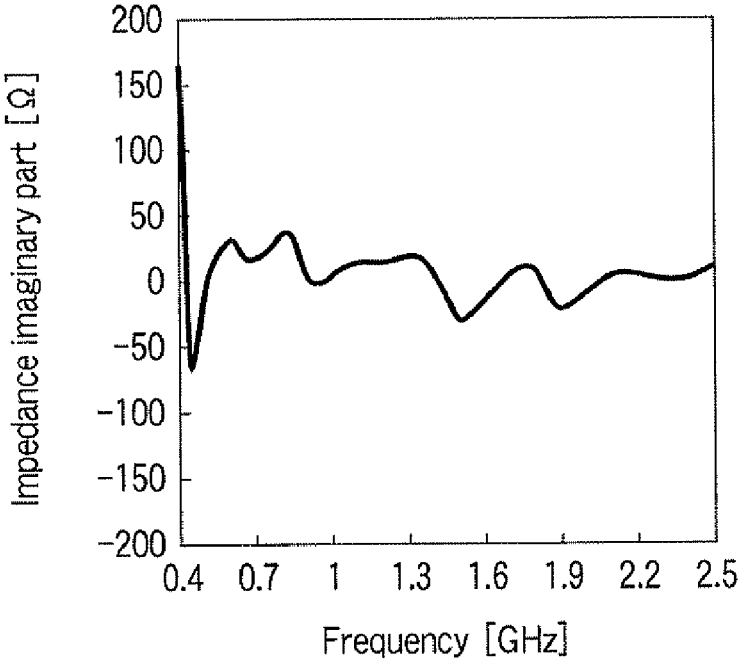
FIG. 72 is an imaginary part impedance characteristic diagram when direct connection is performed in the antenna apparatus according to the fifteenth embodiment.
Figure 73:
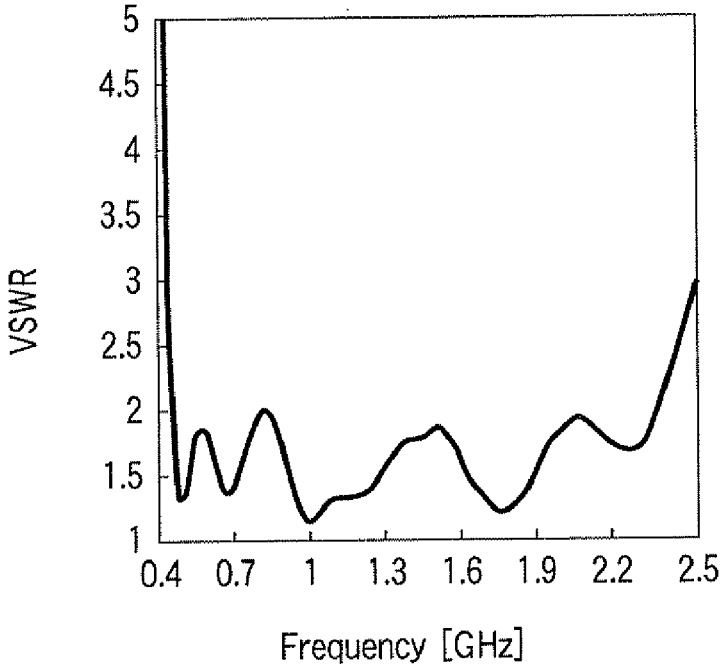
FIG. 73 is a VSWR characteristic diagram when direct connection is performed in the antenna apparatus according to the fifteenth embodiment.

FIG. 71 is a real part impedance characteristic diagram obtained when the feeding path 61B and the radiating elements 16*a* to 16*d* are directly connected to each other and the matching plates 81*a* to 81*d* are provided. FIG. 72 is an imaginary part impedance characteristic diagram in this case and FIG. 73 is a VSWR characteristic diagram in this case.

Figure 74:
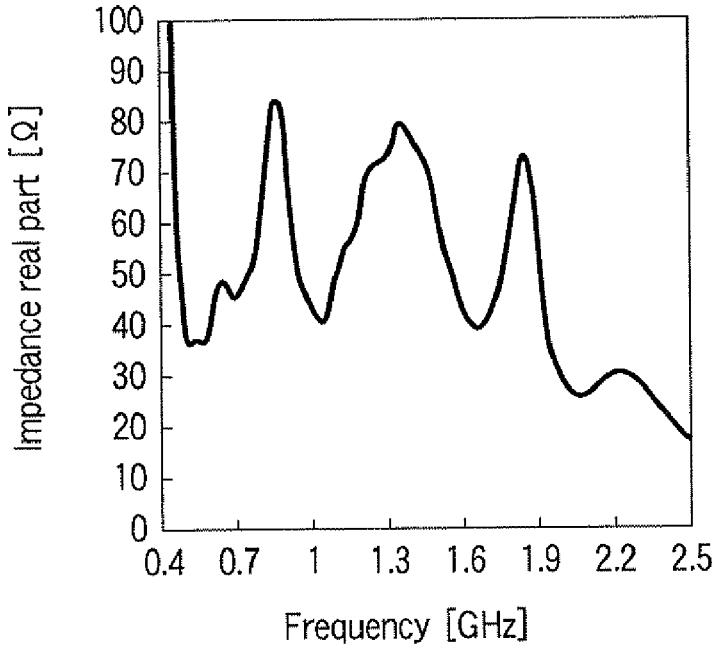
FIG. 74 is a real part impedance characteristic diagram when capacitance coupling is performed in the antenna apparatus according to the fifteenth embodiment.
Figure 75:
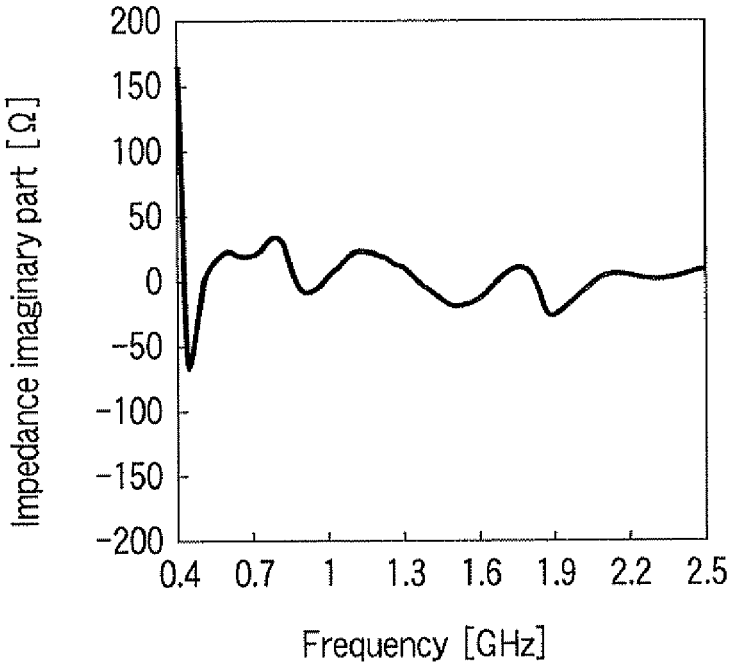
FIG. 75 is an imaginary part impedance characteristic diagram when capacitance coupling is performed in the antenna apparatus according to the fifteenth embodiment.
Figure 76:
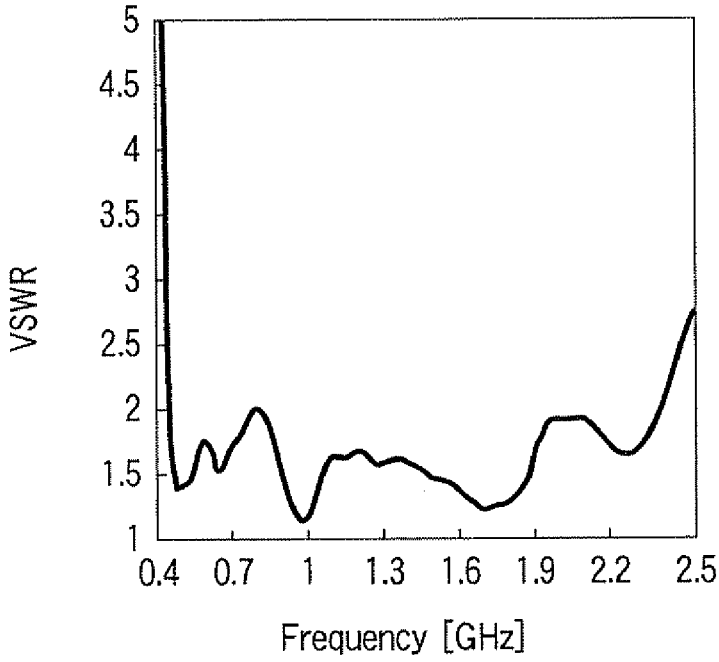
FIG. 76 is a VSWR characteristic diagram when capacitance coupling is performed in the antenna apparatus according to the fifteenth embodiment.

FIG. 74 is a real part impedance characteristic diagram obtained when the feeding path 61B and the radiating elements 16*a* to 16*d* are capacitance-coupled with each other and the matching plates 81*a* to 81*d* are provided. FIG. 75 is an imaginary part impedance characteristic diagram in this case and FIG. 76 is a VSWR characteristic diagram in this case.

In comparison between FIGS. 71 to 76 and FIGS. 58 to 63, impedance matching approximately equivalent to the case that the length of one side of the conductor plate 11 is set to 460 mm is obtained and VSWR≦2 is obtained in a range from 450 MHz to 2.3 GHz, so that an excellent result is obtained over a wide bandwidth. Thereby, even if the length of one side of the conductor plate 11 is reduced from 460 mm to 410 mm, a desired characteristic can be obtained over a wide bandwidth in each of the direct connection and the capacitance coupling by attachment of the matching plates 81*a* to 81*d*. Accordingly, while a desired characteristic is maintained, an antenna apparatus can be reduced in size by attaching the matching plates 81*a* to 81*d* in addition to the matching plates 31*a* to 31*d*.

Sixteenth Embodiment

Next, an antenna apparatus according to a sixteenth embodiment of the present invention will be explained.

Figure 77:
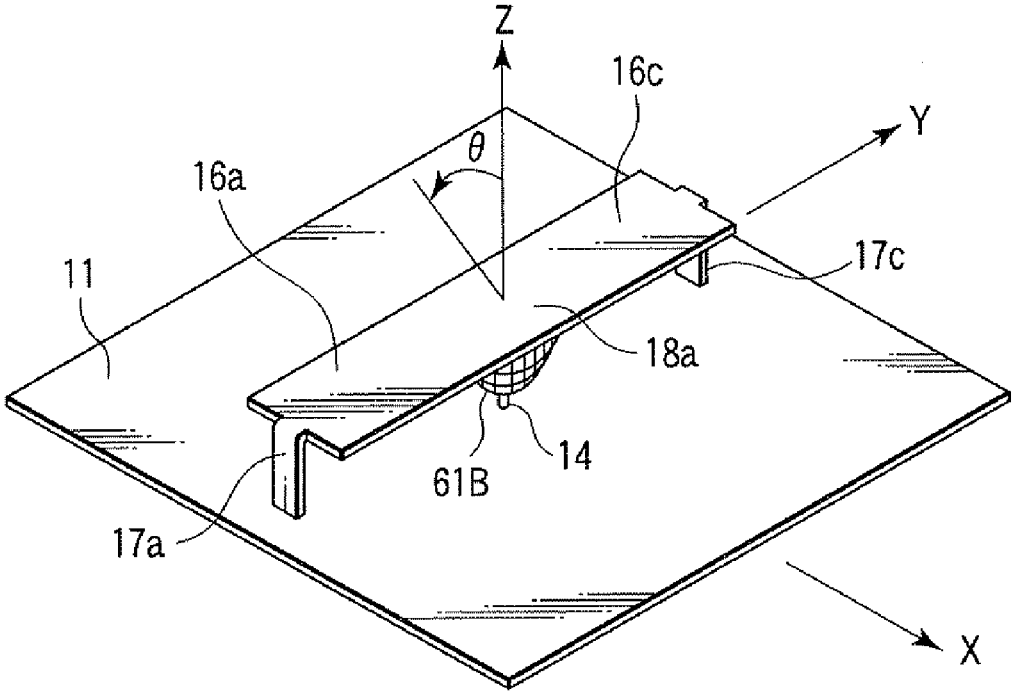
FIG. 77 is a perspective view showing a configuration of an antenna apparatus according to a sixteenth embodiment of the present invention.
Figure 78:
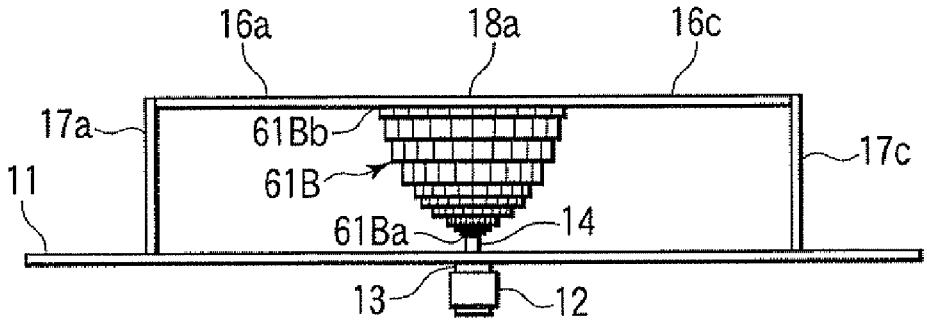
FIG. 78 is a side view of the antenna apparatus according to the sixteenth embodiment.

FIG. 77 is a perspective view of an antenna apparatus according to the sixteenth embodiment of the present invention and FIG. 78 is a side view of the antenna apparatus. The antenna apparatus according to the sixteenth embodiment has such a configuration that two radiating elements are arranged in a straight line, for example, two radiating elements 16*a* and 16*c* of four radiating elements 16*a* to 16*d* positioned on a straight line are used and the feeding path 61B shown in FIGS. 45A and 45B is used instead of the feeding path 61 in the antenna apparatus according to the sixth embodiment. Incidentally, in the sixteenth embodiment, the radiating elements 16*a* and 16*c* are arranged on sides of the conductor plate 11 in parallel with each other. Since the other configuration is the same as that of the sixth embodiment, the same portions are attached with same reference numerals and detailed explanation thereof is omitted.

By arranging two radiating elements 16*a* and 16*c* in a straight line, as described above, directionality of a coordinate axis Z-X plane perpendicular to the radiating elements 16*a* and 16*c* can be made intense while directionality of a coordinate axis Z-Y plane is made weak. Therefore, by installing the antenna apparatus in a narrow communication area such as, for example, a tunnel, radiation of wasteful radio wave in a short-length direction can be reduced so that radio wave can be radiated in a longitudinal direction efficiently.

Figure 79:
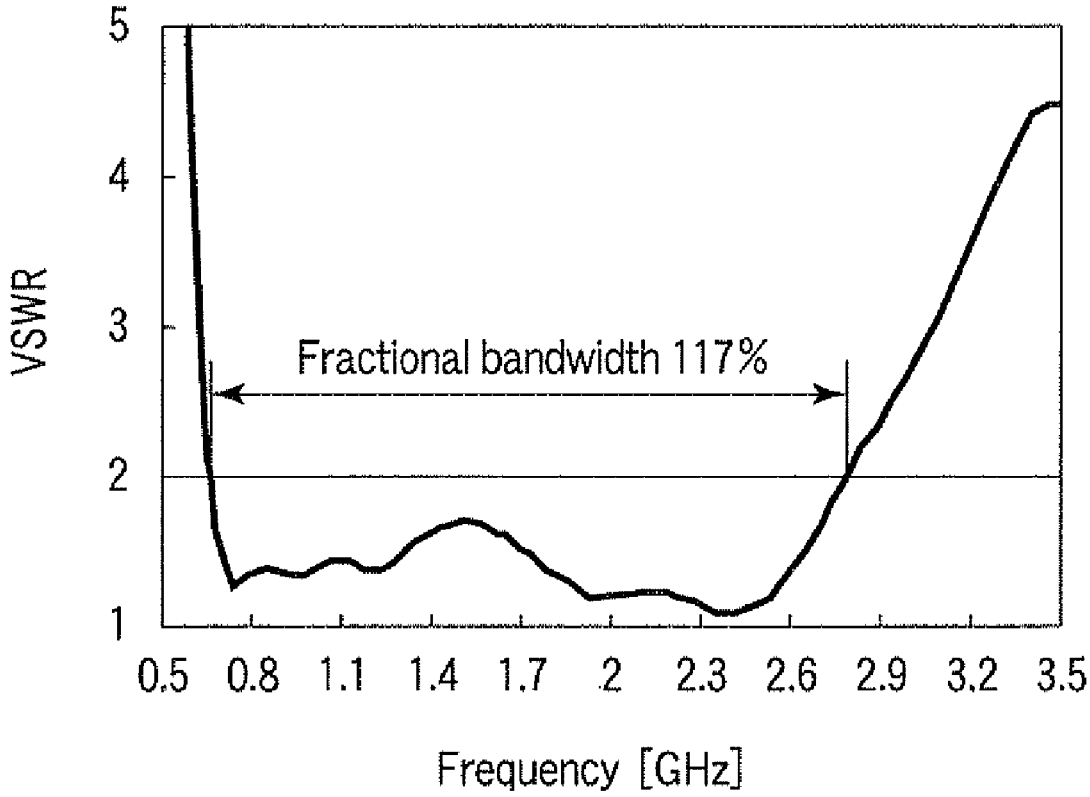
FIG. 79 is a VSWR characteristic diagram of the antenna apparatus according to the sixteenth embodiment.

FIG. 79 is a VSWR characteristic diagram of the antenna apparatus according to the sixteenth embodiment, where a horizontal axis takes frequency [GHz] and a vertical axis takes VSWR. Regarding the VSWR characteristic, VSWR≦2 is obtained in a range of a wideband from 650 to 2750 MHz, so that a fractional bandwidth of about 117% can be obtained.

Figure 80:
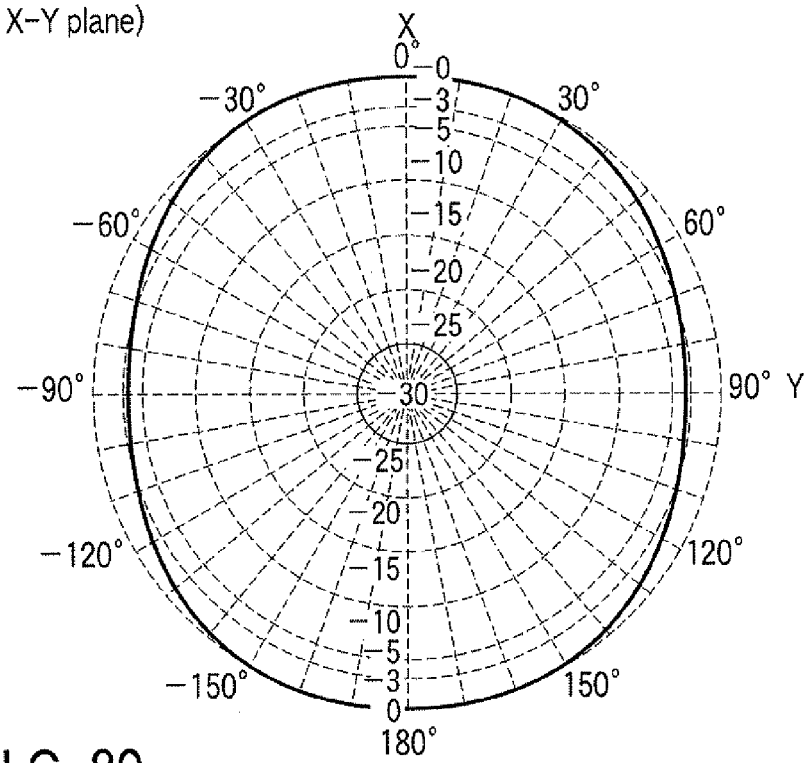
FIG. 80 is a diagram showing vertically-polarized horizontal plane directionality (coordinate axis θ=45° X-Y plane in FIG. 17) of the antenna apparatus according to the sixteenth embodiment of the present invention at a frequency of 0.7 GHz.

FIG. 80 shows a vertically-polarized horizontal plane directionality (a coordinate axis θ=45° X-Y plane in FIG. 77) of the antenna apparatus according to the sixteenth embodiment at a frequency of 0.7 GHz, where directionality deflection of an X-axis direction and a Y-axis direction forms a cocoon-shaped directionality of about 3 dB.

Figure 81:
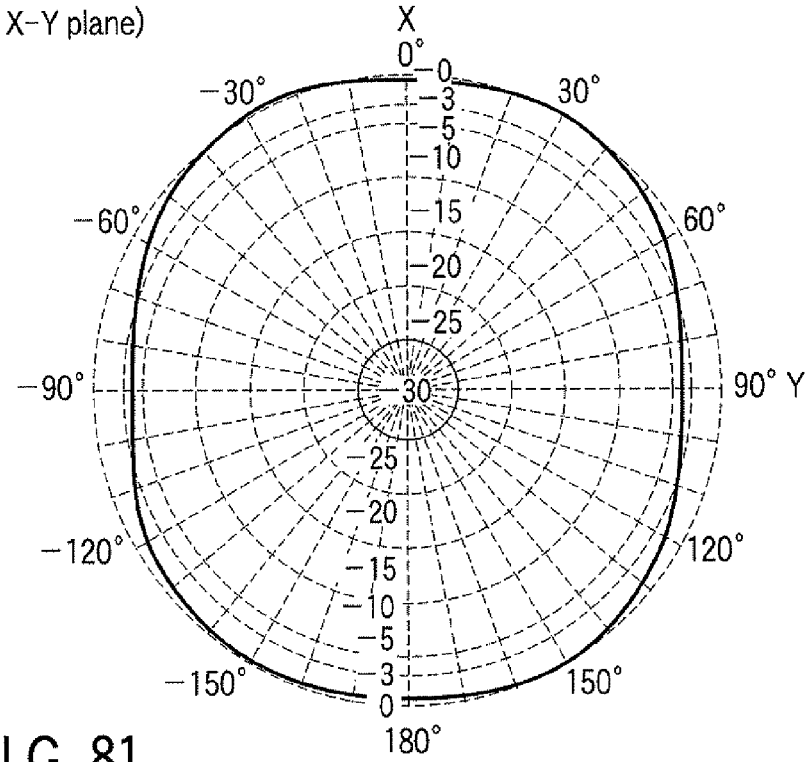
FIG. 81 is a diagram showing vertically-polarized horizontal plane directionality (coordinate axis θ=45° X-Y plane in FIG. 17) of the antenna apparatus according to the sixteenth embodiment of the present invention at a frequency of 1.7 GHz.

FIG. 81 shows a vertically-polarized horizontal plane directionality (a coordinate axis θ=45° X-Y plane in FIG. 77) of the antenna apparatus according to the sixteenth embodiment at a frequency of 1.7 GHz, where directionality deflection of an X-axis direction and a Y-axis direction forms a cocoon-shaped directionality of about 4 dB.

Figure 82:
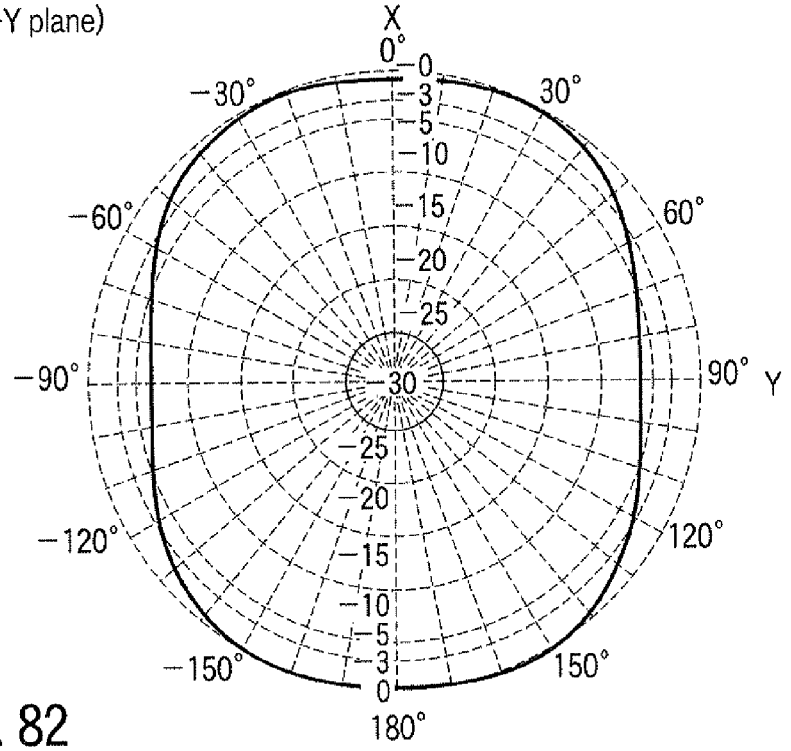
FIG. 82 is a diagram showing vertically-polarized horizontal plane directionality (coordinate axis θ=45° X-Y plane in FIG. 17) of the antenna apparatus according to the sixteenth embodiment of the present invention at a frequency of 2.7 GHz.

FIG. 82 shows a vertically-polarized horizontal plane directionality (a coordinate axis θ=45° X-Y plane in FIG. 77) of the antenna apparatus according to the sixteenth embodiment at a frequency of 2.7 GHz, where directionality deflection of an X-axis direction and a Y-axis direction forms a cocoon-shaped directionality of about 6 dB.

The reason why the maximum radiation angle is set in a direction of the abovementioned θ=45° is, for example, when an antenna is installed on a ceiling of a tunnel having a height higher than an underground mall or the like, if the maximum radiation angle is set to a horizontal (90°) direction, level at a tunnel upper portion is intense but the level is weak at a lower portion so that a communication region cannot be secured.

Figure 83:
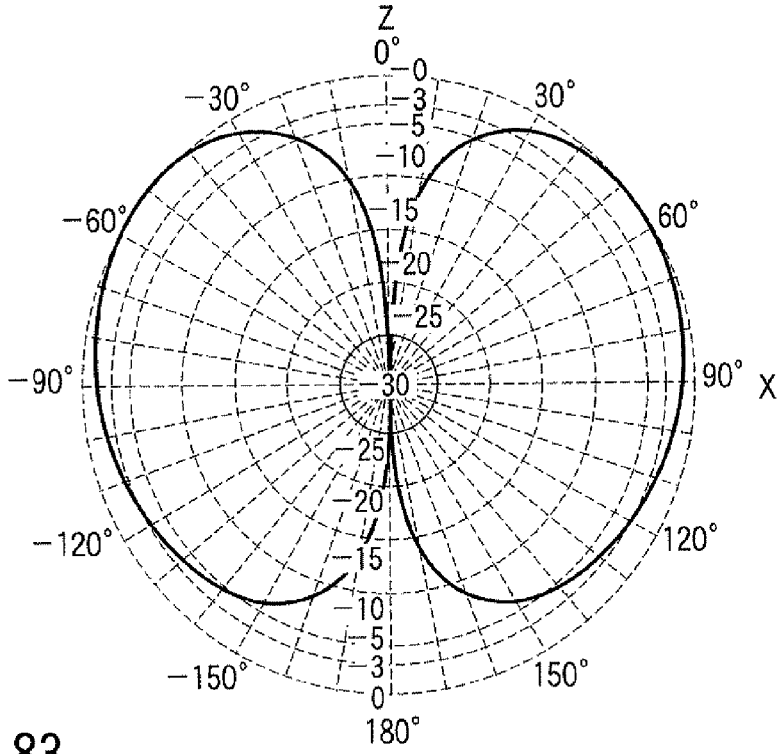
FIG. 83 is a diagram showing vertically-polarized vertical plane directionality (coordinate axis Z-X plane in FIG. 17) of the antenna apparatus according to the sixteenth embodiment of the present invention at a frequency of 0.7 GHz.

FIG. 83 is a diagram showing vertically-polarized vertical plane directionality (a coordinate axis Z-X plane in FIG. 77) of the antenna apparatus according to the sixteenth embodiment at a frequency of 0.7 GHz.

Figure 84:
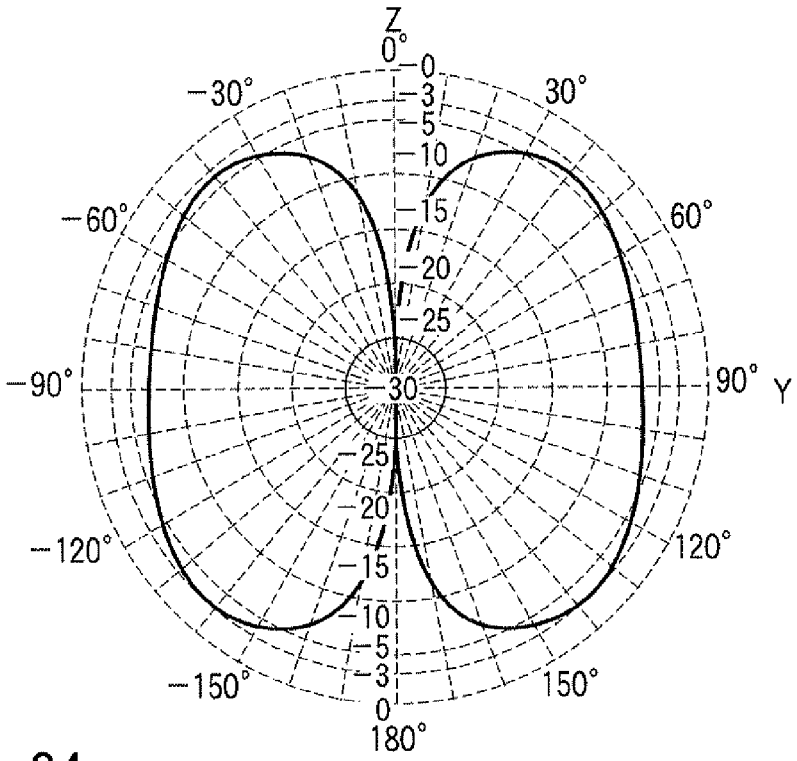
FIG. 84 is a diagram showing vertically-polarized vertical plane directionality (coordinate axis Z-Y plane in FIG. 17) of the antenna apparatus according to the sixteenth embodiment of the present invention at a frequency of 0.7 GHz.

FIG. 84 is a diagram showing vertically-polarized vertical plane directionality (a coordinate axis Z-Y plane in FIG. 77) of the antenna apparatus according to the sixteenth embodiment at a frequency of 0.7 GHz.

Figure 85:
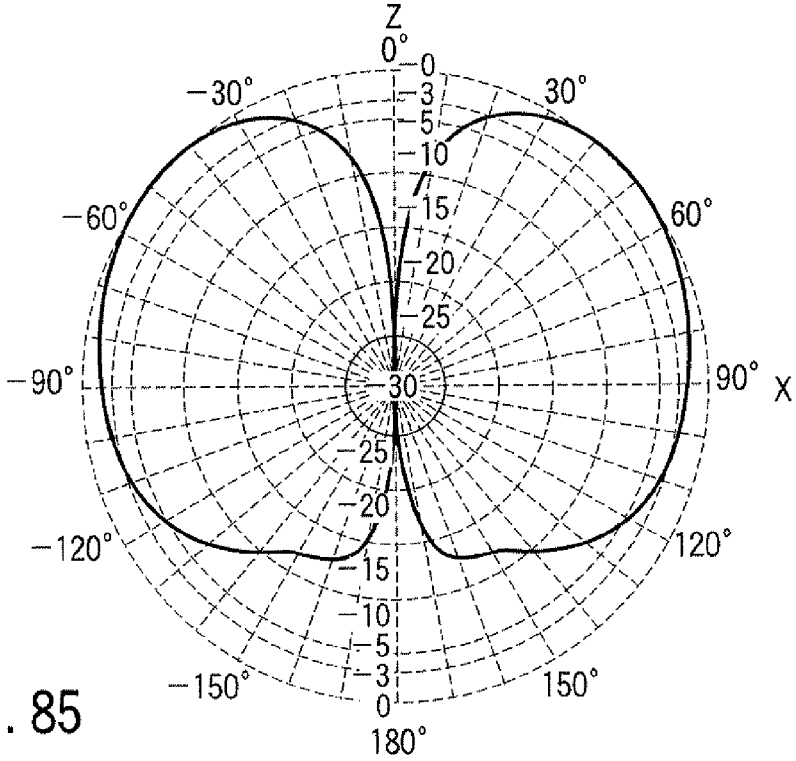
FIG. 85 is a diagram showing vertically-polarized vertical plane directionality (coordinate axis Z-X plane in FIG. 17) of the antenna apparatus according to the sixteenth embodiment of the present invention at a frequency of 1.7 GHz.

FIG. 85 is a diagram showing vertically-polarized vertical plane directionality (a coordinate axis Z-X plane in FIG. 77) of the antenna apparatus according to the sixteenth embodiment at a frequency of 1.7 GHz.

Figure 86:
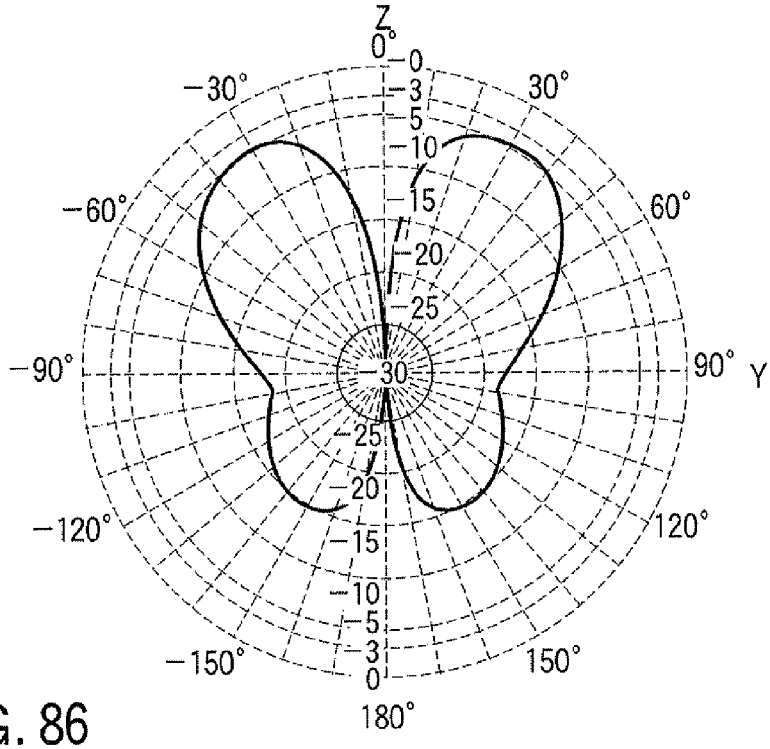
FIG. 86 is a diagram showing vertically-polarized vertical plane directionality (coordinate axis Z-Y plane in FIG. 17) of the antenna apparatus according to the sixteenth embodiment of the present invention at a frequency of 1.7 GHz.

FIG. 86 is a diagram showing vertically-polarized vertical plane directionality (a coordinate axis Z-Y plane in FIG. 77) of the antenna apparatus according to the sixteenth embodiment at a frequency of 1.7 GHz.

Figure 87:
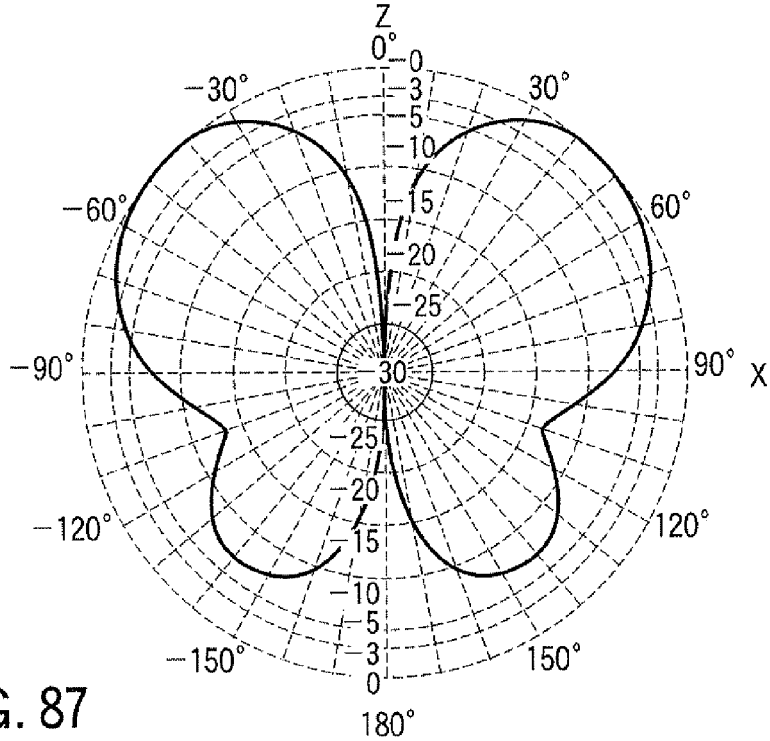
FIG. 87 is a diagram showing vertically-polarized vertical plane directionality (coordinate axis Z-X plane in FIG. 17) of the antenna apparatus according to the sixteenth embodiment of the present invention at a frequency of 2.7 GHz.

FIG. 87 is a diagram showing vertically-polarized vertical plane directionality (a coordinate axis Z-X plane in FIG. 77) of the antenna apparatus according to the sixteenth embodiment at a frequency of 2.7 GHz.

Figure 88:
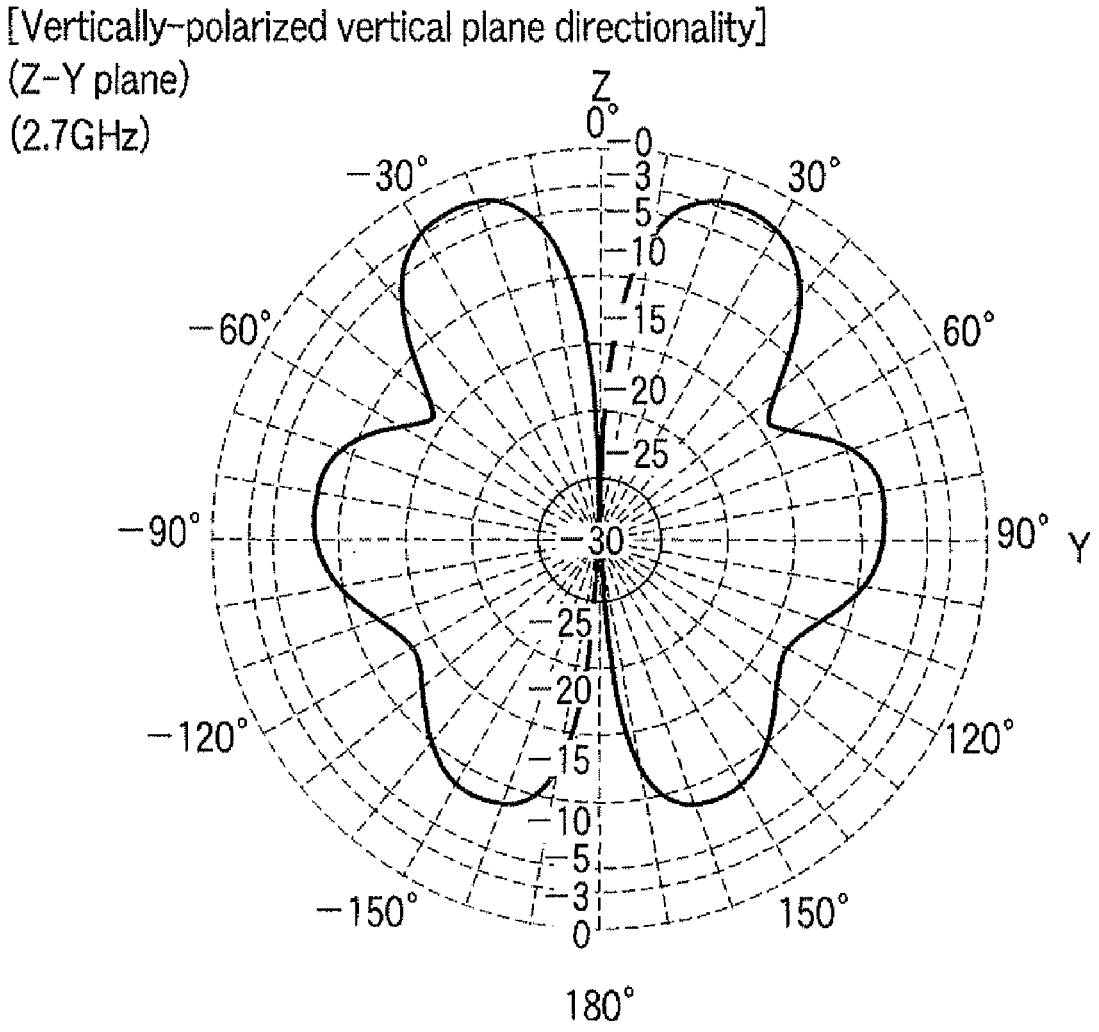
FIG. 88 is a diagram showing vertically-polarized vertical plane directionality (coordinate axis Z-Y plane in FIG. 17) of the antenna apparatus according to the sixteenth embodiment of the present invention at a frequency of 2.7 GHz.

FIG. 88 is a diagram showing vertically-polarized vertical plane directionality (a coordinate axis Z-Y plane in FIG. 77) of the antenna apparatus according to the sixteenth embodiment at a frequency of 2.7 GHz.

The abovementioned FIG. 83 to FIG. 88 show directionalities of the coordinate axis Z-X plane and the coordinate axis Z-Y plane of the antenna apparatus shown in the abovementioned FIG. 77, where the maximum radiation angle of the coordinate axis Z-X plane where the level is intense becomes θ=45° at each frequency. This is because, in an antenna with a conductor plate, the conductor plate serves as a reflecting plate so that beam is jumped up.

Accordingly, when the abovementioned antenna apparatus is installed, for example, in a tunnel, if installation is made such that the coordinate axis Z-X plane where the level is high coincides with a longitudinal direction in the tunnel, while the coordinate axis Z-Y plane where the level is low coincides with a short direction in the tunnel, excellent communication can be performed even in a communication area where a ceiling is high and elongated.

Seventeenth Embodiment

Next, an antenna apparatus according to a seventeenth embodiment of the present invention will be explained.

Figure 89A:
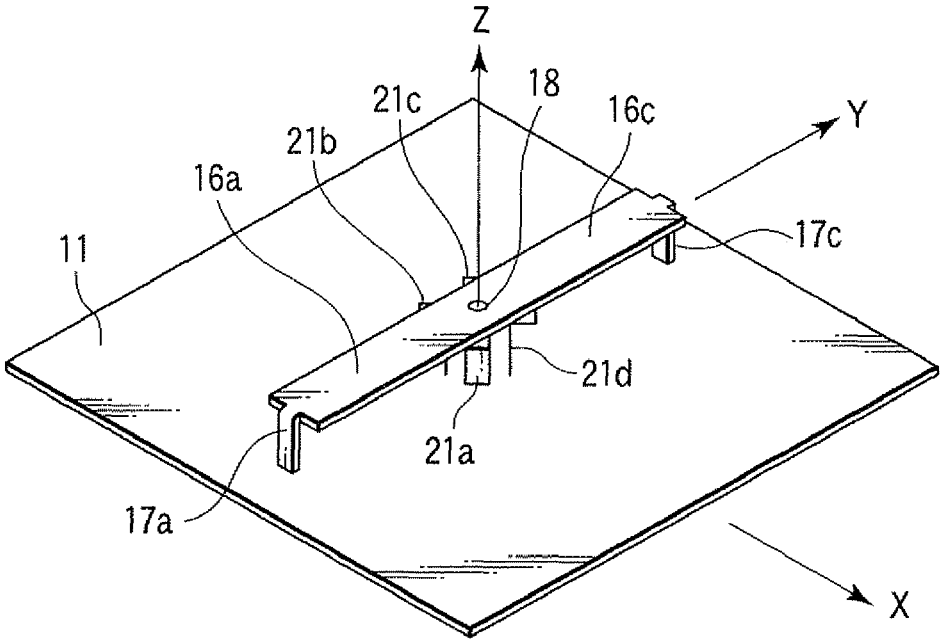
FIG. 89A is a perspective view showing a configuration of an antenna apparatus according to a seventeenth embodiment of the present invention.
Figure 89B:
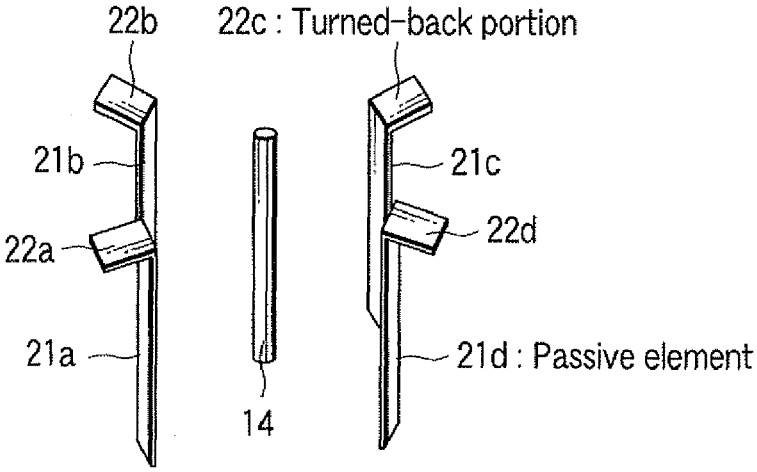
FIG. 89B is a perspective view showing an arrangement configuration of a passive element portion of the antenna apparatus according to the seventeenth embodiment.
Figure 90:
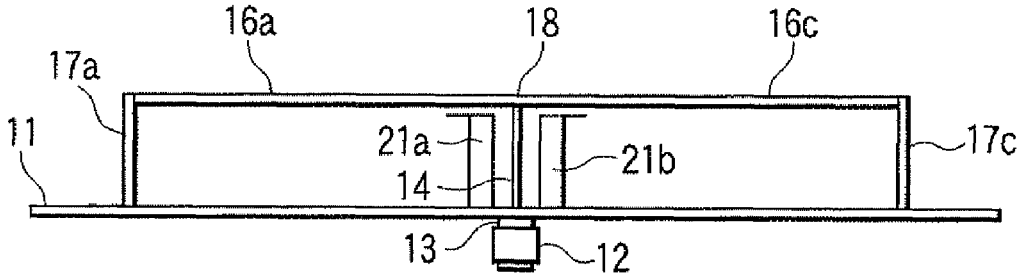
FIG. 90 is a side view of the antenna apparatus according to the seventeenth embodiment.
Figure 91A:
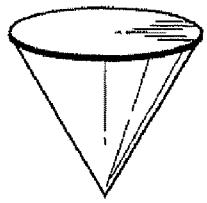
FIG. 91A is a perspective view showing a shape example of a feeding path in the present invention.
Figure 91B:
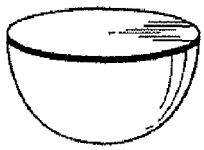
FIG. 91B is a perspective view showing a shape example of the feeding path in the present invention.
Figure 91C:
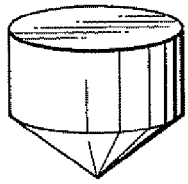
FIG. 91C is a perspective view showing a shape example of the feeding path in the present invention.

FIG. 89A is a perspective view of an antenna apparatus according to a seventeenth embodiment of the present invention, FIG. 89B is a perspective view showing a main portion (a passive element portion), and FIG. 90 is a side view of the antenna apparatus. The antenna apparatus according to the seventeenth embodiment has such a configuration that at least one, for example, four matching passive elements 21*a* to 21*d* are provided at approximately equal intervals about a feeding portion, namely, a central conductor 14 of a coaxial connector 12 protruded on the conductor plate 11 on a concentric circle thereof in the antenna apparatus according to sixteenth embodiment.

The abovementioned passive elements 21*a* to 21*d* are formed in an inverted L shape by, for example, using metal plates to fold their upper portions outwardly, namely, in opposite directions to the central conductor 14 by about 90° and they have horizontal portions 22*a* to 22*d*. The passive elements 21*a* to 21*d* are set, for example, such that a distance thereof from the central conductor 14 is about $0.026\lambda_L$, a width thereof is $0.019\lambda_L$, a height thereof is about $0.055\lambda_L$, and a length of the horizontal portions 22*a* to 22*d* is about $0.023\lambda_L$. The passive elements 21*a* to 21*d* may be disposed on rotated positions if they are positioned on a concentric circle and they may be provided on any positions on the concentric circle. The characteristic of the passive elements 21*a* to 21*d* can be finely adjusted according to their installation positions.

As a specific size example of the passive elements 21*a* to 21*d*, for example, setting is performed such that a distance from the central conductor 14 is about 17 mm, a width is 12 mm, a height is about 36 mm, and a length of the horizontal portion is about 15 mm when the lowest frequency in a working frequency band is 470 MHz.

In the antenna apparatus according to the seventeenth embodiment, the passive elements 21*a* to 21*d* serve as stubs, so that impedance characteristic can be kept in a stable state over a wideband.

As described above, since the antenna apparatus according to the present invention is compliant with a very wide band, and is reduced in size and has a low profile, it can be used as not only a relay unit for a ground wave digital broadcast in UHF band but also a relay unit for a mobile phone utilizing radio waves of, for example, 800 MHz, 1.5 GHz, 1.9 GHz, and 2.0 GHz. By adopting a size matching with a working frequency band, the antenna apparatus according to the present invention can produce a large effect when it is used as a relay station for mobile communication, wireless LAN (2.4 GHz band, 5 GHz band), further UWB (ultra wide band) or the like. In this case, since a circuit element such as an IC can be disposed in a space formed below the radiating elements 16*a* to 16*d*, a merit regarding mounting can be obtained. In a high frequency band such as GHz, an antenna can be further reduced in size, so that the antenna apparatus according to the present invention can be used in a mobile device. The antenna apparatus according to the present invention can be manufactured by applying conductive agent to dielectric or ceramic.

In the abovementioned fourteenth, fifteenth, and sixteenth embodiments, the feeding path 61B has been shown, but a feeding path having the shape shown in the sixth embodiment to the ninth embodiment may be used.

The feeding paths 61, 61A, 61B, and 61C shown in the above embodiments are formed such that their outer peripheral surfaces have the exponent function curve or the semi-elliptical shape or shapes similar to these shapes, but any shape where its end portion on the side of the feeding portion 18*c* is wider than its end portion on the side of the feeding terminal (the coaxial connector 12) can be adopted.

As shown in FIGS. 91A to 92B, for example, the feeding path can be formed in a conical shape (a triangle in side view) or a hemispherical shape (semicircular shape in side view), a shape obtained by combining a width-expanded portion and a vertical portion, a triangular pyramid shape, a quadrilateral shape, or the like. The feeding path is formed such that its end portion on the side of the feeding portion 18*c* is wider than its end portion on the side of the feeding terminal, but a feeding path having a shape where a portion positioned between the lower end and the upper end is made narrow can be adopted.

Figure 92A:
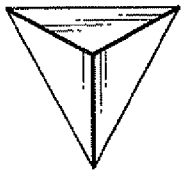
FIG. 92A is a perspective view showing another shape example of the feeding path in the present invention.
Figure 92B:
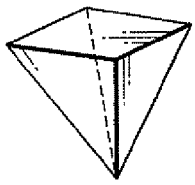
FIG. 92B is a perspective view showing another shape example of the feeding path in the present invention.

When a feeding path shown in the above FIG. 92A or 92B is used, three or four radiating elements are used. At this time, excellent symmetrical property of horizontal plane directionality can be obtained in use of the triangular pyramid shape shown in FIG. 92A when three radiating elements are provided, and it can be obtained in use of the quadrilateral shape when four radiating elements are provided. At this time, it is desirable that a midpoint of the radiating element in a widthwise direction is positioned at a corner of an upper end of the feeding path shown in FIG. 92A or 92B or a central portion of a side of the feeding path. However, it is not required to cause the number of radiating elements and the number of corners of the feeding path to coincide with each other necessarily.

That is, the present invention is not limited to each of the embodiments as it is, and it can be embodied at its implementation stage by modifying constituent elements without departing from the gist of the present invention. Various inventions can be made by combining a plurality of constituent elements disclosed in the respective embodiments properly. For example, some constituent elements can be removed from all the constituent elements shown in the respective embodiments. Further, constituent elements included in different embodiments can be combined properly.

An antenna apparatus according to the present invention is suitable as an antenna for relay which retransmits ground wave for a mobile phone, television broadcasting or the like to a blind zone such as a underground mall.

What is claimed is:

1. An antenna apparatus comprising:

a conductor plate;

an antenna element arranged to face the conductor plate and partially short-circuited to the conductor plate;

a feeding terminal provided on the conductor plate; and a feeding path connecting electrically the feeding terminal and a feeding portion of the radiating element to each other, wherein the antenna element comprises a plurality of plate-like radiating elements and a ring-shaped element, the plate-like radiating elements extending radially from the feeding portion at equal circumferentially spaced intervals and being short-circuited to the conductor plate at distal ends thereof, respectively, and the ring-shaped element comprises a plurality of line paths connecting distal end portions of adjacent plate-like radiating elements of the plurality of line paths.

2. The antenna apparatus according to claim 1, further comprising at least one passive element arranged on the conductor plate alongside the feeding path and comprising a metal plate having a vertical portion electromagnetically-coupled to the feeding path and a horizontal portion that is capacitance-coupled to the feeding portion or plate-like radiating elements near the feeding portion.

3. The antenna apparatus according to claim 1, wherein the feeding path has such a shape that a width thereof is expanded from the side of the feeding terminal toward the side of the feeding portion.

4. The antenna apparatus according to claim 3, wherein the feeding terminal is provided at a central portion of the conductor plate; and wherein the feeding path has one end connected to the feeding terminal and another end capacitance-coupled to a feeding portion of the radiating element.

5. The antenna apparatus according to claim 3, wherein one end of the feeding path is directly connected to the feeding portion.

6. The antenna apparatus according to one of claims 2 to 5, wherein the conductor plate further includes a plurality of matching plates near the short-circuiting portion of the radiating elements, respectively.

7. The antenna apparatus according to claim 6, wherein the plurality of matching plates is formed by bending corners of the conductor plate upwardly away from the conductor plate.

8. The antenna apparatus according to one of claims 1 to 5, wherein the short-circuiting portions of the radiating element are provided on the circumference of a circle about the feeding path at equal intervals.

9. The antenna apparatus according to one of claims 1 to 5, wherein the radiating element is defined as a first radiating element and a second radiating element having a facing distance between the conductor plate and the second radiating element shorter than a facing distance between the conductor plate and the first radiating element is further disposed between the conductor plate and the first radiating element.

10. The antenna apparatus according to one of claims 2 to 5, wherein a plane area of the conductor plate is formed in a square shape with side length of 0.5 $\lambda$ or more, wherein the plurality of line paths are set to about $\lambda/4$, and wherein a facing distance between the conductor plate and the radiating element is set to about $\lambda/10$ to $\lambda/16$ or about $\lambda/18$, where $\lambda$ is a wavelength of a lowest frequency in a working frequency band.

11. The antenna apparatus according to claim 3, wherein the width of the feeding path is represented by an exponent function curve or a semi-elliptical shape.

12. The antenna apparatus according to claim 11, wherein the exponent function curve or the semi-elliptical shape is approximately formed by stacking a plurality of circular metal plates having different diameters.

* * * * *